US012326075B2

(12) United States Patent
Yeung et al.

(10) Patent No.: US 12,326,075 B2
(45) Date of Patent: Jun. 10, 2025

(54) STAGE PROFILES FOR OPERATIONS OF HYDRAULIC SYSTEMS AND ASSOCIATED METHODS

(71) Applicant: BJ Energy Solutions, LLC, The Woodlands, TX (US)

(72) Inventors: Tony Yeung, The Woodlands, TX (US); Ricardo Rodriguez-Ramon, The Woodlands, TX (US); Joseph Foster, The Woodlands, TX (US)

(73) Assignee: BJ Energy Solutions, LLC, The Woodlands, TX (US)

( * ) Notice: Subject to any disclaimer, the term of this patent is extended or adjusted under 35 U.S.C. 154(b) by 0 days.

(21) Appl. No.: 18/596,860

(22) Filed: Mar. 6, 2024

(65) Prior Publication Data

US 2025/0084743 A1 Mar. 13, 2025

Related U.S. Application Data

(63) Continuation of application No. 18/072,478, filed on Nov. 30, 2022, now Pat. No. 11,952,878, which is a (Continued)

(51) Int. Cl.
*E21B 43/26* (2006.01)
*E21B 43/267* (2006.01)

(52) U.S. Cl.
CPC ..... *E21B 43/2607* (2020.05); *E21B 43/26* (2013.01); *E21B 43/267* (2013.01); *E21B 2200/22* (2020.05)

(58) Field of Classification Search
CPC .... E21B 43/2607; E21B 43/26; E21B 43/267; E21B 2200/22
See application file for complete search history.

(56) References Cited

U.S. PATENT DOCUMENTS 1,716,049 A 6/1929 Greve
1,726,633 A 9/1929 Smith
(Continued)

FOREIGN PATENT DOCUMENTS

AU 9609498 A 7/1999
AU 737970 B2 9/2001
(Continued)

OTHER PUBLICATIONS

4-Star Hose & Supply: "Frac Tank Hose (FRAC)," 1 Page, [Retrieved on Nov. 10, 2019] Retrieved from URL: http://www.4starhose.com/product/frac_tank_hose_frac.aspx.
(Continued)

*Primary Examiner* — Brad Harcourt
(74) *Attorney, Agent, or Firm* — Norton Rose Fulbright US LLP

(57) ABSTRACT

A system and method of enhancing operation of hydraulic fracturing equipment at a hydraulic fracturing wellsite may include determining if a hydraulic fracturing stage profiles are available for use for hydraulic fracturing equipment at a wellsite. The method may include prompting an acceptance or amendment of one of the hydraulic fracturing stage profiles for a hydraulic fracturing pumping stage. The method may include, in response to an amendment of one of the hydraulic fracturing stage profiles, prompting acceptance of the amended hydraulic fracturing stage profile as the current hydraulic fracturing stage profile for use in association with the controller. The method may include, when a hydraulic fracturing stage profile is not available, prompting configuration of hydraulic fracturing pumping stage parameters for the current hydraulic fracturing stage profile. The method may include storing the current hydraulic fracturing stage profile as the previous hydraulic fracturing stage profile in association with the controller.

20 Claims, 11 Drawing Sheets

Related U.S. Application Data continuation of application No. 17/555,919, filed on Dec. 20, 2021, now Pat. No. 11,598,188, which is a continuation of application No. 17/500,217, filed on Oct. 13, 2021, now Pat. No. 11,236,598, which is a continuation of application No. 17/308,330, filed on May 5, 2021, now Pat. No. 11,208,879, which is a continuation of application No. 17/182,489, filed on Feb. 23, 2021, now Pat. No. 11,028,677.

(60) Provisional application No. 62/705,356, filed on Jun. 23, 2020, provisional application No. 62/705,332, filed on Jun. 22, 2020.

(56) References Cited

U.S. PATENT DOCUMENTS

| | | | |
|---|---|---|---|
| 2,178,662 | A | 11/1939 | Lars et al. |
| 2,427,638 | A | 9/1947 | Vilter et al. |
| 2,498,229 | A | 2/1950 | Adler |
| 2,535,703 | A | 12/1950 | Smith et al. |
| 2,572,711 | A | 10/1951 | Fischer |
| 2,820,341 | A | 1/1958 | Amann |
| 2,868,004 | A | 1/1959 | Runde |
| 2,940,377 | A | 6/1960 | Darnell et al. |
| 2,947,141 | A | 8/1960 | Russ |
| 2,956,738 | A | 10/1960 | Af et al. |
| 3,068,796 | A | 12/1962 | Pfluger et al. |
| 3,191,517 | A | 6/1965 | Solzman, I |
| 3,257,031 | A | 6/1966 | Dietz |
| 3,274,768 | A | 9/1966 | Hans-Christof et al. |
| 3,378,074 | A | 4/1968 | Kiel |
| 3,382,671 | A | 5/1968 | Ehni, III et al. |
| 3,401,873 | A | 9/1968 | Privon et al. |
| 3,463,612 | A | 8/1969 | Whitsel, Jr. et al. |
| 3,496,880 | A | 2/1970 | Wolff et al. |
| 3,550,696 | A | 12/1970 | Kenneday et al. |
| 3,560,053 | A | 2/1971 | Ortloff et al. |
| 3,586,459 | A | 6/1971 | Zerlauth et al. |
| 3,632,222 | A | 1/1972 | Cronstedt et al. |
| 3,656,582 | A | 4/1972 | Alcock et al. |
| 3,667,868 | A | 6/1972 | Brunner et al. |
| 3,692,434 | A | 9/1972 | Schnear et al. |
| 3,739,872 | A | 6/1973 | McNair et al. |
| 3,757,581 | A | 9/1973 | Mankin et al. |
| 3,759,063 | A | 9/1973 | Bendall et al. |
| 3,765,173 | A | 10/1973 | Harris et al. |
| 3,771,916 | A | 11/1973 | Flanigan et al. |
| 3,773,438 | A | 11/1973 | Hall et al. |
| 3,781,135 | A | 12/1973 | Nickell et al. |
| 3,786,835 | A | 1/1974 | Finger et al. |
| 3,791,682 | A | 2/1974 | Mitchell et al. |
| 3,796,045 | A | 3/1974 | Foster et al. |
| 3,814,549 | A | 6/1974 | Cronstedt et al. |
| 3,820,922 | A | 6/1974 | Buse et al. |
| 3,847,511 | A | 11/1974 | Cole et al. |
| 3,866,108 | A | 2/1975 | Yannone et al. |
| 3,875,380 | A | 4/1975 | Rankin |
| 3,963,372 | A | 6/1976 | McLain et al. |
| 4,010,613 | A | 3/1977 | McInerney |
| 4,019,477 | A | 4/1977 | Overton |
| 4,031,407 | A | 6/1977 | Reed |
| 4,047,569 | A | 9/1977 | Tagirov et al. |
| 4,050,862 | A | 9/1977 | Buse |
| 4,059,045 | A | 11/1977 | Mcclain |
| 4,086,976 | A | 5/1978 | Holm et al. |
| 4,117,342 | A | 9/1978 | Melley, Jr. et al. |
| 4,173,121 | A | 11/1979 | Yu |
| 4,204,808 | A | 5/1980 | Clayton et al. |
| 4,209,079 | A | 6/1980 | Deschamps et al. |
| 4,209,979 | A | 7/1980 | Mattson et al. |
| 4,222,229 | A | 9/1980 | Uram |
| 4,239,396 | A | 12/1980 | Arribau et al. |
| 4,269,569 | A | 5/1981 | Hoover |
| 4,311,395 | A | 1/1982 | Douthitt et al. |
| 4,330,237 | A | 5/1982 | Battah |
| 4,341,508 | A | 7/1982 | Rambin, Jr. et al. |
| 4,357,027 | A | 11/1982 | Zeitlow |
| 4,383,478 | A | 5/1983 | Jones et al. |
| 4,402,504 | A | 9/1983 | Christian |
| 4,430,047 | A | 2/1984 | Ilg |
| 4,442,665 | A | 4/1984 | Fick et al. |
| 4,457,325 | A | 7/1984 | Green |
| 4,470,771 | A | 9/1984 | Hall et al. |
| 4,483,684 | A | 11/1984 | Black |
| 4,505,650 | A | 3/1985 | Hannett et al. |
| 4,574,880 | A | 3/1986 | Handke |
| 4,584,654 | A | 4/1986 | Crane |
| 4,620,330 | A | 11/1986 | Izzi, Sr. |
| 4,672,813 | A | 6/1987 | David |
| 4,754,607 | A | 7/1988 | Mackay |
| 4,782,244 | A | 11/1988 | Wakimoto |
| 4,796,777 | A | 1/1989 | Keller |
| 4,869,209 | A | 9/1989 | Young |
| 4,913,625 | A | 4/1990 | Gerlowski |
| 4,983,259 | A | 1/1991 | Duncan et al. |
| 4,990,058 | A | 2/1991 | Eslinger |
| 5,032,065 | A | 7/1991 | Yamamuro et al. |
| 5,135,361 | A | 8/1992 | Dion |
| 5,167,493 | A | 12/1992 | Kobari |
| 5,245,970 | A | 9/1993 | Iwaszkiewicz et al. |
| 5,275,041 | A | 1/1994 | Poulsen |
| 5,291,842 | A | 3/1994 | Sallstrom et al. |
| 5,326,231 | A | 7/1994 | Pandeya et al. |
| 5,362,219 | A | 11/1994 | Paul et al. |
| 5,482,116 | A | 1/1996 | El-Rabaa et al. |
| 5,511,956 | A | 4/1996 | Hasegawa et al. |
| 5,517,854 | A | 5/1996 | Plumb et al. |
| 5,537,813 | A | 7/1996 | Davis et al. |
| 5,553,514 | A | 9/1996 | Walkowc |
| 5,560,195 | A | 10/1996 | Anderson et al. |
| 5,586,444 | A | 12/1996 | Fung |
| 5,622,245 | A | 4/1997 | Reik et al. |
| 5,626,103 | A | 5/1997 | Haws et al. |
| 5,634,777 | A | 6/1997 | Albertin et al. |
| 5,651,400 | A | 7/1997 | Corts et al. |
| 5,678,460 | A | 10/1997 | Walkowc |
| 5,717,172 | A | 2/1998 | Griffin, Jr. et al. |
| 5,720,598 | A | 2/1998 | De |
| 5,761,084 | A | 6/1998 | Edwards |
| 5,811,676 | A | 9/1998 | Spalding et al. |
| 5,839,888 | A | 11/1998 | Harrison |
| 5,846,062 | A | 12/1998 | Yanagisawa et al. |
| 5,875,744 | A | 3/1999 | Vallejos |
| 5,983,962 | A | 11/1999 | Gerardot |
| 5,992,944 | A | 11/1999 | Hara |
| 6,041,856 | A | 3/2000 | Thrasher et al. |
| 6,050,080 | A | 4/2000 | Horner |
| 6,067,962 | A | 5/2000 | Bartley et al. |
| 6,071,188 | A | 6/2000 | O'Neill et al. |
| 6,074,170 | A | 6/2000 | Bert et al. |
| 6,123,751 | A | 9/2000 | Nelson et al. |
| 6,129,335 | A | 10/2000 | Yokogi |
| 6,145,318 | A | 11/2000 | Kaplan et al. |
| 6,230,481 | B1 | 5/2001 | Jahr |
| 6,279,309 | B1 | 8/2001 | Lawlor et al. |
| 6,321,860 | B1 | 11/2001 | Reddoch |
| 6,334,746 | B1 | 1/2002 | Nguyen et al. |
| 6,367,548 | B1 | 4/2002 | Purvis et al. |
| 6,401,472 | B2 | 6/2002 | Pollrich et al. |
| 6,530,224 | B1 | 3/2003 | Conchieri |
| 6,543,395 | B2 | 4/2003 | Green |
| 6,644,844 | B2 | 11/2003 | Neal et al. |
| 6,655,922 | B1 | 12/2003 | Flek |
| 6,669,453 | B1 | 12/2003 | Breeden et al. |
| 6,714,253 | B2 | 3/2004 | Kim et al. |
| 6,765,304 | B2 | 7/2004 | Baten et al. |
| 6,786,051 | B2 | 9/2004 | Kristich et al. |
| 6,832,900 | B2 | 12/2004 | Leu |
| 6,851,514 | B2 | 2/2005 | Han et al. |
| 6,859,740 | B2 | 2/2005 | Stephenson et al. |
| 6,901,735 | B2 | 6/2005 | Lohn |
| 6,935,424 | B2 | 8/2005 | Lehman et al. |
| 6,962,057 | B2 | 11/2005 | Kurokawa et al. |

(56) References Cited

U.S. PATENT DOCUMENTS 7,007,966 B2 3/2006 Campion
7,047,747 B2 5/2006 Tanaka
7,065,953 B1 6/2006 Kopko
7,143,016 B1 11/2006 Discenzo et al.
7,222,015 B2 5/2007 Davis et al.
7,281,519 B2 10/2007 Schroeder et al.
7,388,303 B2 6/2008 Seiver
7,404,294 B2 7/2008 Sundin
7,442,239 B2 10/2008 Armstrong et al.
7,516,793 B2 4/2009 Dykstra
7,524,173 B2 4/2009 Cummins
7,545,130 B2 6/2009 Latham
7,552,903 B2 6/2009 Dunn et al.
7,563,076 B2 7/2009 Brunet et al.
7,563,413 B2 7/2009 Naets et al.
7,574,325 B2 8/2009 Dykstra
7,581,379 B2 9/2009 Yoshida et al.
7,594,424 B2 9/2009 Fazekas
7,614,239 B2 11/2009 Herzog et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,779,961 B2 8/2010 Matte
7,789,452 B2 9/2010 Dempsey et al.
7,836,949 B2 11/2010 Dykstra
7,841,394 B2 11/2010 McNeel et al.
7,845,413 B2 12/2010 Shampine et al.
7,861,679 B2 1/2011 Lemke et al.
7,886,702 B2 2/2011 Jerrell et al.
7,900,724 B2 3/2011 Promersberger et al.
7,921,914 B2 4/2011 Bruins et al.
7,938,151 B2 5/2011 Hoeckner
7,955,056 B2 6/2011 Pettersson
7,980,357 B2 7/2011 Edwards
8,056,635 B2 11/2011 Shampine et al.
8,083,504 B2 12/2011 Williams et al.
8,099,942 B2 1/2012 Alexander et al.
8,186,334 B2 5/2012 Ooyama
8,196,555 B2 6/2012 Ikeda et al.
8,202,354 B2 6/2012 Iijima
8,316,936 B2 11/2012 Roddy et al.
8,336,631 B2 12/2012 Shampine et al.
8,388,317 B2 3/2013 Sung
8,414,673 B2 4/2013 Raje et al.
8,469,826 B2 6/2013 Brosowske
8,500,215 B2 8/2013 Gastauer et al.
8,506,267 B2 8/2013 Gambier et al.
8,575,873 B2 11/2013 Peterson et al.
8,616,005 B1 12/2013 Cousino, Sr.
8,621,873 B2 1/2014 Robertson et al.
8,641,399 B2 2/2014 Mucibabic et al.
8,656,990 B2 2/2014 Kajaria et al.
8,672,606 B2 3/2014 Glynn et al.
8,707,853 B1 4/2014 Dille et al.
8,708,667 B2 4/2014 Collingborn
8,714,253 B2 5/2014 Sherwood et al.
8,757,918 B2 6/2014 Ramnarain et al.
8,763,583 B2 7/2014 Hofbauer et al.
8,770,329 B2 7/2014 Spitler
8,784,081 B1 7/2014 Blume
8,789,601 B2 7/2014 Broussard et al.
8,794,307 B2 8/2014 Coquilleau et al.
8,801,394 B2 8/2014 Anderson
8,851,186 B2 10/2014 Shampine et al.
8,851,441 B2 10/2014 Acuna et al.
8,886,502 B2 11/2014 Walters et al.
8,894,356 B2 11/2014 Lafontaine et al.
8,905,056 B2 12/2014 Kendrick
8,951,019 B2 2/2015 Hains et al.
8,973,560 B2 3/2015 Krug
8,997,904 B2 4/2015 Cryer et al.
9,011,111 B2 4/2015 Lesko
9,016,383 B2 4/2015 Shampine et al.
9,032,620 B2 5/2015 Frassinelli et al.
9,057,247 B2 6/2015 Kumar et al.
9,097,249 B2 8/2015 Petersen
9,103,193 B2 8/2015 Coli et al.
9,121,257 B2 9/2015 Coli et al.
9,140,110 B2 9/2015 Coli et al.
9,175,810 B2 11/2015 Hains et al.
9,187,982 B2 11/2015 Dehring et al.
9,206,667 B2 12/2015 Khvoshchev et al.
9,212,643 B2 12/2015 Deliyski
9,217,318 B2 12/2015 Dusterhoft et al.
9,222,346 B1 12/2015 Walls
9,297,250 B2 3/2016 Dusterhoft et al.
9,324,049 B2 4/2016 Thomeer et al.
9,341,055 B2 5/2016 Weightman et al.
9,346,662 B2 5/2016 Van et al.
9,366,114 B2 6/2016 Coli et al.
9,376,786 B2 6/2016 Numasawa
9,394,829 B2 7/2016 Cabeen et al.
9,395,049 B2 7/2016 Vicknair et al.
9,401,670 B2 7/2016 Minato
9,410,406 B2 8/2016 Yuan
9,410,410 B2 8/2016 Broussard et al.
9,410,546 B2 8/2016 Jaeger et al.
9,429,078 B1 8/2016 Crowe et al.
9,435,333 B2 9/2016 McCoy et al.
9,488,169 B2 11/2016 Cochran et al.
9,493,997 B2 11/2016 Liu et al.
9,512,783 B2 12/2016 Veilleux, Jr. et al.
9,534,473 B2 1/2017 Morris et al.
9,546,652 B2 1/2017 Yin
9,550,501 B2 1/2017 Ledbetter et al.
9,556,721 B2 1/2017 Jang et al.
9,562,420 B2 2/2017 Morris et al.
9,570,945 B2 2/2017 Fischer
9,579,980 B2 2/2017 Cryer et al.
9,587,649 B2 3/2017 Oehring
9,593,710 B2 3/2017 Laimboeck et al.
9,611,728 B2 4/2017 Oehring
9,617,808 B2 4/2017 Liu et al.
9,638,101 B1 5/2017 Crowe et al.
9,638,194 B2 5/2017 Wiegman et al.
9,650,871 B2 5/2017 Oehring et al.
9,656,762 B2 5/2017 Kamath et al.
9,689,316 B1 6/2017 Crom
9,695,808 B2 7/2017 Giessbach et al.
9,739,130 B2 8/2017 Young
9,764,266 B1 9/2017 Carter
9,777,748 B2 10/2017 Lu et al.
9,803,467 B2 10/2017 Tang et al.
9,803,793 B2 10/2017 Davi et al.
9,809,308 B2 11/2017 Aguilar et al.
9,829,002 B2 11/2017 Crom
9,840,897 B2 12/2017 Larson
9,840,901 B2 12/2017 Oehring et al.
9,845,730 B2 12/2017 Betti et al.
9,850,422 B2 12/2017 Lestz et al.
9,856,131 B1 1/2018 Moffitt, Jr.
9,863,279 B2 1/2018 Laing et al.
9,869,305 B1 1/2018 Crowe et al.
9,871,406 B1 1/2018 Churnock et al.
9,879,609 B1 1/2018 Crowe et al.
RE46,725 E 2/2018 Case et al.
9,893,500 B2 2/2018 Oehring et al.
9,893,660 B2 2/2018 Peterson et al.
9,897,003 B2 2/2018 Motakef et al.
9,920,615 B2 3/2018 Zhang et al.
9,945,365 B2 4/2018 Hernandez et al.
9,964,052 B2 5/2018 Millican et al.
9,970,278 B2 5/2018 Broussard et al.
9,981,840 B2 5/2018 Shock
9,995,102 B2 6/2018 Dille et al.
9,995,218 B2 6/2018 Oehring et al.
10,008,880 B2 6/2018 Vicknair et al.
10,008,912 B2 6/2018 Davey et al.
10,018,096 B2 7/2018 Wallimann et al.
10,020,711 B2 7/2018 Oehring et al.
10,024,123 B2 7/2018 Steffenhagen et al.
10,029,289 B2 7/2018 Wendorski et al.
10,030,579 B2 7/2018 Austin et al.

(56) References Cited

U.S. PATENT DOCUMENTS

| | | | |
|---|---|---|---|
| 10,036,238 | B2 | 7/2018 | Oehring |
| 10,040,541 | B2 | 8/2018 | Wilson et al. |
| 10,060,293 | B2 | 8/2018 | Del |
| 10,060,349 | B2 | 8/2018 | Morales et al. |
| 10,077,933 | B2 | 9/2018 | Nelson et al. |
| 10,082,137 | B2 | 9/2018 | Graham et al. |
| 10,094,366 | B2 | 10/2018 | Marica |
| 10,100,827 | B2 | 10/2018 | Devan et al. |
| 10,107,084 | B2 | 10/2018 | Coli et al. |
| 10,107,085 | B2 | 10/2018 | Coli et al. |
| 10,114,061 | B2 | 10/2018 | Frampton et al. |
| 10,119,381 | B2 | 11/2018 | Oehring et al. |
| 10,125,750 | B2 | 11/2018 | Pfaff et al. |
| 10,134,257 | B2 | 11/2018 | Zhang et al. |
| 10,138,098 | B2 | 11/2018 | Sørensen et al. |
| 10,151,244 | B2 | 12/2018 | Giancotti et al. |
| 10,161,423 | B2 | 12/2018 | Rampen et al. |
| 10,174,599 | B2 | 1/2019 | Shampine et al. |
| 10,184,397 | B2 | 1/2019 | Austin et al. |
| 10,196,258 | B2 | 2/2019 | Kalala et al. |
| 10,221,856 | B2 | 3/2019 | Hernandez et al. |
| 10,227,854 | B2 | 3/2019 | Glass |
| 10,227,855 | B2 | 3/2019 | Coli et al. |
| 10,246,984 | B2 | 4/2019 | Payne et al. |
| 10,247,182 | B2 | 4/2019 | Zhang et al. |
| 10,253,598 | B2 | 4/2019 | Crews et al. |
| 10,254,732 | B2 | 4/2019 | Oehring et al. |
| 10,267,439 | B2 | 4/2019 | Pryce et al. |
| 10,280,724 | B2 | 5/2019 | Hinderliter |
| 10,287,943 | B1 | 5/2019 | Schiltz |
| 10,288,519 | B2 | 5/2019 | De |
| 10,303,190 | B2 | 5/2019 | Shock |
| 10,305,350 | B2 | 5/2019 | Johnson et al. |
| 10,316,832 | B2 | 6/2019 | Byrne |
| 10,317,875 | B2 | 6/2019 | Pandurangan et al. |
| 10,329,888 | B2 | 6/2019 | Urbancic et al. |
| 10,337,402 | B2 | 7/2019 | Austin et al. |
| 10,358,035 | B2 | 7/2019 | Cryer et al. |
| 10,371,012 | B2 | 8/2019 | Davis et al. |
| 10,374,485 | B2 | 8/2019 | Morris et al. |
| 10,378,326 | B2 | 8/2019 | Morris et al. |
| 10,393,108 | B2 | 8/2019 | Chong et al. |
| 10,407,990 | B2 | 9/2019 | Oehring et al. |
| 10,408,031 | B2 | 9/2019 | Oehring et al. |
| 10,415,348 | B2 | 9/2019 | Zhang et al. |
| 10,415,557 | B1 | 9/2019 | Crowe et al. |
| 10,415,562 | B2 | 9/2019 | Kajita et al. |
| 10,422,207 | B2 | 9/2019 | Aidagulov et al. |
| RE47,695 | E | 11/2019 | Case et al. |
| 10,465,689 | B2 | 11/2019 | Crom |
| 10,478,753 | B1 | 11/2019 | Elms et al. |
| 10,526,882 | B2 | 1/2020 | Oehring et al. |
| 10,563,649 | B2 | 2/2020 | Zhang et al. |
| 10,570,704 | B2 | 2/2020 | Colvin et al. |
| 10,577,908 | B2 | 3/2020 | Kisra et al. |
| 10,577,910 | B2 | 3/2020 | Stephenson |
| 10,584,645 | B2 | 3/2020 | Nakagawa et al. |
| 10,590,867 | B2 | 3/2020 | Thomassin et al. |
| 10,598,258 | B2 | 3/2020 | Oehring et al. |
| 10,605,060 | B2 | 3/2020 | Chuprakov et al. |
| 10,610,842 | B2 | 4/2020 | Chong |
| 10,655,442 | B2 | 5/2020 | Lecerf et al. |
| 10,662,749 | B1 | 5/2020 | Hill et al. |
| 10,677,961 | B1 | 6/2020 | Chen et al. |
| 10,711,787 | B1 | 7/2020 | Darley |
| 10,738,580 | B1 | 8/2020 | Fischer et al. |
| 10,753,153 | B1 | 8/2020 | Fischer et al. |
| 10,753,165 | B1 | 8/2020 | Fischer et al. |
| 10,760,416 | B2 | 9/2020 | Weng et al. |
| 10,760,556 | B1 | 9/2020 | Crom et al. |
| 10,794,165 | B2 | 10/2020 | Fischer et al. |
| 10,794,166 | B2 | 10/2020 | Reckels et al. |
| 10,801,311 | B1 | 10/2020 | Cui et al. |
| 10,815,764 | B1 | 10/2020 | Yeung et al. |
| 10,815,978 | B2 | 10/2020 | Glass |
| 10,830,032 | B1 | 11/2020 | Zhang et al. |
| 10,830,225 | B2 | 11/2020 | Repaci |
| 10,851,633 | B2 | 12/2020 | Harper |
| 10,859,203 | B1 | 12/2020 | Cui et al. |
| 10,864,487 | B1 | 12/2020 | Han et al. |
| 10,865,624 | B1 | 12/2020 | Cui et al. |
| 10,865,631 | B1 | 12/2020 | Zhang et al. |
| 10,870,093 | B1 | 12/2020 | Zhong et al. |
| 10,871,045 | B2 | 12/2020 | Fischer et al. |
| 10,892,596 | B2 | 1/2021 | Enya et al. |
| 10,895,202 | B1 | 1/2021 | Yeung et al. |
| 10,900,475 | B2 | 1/2021 | Weightman et al. |
| 10,907,459 | B1 | 2/2021 | Yeung et al. |
| 10,914,139 | B2 | 2/2021 | Shahri et al. |
| 10,920,538 | B2 | 2/2021 | Rodriguez et al. |
| 10,920,552 | B2 | 2/2021 | Rodriguez et al. |
| 10,927,774 | B2 | 2/2021 | Cai et al. |
| 10,927,802 | B2 | 2/2021 | Oehring et al. |
| 10,954,770 | B1 | 3/2021 | Yeung et al. |
| 10,954,855 | B1 | 3/2021 | Ji et al. |
| 10,961,614 | B1 | 3/2021 | Djavanroodi |
| 10,961,908 | B1 | 3/2021 | Yeung et al. |
| 10,961,912 | B1 | 3/2021 | Yeung et al. |
| 10,961,914 | B1 | 3/2021 | Yeung et al. |
| 10,961,993 | B1 | 3/2021 | Ji et al. |
| 10,961,995 | B2 | 3/2021 | Mayorca |
| 10,968,837 | B1 | 4/2021 | Yeung et al. |
| 10,982,523 | B1 | 4/2021 | Hill et al. |
| 10,989,019 | B2 | 4/2021 | Cai et al. |
| 10,989,180 | B2 | 4/2021 | Yeung et al. |
| 10,995,564 | B2 | 5/2021 | Miller et al. |
| 11,002,189 | B2 | 5/2021 | Yeung et al. |
| 11,008,950 | B2 | 5/2021 | Ethier et al. |
| 11,015,423 | B1 | 5/2021 | Yeung et al. |
| 11,015,536 | B2 | 5/2021 | Yeung et al. |
| 11,015,594 | B2 | 5/2021 | Yeung et al. |
| 11,022,526 | B1 | 6/2021 | Yeung et al. |
| 11,028,677 | B1 | 6/2021 | Yeung et al. |
| 11,035,213 | B2 | 6/2021 | Dusterhoft et al. |
| 11,035,214 | B2 | 6/2021 | Cui et al. |
| 11,047,379 | B1 | 6/2021 | Li et al. |
| 11,053,853 | B2 | 7/2021 | Li et al. |
| 11,060,455 | B1 | 7/2021 | Yeung et al. |
| 11,066,915 | B1 | 7/2021 | Yeung et al. |
| 11,068,455 | B2 | 7/2021 | Shabi et al. |
| 11,085,281 | B1 | 8/2021 | Yeung et al. |
| 11,085,282 | B2 | 8/2021 | Mazrooee et al. |
| 11,092,152 | B2 | 8/2021 | Yeung et al. |
| 11,098,651 | B1 | 8/2021 | Yeung et al. |
| 11,105,250 | B1 | 8/2021 | Zhang et al. |
| 11,105,266 | B2 | 8/2021 | Zhou et al. |
| 11,109,508 | B1 | 8/2021 | Yeung et al. |
| 11,111,768 | B1 | 9/2021 | Yeung et al. |
| 11,125,066 | B1 | 9/2021 | Yeung et al. |
| 11,125,156 | B2 | 9/2021 | Zhang et al. |
| 11,129,295 | B1 | 9/2021 | Yeung et al. |
| 11,143,000 | B2 | 10/2021 | Li et al. |
| 11,143,005 | B2 | 10/2021 | Dusterhoft et al. |
| 11,143,006 | B1 | 10/2021 | Zhang et al. |
| 11,149,533 | B1 | 10/2021 | Yeung et al. |
| 11,149,726 | B1 | 10/2021 | Yeung et al. |
| 11,156,159 | B1 | 10/2021 | Yeung et al. |
| 11,168,681 | B2 | 11/2021 | Boguski et al. |
| 11,174,716 | B1 | 11/2021 | Yeung et al. |
| 11,193,360 | B1 | 12/2021 | Yeung et al. |
| 11,193,361 | B1 | 12/2021 | Yeung et al. |
| 11,205,880 | B1 | 12/2021 | Zhou |
| 11,205,881 | B2 | 12/2021 | Makino |
| 11,208,879 | B1 | 12/2021 | Yeung et al. |
| 11,208,953 | B1 | 12/2021 | Yeung et al. |
| 11,220,895 | B1 | 1/2022 | Yeung et al. |
| 11,236,739 | B2 | 2/2022 | Yeung et al. |
| 11,242,737 | B2 | 2/2022 | Zhang et al. |
| 11,243,509 | B2 | 2/2022 | Cai et al. |
| 11,251,650 | B1 | 2/2022 | Liu et al. |
| 11,261,717 | B2 | 3/2022 | Yeung et al. |
| 11,268,346 | B2 | 3/2022 | Yeung et al. |
| 11,280,266 | B2 | 3/2022 | Yeung et al. |
| 11,306,835 | B1 | 4/2022 | Dille et al. |

(56) References Cited

U.S. PATENT DOCUMENTS

| | | | |
|---|---|---|---|
| RE49,083 | E | 5/2022 | Case et al. |
| 11,339,638 | B1 | 5/2022 | Yeung et al. |
| 11,346,200 | B2 | 5/2022 | Cai et al. |
| 11,373,058 | B2 | 6/2022 | Jaaskelainen et al. |
| RE49,140 | E | 7/2022 | Case et al. |
| 11,377,943 | B2 | 7/2022 | Kriebel et al. |
| RE49,155 | E | 8/2022 | Case et al. |
| RE49,156 | E | 8/2022 | Case et al. |
| 11,401,927 | B2 | 8/2022 | Li et al. |
| 11,428,165 | B2 | 8/2022 | Yeung et al. |
| 11,441,483 | B2 | 9/2022 | Li et al. |
| 11,448,122 | B2 | 9/2022 | Feng et al. |
| 11,466,680 | B2 | 10/2022 | Yeung et al. |
| 11,480,040 | B2 | 10/2022 | Han et al. |
| 11,492,887 | B2 | 11/2022 | Cui et al. |
| 11,499,405 | B2 | 11/2022 | Zhang et al. |
| 11,506,039 | B2 | 11/2022 | Zhang et al. |
| 11,512,570 | B2 | 11/2022 | Yeung et al. |
| 11,519,395 | B2 | 12/2022 | Zhang et al. |
| 11,519,405 | B2 | 12/2022 | Deng et al. |
| 11,530,602 | B2 | 12/2022 | Yeung et al. |
| 11,549,349 | B2 | 1/2023 | Wang et al. |
| 11,555,390 | B2 | 1/2023 | Cui et al. |
| 11,555,756 | B2 | 1/2023 | Yeung et al. |
| 11,557,887 | B2 | 1/2023 | Ji et al. |
| 11,560,779 | B2 | 1/2023 | Mao et al. |
| 11,560,845 | B2 | 1/2023 | Yeung et al. |
| 11,572,775 | B2 | 2/2023 | Mao et al. |
| 11,575,249 | B2 | 2/2023 | Ji et al. |
| 11,592,020 | B2 | 2/2023 | Chang et al. |
| 11,596,047 | B2 | 2/2023 | Liu et al. |
| 11,598,263 | B2 | 3/2023 | Yeung et al. |
| 11,603,797 | B2 | 3/2023 | Zhang et al. |
| 11,607,982 | B2 | 3/2023 | Tian et al. |
| 11,608,726 | B2 | 3/2023 | Zhang et al. |
| 11,624,326 | B2 | 4/2023 | Yeung et al. |
| 11,629,583 | B2 | 4/2023 | Yeung et al. |
| 11,629,589 | B2 | 4/2023 | Lin et al. |
| 11,649,766 | B1 | 5/2023 | Yeung et al. |
| 11,649,819 | B2 | 5/2023 | Gillispie |
| 11,662,384 | B2 | 5/2023 | Liu et al. |
| 11,668,173 | B2 | 6/2023 | Zhang et al. |
| 11,668,289 | B2 | 6/2023 | Chang et al. |
| 11,677,238 | B2 | 6/2023 | Liu et al. |
| 2002/0126922 | A1 | 9/2002 | Cheng et al. |
| 2002/0197176 | A1 | 12/2002 | Kondo |
| 2003/0031568 | A1 | 2/2003 | Stiefel |
| 2003/0061819 | A1 | 4/2003 | Kuroki et al. |
| 2003/0161212 | A1 | 8/2003 | Neal et al. |
| 2004/0016245 | A1 | 1/2004 | Pierson |
| 2004/0074238 | A1 | 4/2004 | Wantanabe et al. |
| 2004/0076526 | A1 | 4/2004 | Fukano et al. |
| 2004/0187950 | A1 | 9/2004 | Cohen et al. |
| 2004/0219040 | A1 | 11/2004 | Kugelev et al. |
| 2005/0051322 | A1 | 3/2005 | Speer |
| 2005/0056081 | A1 | 3/2005 | Gocho |
| 2005/0139286 | A1 | 6/2005 | Poulter et al. |
| 2005/0196298 | A1 | 9/2005 | Manning |
| 2005/0226754 | A1 | 10/2005 | Orr et al. |
| 2005/0274134 | A1 | 12/2005 | Ryu et al. |
| 2006/0061091 | A1 | 3/2006 | Osterloh |
| 2006/0062914 | A1 | 3/2006 | Garg et al. |
| 2006/0155473 | A1 | 7/2006 | Soliman et al. |
| 2006/0196251 | A1 | 9/2006 | Richey |
| 2006/0211356 | A1 | 9/2006 | Grassman |
| 2006/0228225 | A1 | 10/2006 | Rogers |
| 2006/0260331 | A1 | 11/2006 | Andreychuk |
| 2006/0272333 | A1 | 12/2006 | Sundin |
| 2007/0029090 | A1 | 2/2007 | Andreychuk et al. |
| 2007/0041848 | A1 | 2/2007 | Wood et al. |
| 2007/0066406 | A1 | 3/2007 | Keller et al. |
| 2007/0098580 | A1 | 5/2007 | Petersen |
| 2007/0107981 | A1 | 5/2007 | Sicotte |
| 2007/0125544 | A1 | 6/2007 | Robinson et al. |
| 2007/0169543 | A1 | 7/2007 | Fazekas |
| 2007/0181212 | A1 | 8/2007 | Fell |
| 2007/0272407 | A1 | 11/2007 | Lehman et al. |
| 2007/0277982 | A1 | 12/2007 | Shampine et al. |
| 2007/0295569 | A1 | 12/2007 | Manzoor et al. |
| 2008/0006089 | A1 | 1/2008 | Adnan et al. |
| 2008/0041594 | A1 | 2/2008 | Boles et al. |
| 2008/0098891 | A1 | 5/2008 | Feher et al. |
| 2008/0161974 | A1 | 7/2008 | Alston |
| 2008/0212275 | A1 | 9/2008 | Waryck et al. |
| 2008/0229757 | A1 | 9/2008 | Alexander et al. |
| 2008/0264625 | A1 | 10/2008 | Ochoa |
| 2008/0264649 | A1 | 10/2008 | Crawford |
| 2008/0298982 | A1 | 12/2008 | Pabst et al. |
| 2009/0053072 | A1 | 2/2009 | Borgstadt et al. |
| 2009/0064685 | A1 | 3/2009 | Busekros et al. |
| 2009/0068031 | A1 | 3/2009 | Gambier et al. |
| 2009/0092510 | A1 | 4/2009 | Williams et al. |
| 2009/0124191 | A1 | 5/2009 | Van Becelaere |
| 2009/0178412 | A1 | 7/2009 | Spytek |
| 2009/0212630 | A1 | 8/2009 | Flegel et al. |
| 2009/0249794 | A1 | 10/2009 | Wilkes et al. |
| 2009/0252616 | A1 | 10/2009 | Brunet et al. |
| 2009/0308602 | A1 | 12/2009 | Bruins et al. |
| 2010/0019626 | A1 | 1/2010 | Stout et al. |
| 2010/0071899 | A1 | 3/2010 | Coquilleau et al. |
| 2010/0218508 | A1 | 9/2010 | Brown et al. |
| 2010/0224365 | A1 | 9/2010 | Abad |
| 2010/0300683 | A1 | 12/2010 | Looper et al. |
| 2010/0310384 | A1 | 12/2010 | Stephenson et al. |
| 2011/0030963 | A1 | 2/2011 | Demong et al. |
| 2011/0041681 | A1 | 2/2011 | Duerr |
| 2011/0052423 | A1 | 3/2011 | Gambier et al. |
| 2011/0054704 | A1 | 3/2011 | Karpman et al. |
| 2011/0067857 | A1 | 3/2011 | Underhill et al. |
| 2011/0085924 | A1 | 4/2011 | Shampine et al. |
| 2011/0120702 | A1 | 5/2011 | Craig |
| 2011/0120705 | A1 | 5/2011 | Walters et al. |
| 2011/0120706 | A1 | 5/2011 | Craig |
| 2011/0120718 | A1 | 5/2011 | Craig |
| 2011/0125471 | A1 | 5/2011 | Craig et al. |
| 2011/0125476 | A1 | 5/2011 | Craig |
| 2011/0146244 | A1 | 6/2011 | Farman et al. |
| 2011/0146246 | A1 | 6/2011 | Farman et al. |
| 2011/0173991 | A1 | 7/2011 | Dean et al. |
| 2011/0197988 | A1 | 8/2011 | Van et al. |
| 2011/0241888 | A1 | 10/2011 | Lu et al. |
| 2011/0265443 | A1 | 11/2011 | Ansari et al. |
| 2011/0272158 | A1 | 11/2011 | Neal |
| 2012/0023973 | A1 | 2/2012 | Mayorca |
| 2012/0048242 | A1 | 3/2012 | Surnilla et al. |
| 2012/0085541 | A1 | 4/2012 | Love et al. |
| 2012/0137699 | A1 | 6/2012 | Montagne et al. |
| 2012/0179444 | A1 | 7/2012 | Ganguly et al. |
| 2012/0192542 | A1 | 8/2012 | Chillar et al. |
| 2012/0199001 | A1 | 8/2012 | Chillar et al. |
| 2012/0204627 | A1 | 8/2012 | Anderl et al. |
| 2012/0255734 | A1 | 10/2012 | Coli et al. |
| 2012/0310509 | A1 | 12/2012 | Pardo et al. |
| 2012/0324903 | A1 | 12/2012 | Dewis et al. |
| 2013/0068307 | A1 | 3/2013 | Hains et al. |
| 2013/0087045 | A1 | 4/2013 | Sullivan et al. |
| 2013/0087945 | A1 | 4/2013 | Kusters et al. |
| 2013/0134702 | A1 | 5/2013 | Boraas et al. |
| 2013/0140031 | A1 | 6/2013 | Cohen et al. |
| 2013/0189915 | A1 | 7/2013 | Hazard |
| 2013/0205798 | A1 | 8/2013 | Kwok et al. |
| 2013/0233165 | A1 | 9/2013 | Matzner et al. |
| 2013/0255953 | A1 | 10/2013 | Tudor |
| 2013/0259707 | A1 | 10/2013 | Yin |
| 2013/0284455 | A1 | 10/2013 | Kajaria et al. |
| 2013/0300341 | A1 | 11/2013 | Gillette, II |
| 2013/0306322 | A1 | 11/2013 | Sanborn et al. |
| 2014/0000668 | A1 | 1/2014 | Lessard |
| 2014/0010671 | A1 | 1/2014 | Cryer et al. |
| 2014/0013768 | A1 | 1/2014 | Laing et al. |
| 2014/0032082 | A1 | 1/2014 | Gehrke et al. |
| 2014/0044517 | A1 | 2/2014 | Saha et al. |
| 2014/0048253 | A1 | 2/2014 | Andreychuk |
| 2014/0090729 | A1 | 4/2014 | Coulter et al. |

(56) References Cited

U.S. PATENT DOCUMENTS

2014/0090742 A1 4/2014 Coskrey et al.
2014/0094105 A1 4/2014 Lundh et al.
2014/0095114 A1 4/2014 Thomeer et al.
2014/0095554 A1 4/2014 Thomeer et al.
2014/0123621 A1 5/2014 Driessens et al.
2014/0130422 A1 5/2014 Laing et al.
2014/0138079 A1 5/2014 Broussard et al.
2014/0144641 A1 5/2014 Chandler
2014/0147291 A1 5/2014 Burnette
2014/0158345 A1 6/2014 Jang et al.
2014/0174097 A1 6/2014 Hammer et al.
2014/0196459 A1 7/2014 Futa et al.
2014/0216736 A1 8/2014 Leugemors et al.
2014/0219824 A1 8/2014 Burnette
2014/0250845 A1 9/2014 Jackson et al.
2014/0251623 A1 9/2014 Lestz et al.
2014/0262232 A1 9/2014 Dusterhoft et al.
2014/0277772 A1 9/2014 Lopez et al.
2014/0290266 A1 10/2014 Veilleux, Jr. et al.
2014/0318638 A1 10/2014 Harwood et al.
2014/0322050 A1 10/2014 Marette et al.
2015/0027730 A1 1/2015 Hall et al.
2015/0075778 A1 3/2015 Walters et al.
2015/0078924 A1 3/2015 Zhang et al.
2015/0096739 A1 4/2015 Ghasripoor et al.
2015/0101344 A1 4/2015 Jarrier et al.
2015/0114652 A1 4/2015 Lestz et al.
2015/0129210 A1 5/2015 Chong et al.
2015/0135659 A1 5/2015 Jarrier et al.
2015/0159553 A1 6/2015 Kippel et al.
2015/0176387 A1 6/2015 Wutherich
2015/0192117 A1 7/2015 Bridges
2015/0204148 A1 7/2015 Liu et al.
2015/0204174 A1 7/2015 Kresse et al.
2015/0204322 A1 7/2015 Iund et al.
2015/0211512 A1 7/2015 Wiegman et al.
2015/0214816 A1 7/2015 Raad
2015/0217672 A1 8/2015 Shampine et al.
2015/0226140 A1 8/2015 Zhang et al.
2015/0252661 A1 9/2015 Glass
2015/0275891 A1 10/2015 Chong
2015/0337730 A1 11/2015 Kupiszewski et al.
2015/0340864 A1 11/2015 Compton
2015/0345385 A1 12/2015 Santini
2015/0369351 A1 12/2015 Hermann et al.
2016/0032703 A1 2/2016 Broussard et al.
2016/0032836 A1 2/2016 Hawkinson et al.
2016/0076447 A1 3/2016 Merlo et al.
2016/0090823 A1 3/2016 Alzahabi et al.
2016/0102581 A1 4/2016 Del Bono
2016/0105022 A1 4/2016 Oehring et al.
2016/0108705 A1 4/2016 Maxwell et al.
2016/0108713 A1 4/2016 Dunaeva et al.
2016/0123185 A1 5/2016 Le Pache et al.
2016/0168979 A1 6/2016 Zhang et al.
2016/0177675 A1 6/2016 Morris et al.
2016/0177945 A1 6/2016 Byrne et al.
2016/0186671 A1 6/2016 Austin et al.
2016/0195082 A1 7/2016 Wiegman et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0258267 A1 9/2016 Payne et al.
2016/0265330 A1 9/2016 Mazrooee et al.
2016/0265331 A1 9/2016 Weng et al.
2016/0273328 A1 9/2016 Oehring
2016/0273346 A1 9/2016 Tang et al.
2016/0290114 A1 10/2016 Oehring et al.
2016/0319650 A1 11/2016 Oehring et al.
2016/0326845 A1 11/2016 Djikpesse et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0045055 A1 2/2017 Hoefel et al.
2017/0051598 A1 2/2017 Ouenes
2017/0052087 A1 2/2017 Faqihi et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1 4/2017 Norris et al.
2017/0122310 A1 5/2017 Ladrón
2017/0131174 A1 5/2017 Enev et al.
2017/0145918 A1 5/2017 Oehring et al.
2017/0177992 A1 6/2017 Klie
2017/0191350 A1 7/2017 Johns et al.
2017/0218727 A1 8/2017 Oehring et al.
2017/0226839 A1 8/2017 Broussard et al.
2017/0226842 A1 8/2017 Omont et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0241671 A1 8/2017 Ahmad
2017/0247995 A1 8/2017 Crews et al.
2017/0248034 A1 8/2017 Dzieciol et al.
2017/0248208 A1 8/2017 Tamura
2017/0248308 A1 8/2017 Makarychev-Mikhailov et al.
2017/0254186 A1 9/2017 Aidagulov et al.
2017/0275149 A1 9/2017 Schmidt
2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0306936 A1 10/2017 Dole et al.
2017/0322086 A1 11/2017 Luharuka et al.
2017/0328179 A1 11/2017 Dykstra et al.
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0356470 A1 12/2017 Jaffrey
2017/0370199 A1 12/2017 Witkowski et al.
2017/0370480 A1 12/2017 Witkowski et al.
2018/0016895 A1 1/2018 Weng et al.
2018/0034280 A1 2/2018 Pedersen
2018/0038216 A1 2/2018 Zhang et al.
2018/0038328 A1 2/2018 Louven et al.
2018/0041093 A1 2/2018 Miranda
2018/0045202 A1 2/2018 Crom
2018/0058171 A1 3/2018 Roesner et al.
2018/0087499 A1 3/2018 Zhang et al.
2018/0087996 A1 3/2018 De La Cruz
2018/0149000 A1 5/2018 Roussel et al.
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney et al.
2018/0229998 A1 8/2018 Shock
2018/0230780 A1 8/2018 Klenner et al.
2018/0258746 A1 9/2018 Broussard et al.
2018/0266412 A1 9/2018 Stokkevåg et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0290877 A1 10/2018 Shock
2018/0291781 A1 10/2018 Pedrini
2018/0298731 A1 10/2018 Bishop
2018/0298735 A1 10/2018 Conrad

(56) References Cited

U.S. PATENT DOCUMENTS

2018/0307255 A1 10/2018 Bishop
2018/0313456 A1 11/2018 Bayyouk et al.
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0011051 A1 1/2019 Yeung
2019/0048993 A1 2/2019 Akiyama et al.
2019/0055836 A1 2/2019 Felkl et al.
2019/0063263 A1 2/2019 Davis et al.
2019/0063341 A1 2/2019 Davis
2019/0067991 A1 2/2019 Davis et al.
2019/0071946 A1 3/2019 Painter et al.
2019/0071992 A1 3/2019 Feng
2019/0072005 A1 3/2019 Fisher et al.
2019/0078471 A1 3/2019 Braglia et al.
2019/0088845 A1 3/2019 Sugi et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0128288 A1 5/2019 Konada et al.
2019/0131607 A1 5/2019 Gillette
2019/0136677 A1 5/2019 Shampine et al.
2019/0153843 A1 5/2019 Headrick
2019/0153938 A1 5/2019 Hammoud
2019/0154020 A1 5/2019 Glass
2019/0155318 A1 5/2019 Meunier
2019/0169962 A1 6/2019 Aqrawi et al.
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0211661 A1 7/2019 Reckels et al.
2019/0211814 A1 7/2019 Weightman et al.
2019/0217258 A1 7/2019 Bishop
2019/0226317 A1 7/2019 Payne et al.
2019/0245348 A1 8/2019 Hinderliter et al.
2019/0249652 A1 8/2019 Stephenson et al.
2019/0249754 A1 8/2019 Oehring et al.
2019/0257297 A1 8/2019 Botting et al.
2019/0264667 A1 8/2019 Byrne
2019/0277279 A1 9/2019 Byrne et al.
2019/0277295 A1 9/2019 Clyburn et al.
2019/0309585 A1 10/2019 Miller et al.
2019/0316447 A1 10/2019 Oehring et al.
2019/0316456 A1 10/2019 Beisel et al.
2019/0323337 A1 10/2019 Glass et al.
2019/0330923 A1 10/2019 Gable et al.
2019/0331117 A1 10/2019 Gable et al.
2019/0337392 A1 11/2019 Joshi et al.
2019/0338762 A1 11/2019 Curry et al.
2019/0345920 A1 11/2019 Surjaatmadja et al.
2019/0353103 A1 11/2019 Roberge
2019/0356199 A1 11/2019 Morris et al.
2019/0376449 A1 12/2019 Carrell
2019/0383123 A1 12/2019 Hinderliter
2020/0003205 A1 1/2020 Stokkevåg et al.
2020/0011165 A1 1/2020 George et al.
2020/0040878 A1 2/2020 Morris
2020/0049136 A1 2/2020 Stephenson
2020/0049153 A1 2/2020 Headrick et al.
2020/0071998 A1 3/2020 Oehring et al.
2020/0072201 A1 3/2020 Marica
2020/0088202 A1 3/2020 Sigmar et al.
2020/0095854 A1 3/2020 Hinderliter
2020/0109610 A1 4/2020 Husøy et al.
2020/0109616 A1 4/2020 Oehring et al.
2020/0132058 A1 4/2020 Mollatt
2020/0141219 A1 5/2020 Oehring et al.
2020/0141326 A1 5/2020 Redford et al.
2020/0141907 A1 5/2020 Meck et al.
2020/0166026 A1 5/2020 Marica
2020/0206704 A1 7/2020 Chong
2020/0208733 A1 7/2020 Kim
2020/0223648 A1 7/2020 Herman et al.
2020/0224645 A1 7/2020 Buckley
2020/0225381 A1 7/2020 Walles et al.
2020/0232454 A1 7/2020 Chretien et al.
2020/0256333 A1 8/2020 Surjaatmadja et al.
2020/0263498 A1 8/2020 Fischer et al.
2020/0263525 A1 8/2020 Reid et al.
2020/0263526 A1 8/2020 Fischer et al.
2020/0263527 A1 8/2020 Fischer et al.
2020/0263528 A1 8/2020 Fischer et al.
2020/0267888 A1 8/2020 Putz
2020/0291731 A1 9/2020 Haiderer et al.
2020/0295574 A1 9/2020 Batsch-Smith
2020/0300050 A1 9/2020 Oehring et al.
2020/0309027 A1 10/2020 Rytkönen
2020/0309113 A1 10/2020 Hunter et al.
2020/0325752 A1 10/2020 Clark et al.
2020/0325760 A1 10/2020 Markham
2020/0325761 A1 10/2020 Williams
2020/0325791 A1 10/2020 Himmelmann
2020/0325893 A1 10/2020 Kraige et al.
2020/0332784 A1 10/2020 Zhang et al.
2020/0332788 A1 10/2020 Cui et al.
2020/0340313 A1 10/2020 Fischer et al.
2020/0340322 A1 10/2020 Sizemore et al.
2020/0340340 A1 10/2020 Oehring et al.
2020/0340344 A1 10/2020 Reckels et al.
2020/0340404 A1 10/2020 Stockstill et al.
2020/0347725 A1 11/2020 Morris et al.
2020/0354928 A1 11/2020 Wehler et al.
2020/0355055 A1 11/2020 Dusterhoft et al.
2020/0362760 A1 11/2020 Morenko et al.
2020/0362764 A1 11/2020 Saintignan et al.
2020/0370394 A1 11/2020 Cai et al.
2020/0370408 A1 11/2020 Cai et al.
2020/0370429 A1 11/2020 Cai et al.
2020/0371490 A1 11/2020 Cai et al.
2020/0386169 A1 12/2020 Hinderliter et al.
2020/0386222 A1 12/2020 Pham et al.
2020/0388140 A1 12/2020 Gomez et al.
2020/0392826 A1 12/2020 Cui et al.
2020/0392827 A1 12/2020 George et al.
2020/0393088 A1 12/2020 Sizemore et al.
2020/0398238 A1 12/2020 Zhong et al.
2020/0400000 A1 12/2020 Ghasripoor et al.
2020/0400005 A1 12/2020 Han et al.
2020/0407625 A1 12/2020 Stephenson
2020/0408071 A1 12/2020 Li et al.
2020/0408144 A1 12/2020 Feng et al.
2020/0408147 A1 12/2020 Zhang et al.
2020/0408149 A1 12/2020 Li et al.
2021/0010361 A1 1/2021 Kriebel et al.
2021/0010362 A1 1/2021 Kriebel et al.
2021/0025324 A1 1/2021 Morris et al.
2021/0025383 A1 1/2021 Bodishbaugh et al.
2021/0032961 A1 2/2021 Hinderliter et al.
2021/0054727 A1 2/2021 Floyd
2021/0071503 A1 3/2021 Ogg et al.
2021/0071574 A1 3/2021 Feng et al.
2021/0071579 A1 3/2021 Li et al.
2021/0071654 A1 3/2021 Brunson, Jr.
2021/0071752 A1 3/2021 Cui et al.
2021/0079758 A1 3/2021 Yeung et al.
2021/0079851 A1 3/2021 Yeung et al.
2021/0086851 A1 3/2021 Zhang et al.
2021/0087883 A1 3/2021 Zhang et al.
2021/0087916 A1 3/2021 Zhang et al.

(56) References Cited

U.S. PATENT DOCUMENTS

2021/0087925 A1 3/2021 Heidari et al.
2021/0087943 A1 3/2021 Cui et al.
2021/0088042 A1 3/2021 Zhang et al.
2021/0123425 A1 4/2021 Cui et al.
2021/0123434 A1 4/2021 Cui et al.
2021/0123435 A1 4/2021 Cui et al.
2021/0131409 A1 5/2021 Cui et al.
2021/0140416 A1 5/2021 Buckley
2021/0148208 A1 5/2021 Thomas et al.
2021/0156240 A1 5/2021 Cicci et al.
2021/0156241 A1 5/2021 Cook
2021/0172282 A1 6/2021 Wang et al.
2021/0180517 A1 6/2021 Zhou et al.
2021/0190045 A1 6/2021 Zhang et al.
2021/0199110 A1 7/2021 Albert et al.
2021/0222690 A1 7/2021 Beisel
2021/0239112 A1 8/2021 Buckley
2021/0246774 A1 8/2021 Cui et al.
2021/0270261 A1 9/2021 Zhang et al.
2021/0270264 A1 9/2021 Byrne et al.
2021/0285311 A1 9/2021 Ji et al.
2021/0285432 A1 9/2021 Ji et al.
2021/0301807 A1 9/2021 Cui et al.
2021/0301815 A1 9/2021 Chretien et al.
2021/0306720 A1 9/2021 Sandoval et al.
2021/0308638 A1 10/2021 Zhong et al.
2021/0324718 A1 10/2021 Anders
2021/0348475 A1 11/2021 Yeung et al.
2021/0348476 A1 11/2021 Yeung et al.
2021/0348477 A1 11/2021 Yeung et al.
2021/0355927 A1 11/2021 Jian et al.
2021/0372394 A1 12/2021 Bagulayan et al.
2021/0372395 A1 12/2021 Li et al.
2021/0376413 A1 12/2021 Asfha
2021/0388760 A1 12/2021 Feng et al.
2022/0082007 A1 3/2022 Zhang et al.
2022/0090476 A1 3/2022 Zhang et al.
2022/0090477 A1 3/2022 Zhang et al.
2022/0090478 A1 3/2022 Zhang et al.
2022/0112892 A1 4/2022 Cui et al.
2022/0120262 A1 4/2022 Ji et al.
2022/0145740 A1 5/2022 Yuan et al.
2022/0154775 A1 5/2022 Liu et al.
2022/0155373 A1 5/2022 Liu et al.
2022/0162931 A1 5/2022 Zhong et al.
2022/0162991 A1 5/2022 Zhang et al.
2022/0181859 A1 6/2022 Ji et al.
2022/0186724 A1 6/2022 Chang et al.
2022/0213777 A1 7/2022 Cui et al.
2022/0220836 A1 7/2022 Zhang et al.
2022/0224087 A1 7/2022 Ji et al.
2022/0228468 A1 7/2022 Cui et al.
2022/0228469 A1 7/2022 Zhang et al.
2022/0235639 A1 7/2022 Zhang et al.
2022/0235640 A1 7/2022 Mao et al.
2022/0235641 A1 7/2022 Zhang et al.
2022/0235642 A1 7/2022 Zhang et al.
2022/0235802 A1 7/2022 Jiang et al.
2022/0242297 A1 8/2022 Tian et al.
2022/0243613 A1 8/2022 Ji et al.
2022/0243724 A1 8/2022 Li et al.
2022/0250000 A1 8/2022 Zhang et al.
2022/0255319 A1 8/2022 Liu et al.
2022/0258659 A1 8/2022 Cui et al.
2022/0259947 A1 8/2022 Li et al.
2022/0259964 A1 8/2022 Zhang et al.
2022/0268201 A1 8/2022 Feng et al.
2022/0282606 A1 9/2022 Zhong et al.
2022/0282726 A1 9/2022 Zhang et al.
2022/0290549 A1 9/2022 Zhang et al.
2022/0294194 A1 9/2022 Cao et al.
2022/0298906 A1 9/2022 Zhong et al.
2022/0307359 A1 9/2022 Liu et al.
2022/0307424 A1 9/2022 Wang et al.
2022/0314248 A1 10/2022 Ge et al.
2022/0315347 A1 10/2022 Liu et al.
2022/0316306 A1 10/2022 Liu et al.
2022/0316362 A1 10/2022 Zhang et al.
2022/0316461 A1 10/2022 Wang et al.
2022/0325608 A1 10/2022 Zhang et al.
2022/0330411 A1 10/2022 Liu et al.
2022/0333471 A1 10/2022 Zhong et al.
2022/0339646 A1 10/2022 Yu et al.
2022/0341358 A1 10/2022 Ji et al.
2022/0341362 A1 10/2022 Feng et al.
2022/0341415 A1 10/2022 Deng et al.
2022/0345007 A1 10/2022 Liu et al.
2022/0349345 A1 11/2022 Zhang et al.
2022/0353980 A1 11/2022 Liu et al.
2022/0361309 A1 11/2022 Liu et al.
2022/0364452 A1 11/2022 Wang et al.
2022/0364453 A1 11/2022 Chang et al.
2022/0372865 A1 11/2022 Lin et al.
2022/0376280 A1 11/2022 Shao et al.
2022/0381126 A1 12/2022 Cui et al.
2022/0389799 A1 12/2022 Mao et al.
2022/0389803 A1 12/2022 Zhang et al.
2022/0389804 A1 12/2022 Cui et al.
2022/0389865 A1 12/2022 Feng et al.
2022/0389867 A1 12/2022 Li et al.
2022/0412196 A1 12/2022 Cui et al.
2022/0412199 A1 12/2022 Mao et al.
2022/0412200 A1 12/2022 Zhang et al.
2022/0412258 A1 12/2022 Li et al.
2022/0412379 A1 12/2022 Wang et al.
2023/0001524 A1 1/2023 Jiang et al.
2023/0003238 A1 1/2023 Du et al.
2023/0015132 A1 1/2023 Feng et al.
2023/0015529 A1 1/2023 Zhang et al.
2023/0015581 A1 1/2023 Ji et al.
2023/0017968 A1 1/2023 Deng et al.
2023/0029574 A1 2/2023 Zhang et al.
2023/0029671 A1 2/2023 Han et al.
2023/0036118 A1 2/2023 Xing et al.
2023/0040970 A1 2/2023 Liu et al.
2023/0042379 A1 2/2023 Zhang et al.
2023/0047033 A1 2/2023 Fu et al.
2023/0048551 A1 2/2023 Feng et al.
2023/0049462 A1 2/2023 Zhang et al.
2023/0064964 A1 3/2023 Wang et al.
2023/0074794 A1 3/2023 Liu et al.
2023/0085124 A1 3/2023 Zhong et al.
2023/0092506 A1 3/2023 Zhong et al.
2023/0092705 A1 3/2023 Liu et al.
2023/0106683 A1 4/2023 Zhang et al.
2023/0107300 A1 4/2023 Huang et al.
2023/0107791 A1 4/2023 Zhang et al.
2023/0109018 A1 4/2023 Du et al.
2023/0116458 A1 4/2023 Liu et al.
2023/0117362 A1 4/2023 Zhang et al.
2023/0119725 A1 4/2023 Wang et al.
2023/0119876 A1 4/2023 Mao et al.
2023/0119896 A1 4/2023 Zhang et al.
2023/0120810 A1 4/2023 Fu et al.
2023/0121251 A1 4/2023 Cui et al.
2023/0124444 A1 4/2023 Chang et al.
2023/0138582 A1 5/2023 Li et al.
2023/0144116 A1 5/2023 Li et al.
2023/0145963 A1 5/2023 Zhang et al.
2023/0151722 A1 5/2023 Cui et al.
2023/0151723 A1 5/2023 Ji et al.
2023/0152793 A1 5/2023 Wang et al.
2023/0160289 A1 5/2023 Cui et al.
2023/0160510 A1 5/2023 Bao et al.
2023/0163580 A1 5/2023 Ji et al.
2023/0167776 A1 6/2023 Cui et al.

FOREIGN PATENT DOCUMENTS

CA 2043184 C 8/1994
CA 2829762 A1 9/2012
CA 2737321 C 9/2013
CA 2693567 C 9/2014
CA 2964597 A1 10/2017

(56) References Cited

FOREIGN PATENT DOCUMENTS

| | | | |
|---|---|---|---|
| CA | 2876687 | C | 4/2019 |
| CA | 3138533 | A1 | 11/2020 |
| CA | 2919175 | C | 3/2021 |
| CN | 2622404 | Y | 6/2004 |
| CN | 2779054 | Y | 5/2006 |
| CN | 2890325 | Y | 4/2007 |
| CN | 200964929 | Y | 10/2007 |
| CN | 201190660 | Y | 2/2009 |
| CN | 201190892 | Y | 2/2009 |
| CN | 201190893 | Y | 2/2009 |
| CN | 201215073 | Y | 4/2009 |
| CN | 201236650 | Y | 5/2009 |
| CN | 201275542 | Y | 7/2009 |
| CN | 201275801 | Y | 7/2009 |
| CN | 201333385 | Y | 10/2009 |
| CN | 201443300 | U | 4/2010 |
| CN | 201496415 | U | 6/2010 |
| CN | 201501365 | U | 6/2010 |
| CN | 201507271 | U | 6/2010 |
| CN | 101323151 | B | 7/2010 |
| CN | 201560210 | U | 8/2010 |
| CN | 201581862 | U | 9/2010 |
| CN | 201610728 | U | 10/2010 |
| CN | 201610751 | U | 10/2010 |
| CN | 201618530 | U | 11/2010 |
| CN | 201661255 | U | 12/2010 |
| CN | 101949382 | A | 1/2011 |
| CN | 201756927 | U | 3/2011 |
| CN | 101414171 | B | 5/2011 |
| CN | 102128011 | A | 7/2011 |
| CN | 102182904 | A | 9/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | B | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 203050598 | U | 7/2013 |
| CN | 103245523 | A | 8/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | U | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |
| CN | 203876633 | U | 10/2014 |
| CN | 203876636 | U | 10/2014 |

(56) References Cited

FOREIGN PATENT DOCUMENTS

| | | | |
|---|---|---|---|
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104358536 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563998 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 103233715 | B | 12/2015 |
| CN | 103790927 | B | 12/2015 |
| CN | 105207097 | A | 12/2015 |
| CN | 204831952 | U | 12/2015 |
| CN | 204899777 | U | 12/2015 |
| CN | 102602323 | B | 1/2016 |
| CN | 204944834 | U | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 205260249 | U | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | U | 9/2016 |
| CN | 106121577 | A | 11/2016 |
| CN | 205709587 | U | 11/2016 |
| CN | 104612928 | B | 12/2016 |
| CN | 106246120 | A | 12/2016 |
| CN | 205805471 | U | 12/2016 |
| CN | 106321045 | A | 1/2017 |
| CN | 205858306 | U | 1/2017 |
| CN | 205937833 | U | 2/2017 |
| CN | 104563994 | B | 3/2017 |
| CN | 206129196 | U | 4/2017 |
| CN | 104369687 | B | 5/2017 |
| CN | 106715165 | A | 5/2017 |
| CN | 106761561 | A | 5/2017 |
| CN | 104820372 | B | 6/2017 |
| CN | 105240064 | B | 6/2017 |
| CN | 206237147 | U | 6/2017 |
| CN | 206287832 | U | 6/2017 |
| CN | 206346711 | U | 7/2017 |
| CN | 104563995 | B | 9/2017 |
| CN | 107120822 | A | 9/2017 |
| CN | 107143298 | A | 9/2017 |
| CN | 107159046 | A | 9/2017 |
| CN | 107188018 | A | 9/2017 |
| CN | 206496016 | U | 9/2017 |
| CN | 104564033 | B | 10/2017 |
| CN | 107234358 | A | 10/2017 |
| CN | 107261975 | A | 10/2017 |
| CN | 206581929 | U | 10/2017 |
| CN | 105092401 | B | 12/2017 |
| CN | 107476769 | A | 12/2017 |
| CN | 206754664 | U | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |
| CN | 206985503 | U | 2/2018 |
| CN | 207017968 | U | 2/2018 |
| CN | 107859053 | A | 3/2018 |
| CN | 207057867 | U | 3/2018 |
| CN | 207085817 | U | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | A | 4/2018 |
| CN | 207169595 | U | 4/2018 |
| CN | 207194873 | U | 4/2018 |
| CN | 207245674 | U | 4/2018 |
| CN | 108034466 | A | 5/2018 |
| CN | 108036071 | A | 5/2018 |
| CN | 207380566 | U | 5/2018 |

(56) References Cited

FOREIGN PATENT DOCUMENTS

| | | | |
|---|---|---|---|
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | U | 7/2018 |
| CN | 207634064 | U | 7/2018 |
| CN | 207648054 | U | 7/2018 |
| CN | 207650621 | U | 7/2018 |
| CN | 108371894 | A | 8/2018 |
| CN | 207777153 | U | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | U | 9/2018 |
| CN | 207814698 | U | 9/2018 |
| CN | 207862275 | U | 9/2018 |
| CN | 108687954 | A | 10/2018 |
| CN | 207935270 | U | 10/2018 |
| CN | 207961582 | U | 10/2018 |
| CN | 207964530 | U | 10/2018 |
| CN | 108789848 | A | 11/2018 |
| CN | 108799473 | A | 11/2018 |
| CN | 108868675 | A | 11/2018 |
| CN | 208086829 | U | 11/2018 |
| CN | 208089263 | U | 11/2018 |
| CN | 208169068 | U | 11/2018 |
| CN | 108979569 | A | 12/2018 |
| CN | 109027662 | A | 12/2018 |
| CN | 109058092 | A | 12/2018 |
| CN | 208179454 | U | 12/2018 |
| CN | 208179502 | U | 12/2018 |
| CN | 208253147 | U | 12/2018 |
| CN | 208260574 | U | 12/2018 |
| CN | 109114418 | A | 1/2019 |
| CN | 109141990 | A | 1/2019 |
| CN | 208313120 | U | 1/2019 |
| CN | 208330319 | U | 1/2019 |
| CN | 208342730 | U | 1/2019 |
| CN | 208430982 | U | 1/2019 |
| CN | 208430986 | U | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | U | 3/2019 |
| CN | 208564516 | U | 3/2019 |
| CN | 208564525 | U | 3/2019 |
| CN | 208564918 | U | 3/2019 |
| CN | 208576026 | U | 3/2019 |
| CN | 208576042 | U | 3/2019 |
| CN | 208650818 | U | 3/2019 |
| CN | 208669244 | U | 3/2019 |
| CN | 109555484 | A | 4/2019 |
| CN | 109682881 | A | 4/2019 |
| CN | 208730959 | U | 4/2019 |
| CN | 208735264 | U | 4/2019 |
| CN | 208746733 | U | 4/2019 |
| CN | 208749529 | U | 4/2019 |
| CN | 208750405 | U | 4/2019 |
| CN | 208764658 | U | 4/2019 |
| CN | 109736740 | A | 5/2019 |
| CN | 109751007 | A | 5/2019 |
| CN | 208868428 | U | 5/2019 |
| CN | 208870761 | U | 5/2019 |
| CN | 109869294 | A | 6/2019 |
| CN | 109882144 | A | 6/2019 |
| CN | 109882372 | A | 6/2019 |
| CN | 209012047 | U | 6/2019 |
| CN | 209100025 | U | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | U | 9/2019 |
| CN | 110374745 | A | 10/2019 |
| CN | 209534736 | U | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | U | 11/2019 |
| CN | 209653968 | U | 11/2019 |
| CN | 209654004 | U | 11/2019 |
| CN | 209654022 | U | 11/2019 |
| CN | 209654128 | U | 11/2019 |
| CN | 209656622 | U | 11/2019 |
| CN | 107849130 | B | 12/2019 |
| CN | 108087050 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | U | 12/2019 |
| CN | 209780827 | U | 12/2019 |
| CN | 209798631 | U | 12/2019 |
| CN | 209799942 | U | 12/2019 |
| CN | 209800178 | U | 12/2019 |
| CN | 209855723 | U | 12/2019 |
| CN | 209855742 | U | 12/2019 |
| CN | 209875063 | U | 12/2019 |
| CN | 110656919 | A | 1/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | U | 2/2020 |
| CN | 210049882 | U | 2/2020 |
| CN | 210097596 | U | 2/2020 |
| CN | 210105817 | U | 2/2020 |
| CN | 210105818 | U | 2/2020 |
| CN | 210105993 | U | 2/2020 |
| CN | 110873093 | A | 3/2020 |
| CN | 210139911 | U | 3/2020 |
| CN | 110947681 | A | 4/2020 |
| CN | 111058810 | A | 4/2020 |
| CN | 111075391 | A | 4/2020 |
| CN | 210289931 | U | 4/2020 |
| CN | 210289932 | U | 4/2020 |
| CN | 210289933 | U | 4/2020 |
| CN | 210303516 | U | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |

(56) References Cited

FOREIGN PATENT DOCUMENTS

| | | | |
|---|---|---|---|
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | U | 5/2020 |
| CN | 210460875 | U | 5/2020 |
| CN | 210522432 | U | 5/2020 |
| CN | 210598943 | U | 5/2020 |
| CN | 210598945 | U | 5/2020 |
| CN | 210598946 | U | 5/2020 |
| CN | 210599194 | U | 5/2020 |
| CN | 210599303 | U | 5/2020 |
| CN | 210600110 | U | 5/2020 |
| CN | 111219326 | A | 6/2020 |
| CN | 111350595 | A | 6/2020 |
| CN | 210660319 | U | 6/2020 |
| CN | 210714569 | U | 6/2020 |
| CN | 210769168 | U | 6/2020 |
| CN | 210769169 | U | 6/2020 |
| CN | 210769170 | U | 6/2020 |
| CN | 210770133 | U | 6/2020 |
| CN | 210825844 | U | 6/2020 |
| CN | 210888904 | U | 6/2020 |
| CN | 210888905 | U | 6/2020 |
| CN | 210889242 | U | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | U | 8/2020 |
| CN | 211201920 | U | 8/2020 |
| CN | 211202218 | U | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | U | 9/2020 |
| CN | 211397553 | U | 9/2020 |
| CN | 211397677 | U | 9/2020 |
| CN | 211412945 | U | 9/2020 |
| CN | 211500955 | U | 9/2020 |
| CN | 211524765 | U | 9/2020 |
| DE | 4004854 | A1 | 8/1991 |
| DE | 4241614 | A1 | 6/1994 |
| DE | 102009022859 | A1 | 12/2010 |
| DE | 102012018825 | A1 | 3/2014 |
| DE | 102013111655 | A1 | 12/2014 |
| DE | 102015103872 | A1 | 10/2015 |
| DE | 102013114335 | B4 | 12/2020 |
| EP | 0835983 | A2 | 4/1998 |
| EP | 1378683 | A2 | 1/2004 |
| EP | 2143916 | A1 | 1/2010 |
| EP | 2613023 | A2 | 7/2013 |
| EP | 3095989 | A1 | 11/2016 |
| EP | 3211766 | A1 | 8/2017 |
| EP | 3049642 | B1 | 4/2018 |
| EP | 3354866 | A1 | 8/2018 |
| EP | 3075946 | B1 | 5/2019 |
| FR | 2795774 | A1 | 1/2001 |
| GB | 474072 | A | 10/1937 |
| GB | 1438172 | A | 6/1976 |
| JP | S57135212 | A | 8/1982 |
| KR | 20020026398 | A | 4/2002 |
| RU | 13562 | U1 | 4/2000 |
| WO | WO-9320328 | A1 | 10/1993 |
| WO | WO-2006025886 | A2 | 3/2006 |
| WO | WO-2009023042 | A1 | 2/2009 |
| WO | WO-2011119668 | A1 | 9/2011 |
| WO | WO-2011133821 | A2 | 10/2011 |
| WO | WO-2012139380 | A1 | 10/2012 |
| WO | WO-2013158822 | A1 | 10/2013 |
| WO | WO-2013163786 | A1 | 11/2013 |
| WO | WO-2013185399 | A1 | 12/2013 |
| WO | WO-2015073005 | A1 | 5/2015 |
| WO | WO-2015158020 | A1 | 10/2015 |
| WO | WO-2016014476 | A1 | 1/2016 |
| WO | WO-2016033983 | A1 | 3/2016 |
| WO | WO-2016078181 | A1 | 5/2016 |
| WO | WO-2016086138 | A1 | 6/2016 |
| WO | WO-2016101374 | A1 | 6/2016 |
| WO | WO-2016112590 | A1 | 7/2016 |
| WO | WO-2016186790 | A1 | 11/2016 |
| WO | WO-2017123656 | A2 | 7/2017 |
| WO | WO-2017146279 | A1 | 8/2017 |
| WO | WO-2017213848 | A1 | 12/2017 |
| WO | WO-2018031029 | A1 | 2/2018 |
| WO | WO-2018031031 | A1 | 2/2018 |
| WO | WO-2018038710 | A1 | 3/2018 |
| WO | WO-2018044293 | A1 | 3/2018 |
| WO | WO-2018044307 | A1 | 3/2018 |
| WO | WO-2018071738 | A1 | 4/2018 |
| WO | WO-2018075034 | A1 | 4/2018 |
| WO | WO-2018084871 | A1 | 5/2018 |
| WO | WO-2018101909 | A1 | 6/2018 |
| WO | WO-2018101912 | A1 | 6/2018 |
| WO | WO-2018106210 | A1 | 6/2018 |
| WO | WO-2018106225 | A1 | 6/2018 |
| WO | WO-2018106252 | A1 | 6/2018 |
| WO | WO-2018125176 | A1 | 7/2018 |
| WO | WO-2018132106 | A1 | 7/2018 |
| WO | WO-2018152051 | A1 | 8/2018 |
| WO | WO-2018156131 | A1 | 8/2018 |
| WO | WO-2018160171 | A1 | 9/2018 |
| WO | WO-2018187346 | A1 | 10/2018 |
| WO | WO-2019045691 | A1 | 3/2019 |
| WO | WO-2019046680 | A1 | 3/2019 |
| WO | WO-2019060922 | A1 | 3/2019 |
| WO | WO-2019117862 | A1 | 6/2019 |
| WO | WO-2019126742 | A1 | 6/2019 |
| WO | WO-2019147601 | A1 | 8/2019 |
| WO | WO-2019169366 | A1 | 9/2019 |
| WO | WO-2019195651 | A1 | 10/2019 |
| WO | WO-2019200510 | A1 | 10/2019 |
| WO | WO-2019210417 | A1 | 11/2019 |
| WO | WO-2020018068 | A1 | 1/2020 |
| WO | WO-2020046866 | A1 | 3/2020 |
| WO | WO-2020072076 | A1 | 4/2020 |
| WO | WO-2020076569 | A1 | 4/2020 |
| WO | WO-2020097060 | A2 | 5/2020 |
| WO | WO-2020104088 | A1 | 5/2020 |
| WO | WO-2020131085 | A1 | 6/2020 |
| WO | WO-2020211083 | A1 | 10/2020 |
| WO | WO-2020211086 | A1 | 10/2020 |
| WO | WO-2021038604 | A1 | 3/2021 |
| WO | WO-2021041783 | A1 | 3/2021 |

OTHER PUBLICATIONS

AFD Petroleum Ltd: "Automated Hot Zone Frac Refueling System," Dec. 2018, 2 Pages.

Afglobal Corporation: "Durastim Hydraulic Fracturing Pump," A Revolutionary Design for Continuous Duty Hydraulic Fracturing, 2018, 4 Pages.

Ahmadzadehtalatapeh M., et al., Performance Enhancement of Gas Turbine Units by Retrofitting With Inlet Air Cooling Technologies (IACTs): An Hour-by-Hour Simulation Study, Journal of the Brazilian Society of Mechanical Sciences and Engineering, Mar. 2020, 29 Pages.

Akita E., et al., "Mewbourne College of Earth & Energy," Society of Petroleum Engineers, Drilling Systems Automation Technical Section (DSATS), 2019, 105 Pages.

American Petroleum Institute: "Gas Turbines for the Petroleum, Chemical, and Gas Industry Services," API Standard 616, Fifth

(56) References Cited

OTHER PUBLICATIONS

Edition, API Publishing Services, Washington, DC, Jan. 2011, 177 Pages.
American Petroleum Institute: "Positive Displacement Pumps-Reciprocating," API Standard 674, Third Edition, API Publishing Services, Washington, D.C, Dec. 2010, 104 Pages.
API: "2011 Publications Programs and Services," American Petroleum Institute, 2011, 260 Pages.
API: "About API," American Petroleum Institute, 8 Pages, Retrieved on [Dec. 30, 2021] Retrieved from URL: https://www.api.org/about.
"API's Global Industry Services," American Petroleum Institute, Copyright Aug. 2020, 2 Pages.
API Standard 671: "Special-Purpose Couplings for Petroleum, Chemical, and Gas Industry Services," 4th Edition, Sep. 2010, 64 Pages, (Aug. 2007).
Arop J.B., "Geomechanical Review of Hydraulic Fracturing Technology," Thesis (M. Eng) Massachusetts Institute of Technology, Department of Civil and Environmental Engineering, Cambridge, MA, Oct. 29, 2013, 291 Pages, Retrieved from URL: https://dspace.mit.edu/handle/1721.1/82176.
Atlas: "On-Site Fuel Services and Mobile Fuel Delivery," atlasoil.com, Mar. 6, 2019, 3 Pages, Retrieved from URL: https://www.atlasoil.com/nationwide-fueling/onsite-and-mobile-fueling.
Beer F.P., et al., "Mechanics of Materials," 6th Edition, McGraw Hill, 2012, 838 Pages.
Boman K., "Turbine Technology Powers Green Field Multi-Fuel Frack Pump," Rigzone, Mar. 7, 2015, 5 Pages, [Retrieved on Mar. 14, 2015] Retrieved from URL: https://web.archive.org/web/20150314203227/https://www.rigzone.com/news/oil-gas/a/124883/Turbine_Technology_Powers_Green_Field_MultiFuel_Frack_Pump.
Cabling: "Business Week: Fiber-Optic Cables Help Fracking," Cablinginstall.com, Jul. 12, 2013, 10 Pages, Retrieved from URL: https://www.cablinginstall.com/cable/article/16474208/businessweek-fiberoptic-cables-help-fracking.
Cameron Schlumberger Company: "Frac Manifold Systems," 2016, 16 Pages.
Candyne Pump Services Inc: "Q700 Pump," Weatherford, Calgary, Alberta, Canada, Aug. 15, 2015, 2 Pages, Retrieved from URL: http://candyne.com/wp-content/uploads/2014/10/181905-94921.q700-quintuplex-pump.pdf.
Capstone Turbine Corporation: "Capstone Receives Three Megawatt Order from Large Independent Oil & Gas Company in Eagle Ford Shale Play," Dec. 7, 2010, 2 Pages.
Chaichan M.T., "The Impact of Equivalence Ratio on Performance and Emissions of a Hydrogen-diesel Dual Fuel Engine With Cooled Exhaust Gas Recirculation," International Journal of Scientific & Engineering Research, Jun. 2015, vol. 6, No. 6, pp. 938-941, 9 Pages.
CNG Delivery: "Fracturing With Natural Gas, Dual-Fuel Drilling With CNG," Aug. 22, 2019, 7 Pages.
Cooper B., et al., "Jet Frac Porta-Skid—A New Concept in Oil Field Service Pump Equipment," Society of Petroleum Engineers of AIME, SPE-2706, Sep. 28-Oct. 1, 1969, 10 Pages.
De Gevigney J.D., et al., "Analysis of No-Load Dependent Power Losses in a Planetary Gear Train by Using Thermal Network Method," International Gear Conference 2014, Lyon, Aug. 26-28, 2014, pp. 615-624.
Dowell: "B908 Turbine Pumper," Operator's Manual, 9 Pages.
Dziubak T., "Experimental Studies of Dust Suction Irregularity from Multi-Cyclone Dust Collector of Two-Stage Air Filter," Energies, Jun. 16, 2021, vol. 14, No. 3577, 28 Pages.
Eberhard M., "Fracture Design and Stimulation: Monitoring Well Construction & Operations technical workshop in support of the EPA Hydraulic Fracturing Study," Halliburton, Mar. 10-11, 2011, 24 Pages.
Ecob D.J., et al., "Design and Development of a Landfill Gas Combustion System for the Typhoon Gas Turbine," ASME 1996 International Gas Turbine and Aeroengine Congress and Exhibition, American Society of Mechanical Engineers Digital Collection, Jun. 10-13, 1996, 8 Pages.
Empengineering.Com: "HEMP Resistant Electrical Generators / Hardened Structures HEMP/GMD Shielded Generators," Virginia, Nov. 3, 2012, 6 Pages.
Energy.gov: "The Water-Energy Nexus: Challenges and Opportunities," Department of Energy, United States of America, Jun. 2014, 262 Pages, purenergypolicy.org.
Europump and Hydrualic Institute: "Variable Speed Pumping: A Guide to Successful Applications," Elsevier Ltd, 2004, 186 Pages.
Eygun C., et al., "Mitigating Shale Gas Developments Carbon Footprint: Evaluating and Implementing Solutions in Argentina," URTeC: 2687987, Copyright 2017, Unconventional Resources Technology Conference held in Austin, Texas, USA, Jul. 24-26, 2017, 14 Pages.
Filipovic I., et al., "Preliminary Selection of Basic Parameters of Different Torsional Vibration Dampers Intended for use in Medium-Speed Diesel Engines," Transactions of Famena XXXVI-3, 2012, 10 Pages.
Final Written decision of PGR2021-00102, dated Feb. 6, 2023, 43 Pages.
Final written decision of PGR2021-00103, dated Feb. 6, 2023, 40 Pages.
FMC Technologies: "Operation and Maintenance Manual, L06 Through L16 Triplex Pumps," Doc No. OMM50000903 Rev: E, Aug. 27, 2009, 66 Pages.
Frac Shack: "Bi-Fuel FracFueller," Brochure, 2011, 2 Pages.
FTS International: FTS International's Dual Fuel Hydraulic Fracturing Equipment Increases Operational Efficiencies, Provides Cost Benefits, Jan. 3, 2018, 3 Pages.
Gardner Denver: "GD-3000 Well Service Pump," Gardner Denver Hydraulic Fracturing Pumps, 2 Pages, Retrieved from URL: https://www.gardnerdenver.comien-usipumpsitriplex-fracking-pump-gd-3000.
Ginter T., et al., "Uprate Options for the MS6001 Heavy Duty Gas Turbine," GE paper GER-3808C, GE Energy 12, 2006, 64 Pages.
Gladstein: "High Horsepower HHP Summit 2012," Review of HHP Summit 2012, Gladstein, Neandross & Associates, Sep. 26-28, 2012, 4 Pages, Retrieved from URL: https://www.gladstein.orgigna-conferences/high-horsepower-summit-2012/.
Green Field Energy Services: "Green Field Energy Services Deploys Third New Hydraulic Fracturing Spread," Jul. 11, 2012, 3 Pages, Retrieved from URL: https://www.prnewswire.cominews-releases/green-field-energy-services-deploys-third-new-hydraulic-facturing-spread-162113425.
Green Field Energy Services: "Green Field Energy Services Natural Gas Driven Turbine Frac Pumps," HHP Summit Presentation, Yumpu, Sep. 2012, 15 Pages, (Green Field), Retrieved from URL: https://www.yumpu.com/en/document/read/49685291/turbine-frac-pump-assembly-hhp.
Halliburton: "Vessel-Based Modular Solution," Production Enhancement, 2015, 4 Pages.
Hausfeld T., et al., "TM2500+ Power for Hydraulic Fracturing," Evolution Well Services, GE Imagination at Work, 2013, 20 Pages.
HCI Jet Frac, Screenshots from YouTube, Dec. 11, 2010. https://www.youtube.com/watch?v=6HjXkdbFaFQ.
Hhp Summit 2012: "Natural Gas for High Horsepower Applications," High Horsepower Summit Agenda, Sep. 5, 2012, 8 Pages.
Hydrocarbons Technology: "Mee Industries: Inlet Air Fogging Systems for Oil, Gas and Petrochemical Processing," Verdict Media Limited, Copyright 2020, 2 Pages.
Ibragimov E.S., "Use of Gas-Turbine Engines in Oil Field Pumping Units," Chemical and Petroleum Engineering, 1994, vol. 30, pp. 530-532, (Translated from Khimicheskaya i Neftyanoe Mashinostroenie, Nov. 1994, No. 11, pp. 24-26).
Ide N., "The Right Valve for Controlling Flow Direction? Check.," Swagelok, Oct. 27, 2016, 7 Pages.
IHS Markit Standards Store: "Positive Displacement Pumps Reciprocating," API STD 674, 3rd Edition, Dec. 2010, [Retrieved on Dec. 30, 2021] Retrieved from URL: https://global.ihs.com/doc_detail.cfm?document_name=API%20STD%20674&item_s_key=00010672#doc-detail-history-anchor and "Special Purpose Coupling

(56) References Cited

OTHER PUBLICATIONS for Petroleum, Chemical, and Gas Industry Services," Api Std 671, 4th Edition, Aug. 2007, 6 Pages, [Retrieved on Dec. 30, 2021] Retrieved from URL: https://global.ihs.com/doc_detail.cfm?&input_doc_number=671&input_doc_title=&document_name=API%20STD%20671&item_s_key=00010669&item_key_date=890331&origin=DSSC.
II-VI Marlow Blog: "Thermoelectric Technologies in Oil, Gas, and Mining Industries," II-VI Marlow Industries, Jul. 24, 2019, 7 Pages, (blog.marlow.com).
Integrated Flow: "Modular Process Skid Manufacturers," Jul. 15, 2017, 6 Pages, Retrieved from URL: https://ifsolutions.com/why-modular/.
ISM: "What is Cracking Pressure," Jun. 4, 2019, 9 Pages.
JBG Enterprises Inc: "WS-Series Blowout Prevention Safety Coupling-Quick Release Couplings," Sep. 11, 2015, 8 Pages, Retrieved from URL: http://www.jgbhose.com/products/WS-Series-Blowout-Prevention-Safety-Coupling.asp.
Jereh Group: "35% Economy Increase, Dual-fuel System Highlighting Jereh Apollo Frac Pumper," Apr. 13, 2015, 2 Pages, Retrieved from URL: https://www.jereh.com/en/news/press-release/news-detail-7345.html.
Jereh Group: "Jereh Apollo 4500 Turbine Frac Pumper Finishes Successful Field Operation in China," Feb. 13, 2015, 2 Pages, [Retrieved on Apr. 20, 2015] Retrieved from URL: https://web.archive.org/web/20150420220625/https://www.prnewswire.com/news-releases/jereh-apollo-4500-turbine-frac-pumper-finishes-successful-field-operation-in-china-300035829.html.
Jereh Group: "Jereh Apollo Turbine Fracturing Pumper Featured on China Central Television," Mar. 9, 2018, 2 Pages, Retrieved from URL: https://www.jereh.com/en/news/press-release/news-detail-7267.html.
Jereh Group: "Jereh Unveiled New Electric Fracturing Solution at OTC 2019," May 7, 2019, 3 Pages, [Retrieved on May 28, 2019] Retrieved from URL: https://web.archive.org/web/20190528183906/https://www.prnewswire.com/news-releases/jereh-unveiled-new-electric-fracturing-solution-at-otc-2019-300845028.html.
Jereh Oilfield Services Group: "Jereh Debut's Super Power Turbine Fracturing Pump, Leading the Industrial Revolution," Jereh Oilfield Services Group, Mar. 19, 2014, 3 Pages, Retrieved from URL: https://www.prnewswire.com/news-releases/jereh-debuts-super-power-turbine-fracturing-pump-leading-the-industrial-revolution-250992111.html.
Karassik I.J., et al., "Pump Handbook," 4th Edition, McGraw-Hill Education, New York, 2008, 431 Pages.
Kas'yanov A.D., et al., "Application of Gas-turbine Engines in Pumping Units Complexes of Hydraulic Fracturing of Oil and Gas Reservoirs," Exposition Oil & Gas, Oct. 24, 2012, 3 Pages, (Published in Russian).
Lekontsev Y.M., et al., "Two-Side Sealer Operation," Journal of Mining Science, 2013, vol. 49, No. 5, pp. 757-762.
Lord Sensing: "Advances in Popular Torque-Link Solution Offer OEMs Greater Benefit," Jun. 21, 2018, 1 Page.
Mahlalela B.M., et al., "Electric Power Generation Potential Based on Waste Heat and Geothermal Resources in South Africa," Proceedings 44th Workshop on Geothermal Reservoir Engineering, pangea.Stanford.edu, Feb. 11-13, 2019, 13 Pages.
Mancuso J., "General Purpose vs Special Purpose Couplings," Proceedings of the Twenty-Third TurboMachinery Symposium, 1994, 12 Pages.
Mancuso J.R et al., "The Application of Flexible Couplings for Turbomachinery," Proceedings of the Eighteenth Turbomachinery Symposium, 1989, 24 Pages.
Marine Turbine Technologies, 1 MW Power Generation Package, http://marineturbine.com/power-generation, 2017.
Marine Turbine Technologies: "Turbine Powered Frac Units," Marine Turbine, Franklin, Louisiana, 2020, 15 Pages.
Minovski B., "Coupled Simulations of Cooling and Engine Systems for Unsteady Analysis of the Benefits of Thermal Engine Encapsulation," Department of Applied Mechanics, Chalmers University of Technology, Goteborg, Sweden, 2015, 47 Pages.
Moliere M., et al., "Heavy Duty Gas Turbines in Petrochemical Plants: Samsung's Daesan Plant (Korea) Beats Fuel Flexibility Records With Over 95% Hydrogen in Process Gas," Proceedings of PowerGen Asia Conference, Singapore, Sep. 1999, 7 Pages.
Mutua D.C., et al., "Fracking Companies Switch to Electric Motors to Power Pumps," iadd-intl.org, International Association of Diecutting and Diemaking in Houston, Texas, USA, Jun. 27, 2019, 5 Pages, Retrieved from URL: https://www.iadd-intl.org/articlesffracking-companies-switch-to-electric-motors-to-power-pumps/.
Neal J.C., (Gulf Oil Corp Odessa Texas)., "Gas Turbine Driven Centrifugal Pumps for High Pressure Water Injection," American Institute of Mining, Metallurgical and Petroleum Engineers, Inc, SPE-1888-MS, 1967, 2 Pages.
Nooutage.com LLC: "PowerShelter Kit II," Sep. 6, 2019, 4 Pages.
"Overview of Industry Guidance/Best Practices on Hydraulic Fracturing (HF)," American Petroleum Institute, 2012, 3 Pages.
PBNG: "Natural Gas Fuel for Drilling and Hydraulic Fracturing," Diesel Displacement / Dual Fuel & Bi-Fuel, May 2014, 8 Pages.
Pettigrew D., et al., "High Pressure Multi-Stage Centrifugal Pump for 10,000 psi Frac Pump-HPHPS FRAC Pump," Society of Petroleum Engineers, SPE 166191, Copyright 2013, SPE Annual Technical Conference and Exhibition held in New Orleans, Louisiana, USA, Sep. 30-Oct. 2, 2013, 8 Pages.
Porteiro J., et al., "Feasibility of a New Domestic CHP Trigeneration With Heat Pump: II. Availability Analysis," Design and Development, Applied Thermal Engineering, 2004, vol. 24, pp. 1421-1429.
Porter J.A., (Solar Division International Harvester Co.)., "Modern Industrial Gas Turbines for the Oil Field," American Petroleum Institute, Drilling and Production Practice, Solar Division International Harvester Co, API-67-243, Jan. 1, 1967, 2 Pages.
"Procedures for Standards Development," American Petroleum Institute, Third Edition, May 2006, 24 Pages, (Sep. 2006).
Researchgate: "Answer by Byron Woolridge," AES Deepwater Inc, Jan. 1, 2013, 1 Page, Retrieved from URL: https://www.researchgate.net/post/How_can_we_improve_the_efficiency_ofthe_gas_turbine_cycles.
Rigmaster Machinery Ltd: "Model: 2000 RMP-6-PLEX," Brochure, 5 Pages, Retrieved from URL: https://www.rigmastermachinery.com/_files/ugd/431e62_eaecd77c9fe54af8b13d08396072da67.pdf.
Rotating Right: "Quintuplex Power Pump Model Q700," Weatherford International Ltd, Edmonton, Alberta, Canada, 2021, 2 Pages, Retrieved from URL: https://www.rotatingrightcom/pdf/weatherford/RR%2026-Weatherford%20Model%20Q700.
Scott K., "Honghua Developing New-Generation Shale-Drilling Rig, Plans Testing of Frac Pump," Drilling Contractor, May 23, 2013, 4 Pages, Retrieved from URL: https://www.drillingcontractor.org/honghua-developing-new-generation-shale-drilling-rig-plans-testing-of-frac-pump-23278.
Seybold E., et al., "Evolution of Dual Fuel Pressure Pumping for Fracturing: Methods, Economics, Field Trial Results and Improvements in Availability of Fuel," Society of Petroleum Engineers, SPE 166443, Copyright 2013, SPE Annual Technical Conference and Exhibition held in New Orleans, Louisiana, USA, Sep. 30-Oct. 2, 2013, 18 Pages.
Shandong Saigao Group Corporation: "Q400 (5W115) Quintuplex Plunger Pump," Jinan City, Shandong Province, China, Saigao, Oct. 20, 2014, 11 Pages, Retrieved from URL: https://www.saigaogroup.com/product/q400-5w115-quintuplex-plunger-pump.html.
Sun Coast Resources: "The Leader in Frac Fueling," Fueling Services, Jun. 29, 2015, 4 Pages, Retrieved from URL: https://web.archive.org/web/20150629220609/https://www.suncoastresources.comioilfield/fueling-services/.
Technology.org: "Check Valves: How Do they Work and What are the Main Types?," Dec. 6, 2018, 10 Pages.
The Wayback Machine: "About API," WaybackMachine Capture, Captured Apr. 22, 2011, 2 Pages, Retrieved from URL: https://web.archive.org/web/20110422104346// http://api.org/aboutapi/.
The Wayback Machine: "Publications," American Petroleum Institute, WaybackMachine Capture, Captured Apr. 27, 2011, 2 Pages,

(56) References Cited

OTHER PUBLICATIONS

Retrieved from URL: https://web.archive.org/web/20110427043936 http://www.api.org:80/Publications/.
The Wayback Machine: "Standards," American Petroleum Institute, WaybackMachine Capture, 2 Pages, Captured Feb. 7, 2011, Retrieved from URL: https://web.archive.org/web/20110207195046/ http://wwww.api.org/Standards/ and Captured Feb. 4, 2011, Retrieved from URL: https://web.archive.org/web/20110204112554/ http://global.ihs.com/?RID=API1.
The Weir Group Inc: "Weir SPM Pump Product Catalog," S.P.M. Flow Control Inc, Fort Worth, Texas, Oct. 30, 2017, 40 Pages, Retrieved from URL: https://manage.global.weiriassets/files/product%20brochures/SPM_2P140706_Pump_Product_ Catalogue_View.pdf.
Tiwari A., "Design of a Cooling System for a Hydraulic Fracturing Equipment," The Pennsylvania State University, The Graduate School, College of Engineering, Aug. 2015, 96 Pages.
Tory K., "Pump Control With Variable Frequency Drives," Pumps & Systems: Advances in Motors and Drives, Reprint from Jun. 2008, 4 Pages.
Turk L., "Green Field Asset Sale Called 'Largest Disposition Industry Has Seen'," The INDsider Media, Mar. 19, 2014, 3 Pages, Retrieved from URL: http://theind.com/article-16497-green-field-asset-sale-called-%E2%80%98largest-disposition-industry-has-seen%60.html.
Vericor: "Hydraulic Fracturing: Gas Turbine Proves Successful in Shale Gasfield Operations," 2017, 2 Pages, (Vericor Case Study), Retrieved from URL: https://www.vericor.com/wp-content/uploads/2020/02/7.-Fracing-4500hp-Pump-China-En.pdf.
Waizel B., "Oil, Gas Industry Discovers Innovative Solutions to Environmental Concerns," Hart Energy, Health, Safety & Environment, Dec. 10, 2018, 11 Pages.
Wallace E.M., et al., "Associated Shale Gas: From Flares to Rig Power," Society of Petroleum Engineers, SPE-173491-MS, Copyright 2015, Spe E&P Health, Safety, Security and Environmental Conference-Americas held in Denver, Colorado, USA, Mar. 16-18, 2015, 13 Pages.
Wang G., et al., "Dynamic Behavior of Reciprocating Plunger Pump Discharge Valve Based on Fluid Structure Interaction and Experimental Analysis," PLOS One, Oct. 21, 2015, vol. 10, No. 10, 20 Pages.
Wayback Machine: "Api Member Companies," American Petroleum Institute, WaybackMachine Capture, 23 Pages, [Retrieved on Jan. 4, 2021] Retrieved from URL: https://web.archive.org/web/20130424080625/ http://api.org/globalitems/globalheaderpages/membership/api-member-companies.
Weir Group: "Weir Oil & Gas Introduces Industry's First Continuous Duty 5000-Horsepower Pump," Jul. 25, 2019, 5 Pages, Retrieved from URL: https://www.global.weir/newsroom/news-articles/weir-oil-and-gas-introduces-industrys-first-continuous-duty-5000-horsepower-pump/.
Weir: "SPM QEM 5000 E-Frac Pump," Specification Sheet, Weir Group, Weir 5000, 2019, 2 Pages.
Weir SPM: "Weir SPM General Catalog: Well Service Pumps, Flow Control Products, Manifold Trailers, Safety Products, Post Sale Services," Weir Oil & Gas, Fort Worth, Texas, May 28, 2016, 40 Pages, Retrieved from URL: https://www.pumpfundamentals.com/pumpdatabase2/weir-spm-general.pdf.
Wikipedia: "Union Pacific GTELs," 1950, 7 Pages, Retrieved from URL: https://en.wikipedia.org/wiki/Union_Pacific_GTELs.
Wikipedia: "Westinghouse Combustion Turbine Systems Division," 1960, 33 Pages, Retrieved from URL: https://en.wikipedia.org/wiki/Westinghouse_Combustion_Turbine_Systems_Division.
Williams C.W (Gulf Oil Corp. Odessa Texas)., "The Use of Gas-Turbine Engines in an Automated High-Pressure Water-Injection Station," American Petroleum Institute, Drilling and Production Practice, API-63-144, Jan. 1, 1963, 2 Pages.
WMD Squared: "Turbine Frac Units," 2012, 4 Pages, Retrieved from URL: https://wmdsquared.com/work/gfes-turbine-frac-units/.
Wolf J.J., et al., "Safety Aspects and Environmental Considerations for a 10 MW Cogeneration Heavy Duty Gas Turbine Burning Coke Oven Gas with 60% Hydrogen Content," ASME 1992 International Gas Turbine and Aeroengine Congress and Exposition, American Society of Mechanical Engineers Digital Collection, Jun. 1-4, 1992, 8 Pages.
Worldcat: "WorldCat Library Collections Database Records for API Standard 671 and API Standard 674," 3 Pages, [Retrieved on Dec. 30, 2021] Retrieved from URL: https://www.worldcat.org/title/positive-displacement-pumps-reciprocating/ocic/858692269&referer=brief_results [Retrieved on Dec. 22, 2021] Retrieved from URL: https://www.worldcat.org/title/special-purpose-couplings-for-petroleum-chemical-and-gas-industry-services/ocic/871254217&referer=brief_results.
Yadav J.P., et al., "Power Enhancement of Gas Turbine Plant by Intake Air Fog Cooling," ResearchGate, Jun. 2015, vol. 3, No. 1, 15 Pages.
Youtube: "Jereh Fracturing Equipment," Jereh Group, Jun. 8, 2015, 1 Page, Retrieved from URL: https://www.youtube.com/watch?v=m0vMiq84P4Q.
Youtube: "Jereh Fracturing Equipment," Transcript of Jereh Group, Jun. 8, 2015, 1 Page, Retrieved from URL: https://www.youtube.com/watch?v=m0vMiq84P4Q.
Youtube: "Jereh Fracturing Unit, Fracturing Spread," Jereh Group, Mar. 30, 2015, 1 Page, Retrieved from URL: https://www.youtube.com/watch?v=PIkDbU5dE00.
Youtube: "Jereh Fracturing Unit, Fracturing Spread," Transcript of Jereh Group, Mar. 30, 2015, 3 Pages.
Zsi-Foster: "Energy | Solar | Fracking | Oil and Gas," Aug. 2020, 2 Pages, Retrieved from URL: https://www.zsi-foster.com/energy-solar-fracking-oil-and-gas.html.

STAGE PROFILES FOR OPERATIONS OF HYDRAULIC SYSTEMS AND ASSOCIATED METHODS

PRIORITY CLAIM

This is a continuation of U.S. Non-Provisional application Ser. No. 18/072,478, filed Nov. 30, 2022, titled "STAGE PROFILES FOR OPERATIONS OF HYDRAULIC SYSTEMS AND ASSOCIATED METHODS," which is a continuation of U.S. Non-Provisional application Ser. No. 17/555,919, filed Dec. 20, 2021, titled "STAGE PROFILES FOR OPERATIONS OF HYDRAULIC SYSTEMS AND ASSOCIATED METHODS" now U.S. Pat. No. 11,598,188 issued Mar. 7, 2023 which is a continuation of U.S. Non-Provisional application Ser. No. 17/500,217, filed Oct. 13, 2021, titled "STAGE PROFILES FOR OPERATIONS OF HYDRAULIC SYSTEMS AND ASSOCIATED METHODS," now U.S. Pat. No. 11,236,598, issued Feb. 1, 2022, which is continuation of U.S. Non-Provisional application Ser. No. 17/308,330, filed May 5, 2021, titled "STAGE PROFILES FOR OPERATIONS OF HYDRAULIC SYSTEMS AND ASSOCIATED METHODS," now U.S. Pat. No. 11,208,879, issued Dec. 28, 2021, which is continuation of U.S. Non-Provisional application Ser. No. 17/182,489, filed Feb. 23, 2021, titled "STAGE PROFILES FOR OPERATIONS OF HYDRAULIC SYSTEMS AND ASSOCIATED METHODS," now U.S. Pat. No. 11,028,677, issued Jun. 8, 2021, which claims priority to and the benefit of U.S. Provisional Application No. 62/705,332, filed Jun. 22, 2020, titled "METHODS AND SYSTEMS TO ENHANCE OPERATION OF HYDRAULIC FRACTURING EQUIPMENT AT A HYDRAULIC FRACTURING WELLSITE BY HYDRAULIC FRACTURING STAGE PROFILES," and U.S. Provisional Application No. 62/705,356, filed Jun. 23, 2020, titled "STAGE PROFILES FOR OPERATIONS OF HYDRAULIC SYSTEMS AND ASSOCIATED METHODS," the disclosures of all of which are incorporated herein by reference in their entirety.

TECHNICAL FIELD

The present disclosure relates to methods and systems for enhancing operation of hydraulic fracturing equipment at a hydraulic fracturing wellsite.

BACKGROUND

Hydrocarbon exploration and energy industries employ various systems and operations to accomplish activities including drilling, formation evaluation, stimulation and production. Hydraulic fracturing may be utilized to produce oil and gas economically from low permeability reservoir rocks or other formations, for example, shale, at a wellsite. During a hydraulic fracturing stage, slurry may be pumped, via hydraulic fracturing pumps, under high pressure to perforations, fractures, pores, faults, or other spaces in the reservoir rocks or formations. The slurry may be pumped at a rate faster than the reservoir rocks or formation may accept. As the pressure of the slurry builds, the reservoir rocks or formation may fail and begin to fracture further. As the pumping of the slurry continues, the fractures may expand and extend in different directions away from a well bore. Once the reservoir rocks or formations are fractured, the hydraulic fracturing pumps may remove the slurry. As the slurry is removed, proppants in the slurry may be left behind and may prop or keep open the newly formed fractures, thus preventing the newly formed fractures from closing or, at least, reducing contracture of the newly formed fractures. Further, after the slurry is removed and the proppants are left behind, production streams of hydrocarbons may be obtained from the reservoir rocks or formation.

For a wellsite, a plurality of hydraulic fracturing stages may be performed. Further, each hydraulic fracturing stage may require configuration of many and various hydraulic fracturing equipment. For example, prior to a next hydraulic fracturing stage, an operator or user may enter multiple data points for that next hydraulic fracturing stage for each piece of equipment, such as, for hydraulic fracturing pumps, a blender, a chemical additive unit, a hydration unit, a conveyor, and/or other hydraulic fracturing equipment located at the wellsite. As each hydraulic fracturing stage arises, data entry or other inputs at each piece of hydraulic fracturing equipment may not be performed efficiently and effectively; thus, such tasks may be considered time consuming and may result in user error.

Accordingly, Applicant has recognized a need for methods and system to enhance operation of hydraulic fracturing equipment at a hydraulic fracturing wellsite. The present disclosure may address one or more of the above-reference drawbacks, as well as other potential drawbacks.

SUMMARY

Accordingly, Applicant has recognized a need for methods and system to enhance operation of hydraulic fracturing equipment at a hydraulic fracturing wellsite. The present disclosure may address one or more of the above-reference drawbacks, as well as other potential drawbacks.

As referenced above, due to a large number of hydraulic fracturing stages and the large number of hydraulic fracturing equipment associated with the hydraulic fracturing stages, setting hydraulic fracturing stage parameters may be difficult, complex, and time-consuming and may introduce error into the process. Further, the manual input of each data point for the hydraulic fracturing stages at each piece of the hydraulic fracturing equipment may result in longer periods of time between hydraulic fracturing stages, thus resulting in a longer overall period of time for entire hydraulic fracturing operations.

The present disclosure generally is directed to methods and systems for operating hydraulic fracturing equipment at a hydraulic fracturing wellsite. In some embodiments, the methods and systems may provide for efficient and enhanced operation of the hydraulic fracturing equipment, for example, during setup or as hydraulic fracturing equipment stages through various operations.

An embodiment of the disclosure provides a method of enhancing operation of hydraulic fracturing equipment at a hydraulic fracturing wellsite. The method may include determining if a previous hydraulic fracturing stage profile or one or more hydraulic fracturing stage profiles may be available for use in association with a controller for hydraulic fracturing equipment at a hydraulic fracturing wellsite. The one or more profiles may include hydraulic fracturing pumping stage parameters for a hydraulic fracturing fleet and a plurality of hydraulic fracturing pumping stages at a fracturing wellsite during hydrocarbon production. The method may include, in response to a determination that the previous hydraulic fracturing stage profile is available for use by the controller, prompting, at a display, a user to accept or amend the previous hydraulic fracturing stage profile as a current hydraulic fracturing stage profile for a hydraulic fracturing pumping stage. The method may further include, in response to a reception of an amendment of the previous hydraulic fracturing stage profile, prompting, at the display, the user to accept the amended previous hydraulic fracturing stage profile as the current hydraulic fracturing stage profile, and storing the current hydraulic fracturing stage profile in memory as another previous hydraulic fracturing stage profile for use in association with the controller. The method may further include, in response to a determination that the previous hydraulic fracturing stage profile is not available for use in association with the controller, prompting, at the display, a user to configure hydraulic fracturing pumping stage parameters for the current hydraulic fracturing stage profile, storing the current hydraulic fracturing stage profile in memory as the previous hydraulic fracturing stage profile for use in association with the controller, and verifying that the hydraulic fracturing pumping stage parameters in the current hydraulic fracturing stage profile are correct.

Another embodiment of the disclosure provides a method of enhancing operation of hydraulic fracturing equipment at a hydraulic fracturing wellsite. The method may include building a new or a first hydraulic fracturing stage profile for a new hydraulic fracturing stage at the hydraulic fracturing wellsite, based, at least, in part on one or more hydraulic fracturing stage profiles, data from a hydraulic fracturing fleet, and hydraulic fracturing fleet alarm history. The one or more hydraulic fracturing stage profiles may include hydraulic fracturing pumping stage parameters for the hydraulic fracturing fleet and a plurality of hydraulic fracturing pumping stages at the hydraulic fracturing wellsite during hydrocarbon production. The method may include, in response to completion of the new hydraulic fracturing stage profile, prompting, at a display, a user to accept or amend the new hydraulic fracturing stage profile as a current hydraulic fracturing stage profile for the new hydraulic fracturing pumping stage. The method may further include, in response to a reception of an amendment of the new hydraulic fracturing stage profile, prompting, at the display, the user to accept the amended new hydraulic fracturing stage profile as the current hydraulic fracturing stage profile, and storing the current hydraulic fracturing stage profile in memory as another previous hydraulic fracturing stage profile for use in association with the controller. The method may further include verifying that the hydraulic fracturing pumping stage parameters in the current hydraulic fracturing stage profile are correct.

According to another embodiment of the disclosure, a wellsite hydraulic fracturing system may include a plurality of hydraulic fracturing pumps. The plurality of hydraulic fracturing pumps, when positioned at a hydraulic fracturing wellsite, may be configured to provide a slurry to a wellhead in hydraulic fracturing pumping stages. The wellsite hydraulic fracturing system also may include a blender configured to provide a slurry to the plurality of hydraulic fracturing pumps. The slurry may include fluid, chemicals, and proppant. The wellsite hydraulic fracturing system also may include a hydration unit to provide fluid to the blender. The wellsite hydraulic fracturing system further may include a chemical additive unit to provide chemicals to the blender. The wellsite hydraulic fracturing system also may include a conveyor or auger, for example, to provide proppant to the blender. The wellsite hydraulic fracturing system further may include one or more controllers to control the hydraulic fracturing pumps, blender, hydration unit, chemical additive unit, and conveyor or auger. The one or more controllers may be positioned in signal communication with a terminal, a computing device, and sensors included on the plurality of hydraulic fracturing pumps, the blender, the hydration unit, the chemical additive unit, and the conveyor or auger. The one or more controllers may include a processor and a memory. The memory may store instructions or computer programs, as will be understood by those skilled in the art. The instructions or computer programs may be executed by the processor. The instructions, when executed, may determine if hydraulic fracturing stage profiles are available for use in the hydraulic fracturing pumping stages, and may, in response to a determination that the hydraulic fracturing stage profiles are not available for use, communicate a prompt at the terminal to enter hydraulic fracturing stage parameters for a current hydraulic fracturing stage profile and for a new or current hydraulic fracturing stage. The instructions, when executed, also may, in response to a determination that the hydraulic fracturing stage profiles are available for use, communicate a prompt at the terminal to utilize one of the hydraulic fracturing stage profiles or to amend one of the hydraulic fracturing stage profiles for the current hydraulic fracturing stage profile and may, in response to an entry or amendment of the hydraulic fracturing stage parameters for the current hydraulic fracturing stage profile at the terminal, store the current hydraulic fracturing stage profile to the computing device with an indicator. The indicator, for example, may indicate that the current hydraulic fracturing stage profile is associated with the current hydraulic fracturing pumping stage. Further, the instructions, when executed, may communicate a prompt to the terminal requesting acceptance of the use of the current hydraulic fracturing stage profile for the current hydraulic fracturing stage.

According to another embodiment of the disclosure, a controller for a hydraulic fracturing system may include a terminal input/output in signal communication with a terminal. The controller may be configured to, in relation to the terminal and in response to a determination that no hydraulic fracturing stage profiles are available for use, provide a prompt to the terminal to enter data for a hydraulic fracturing stage of a plurality of hydraulic fracturing stages into a first hydraulic fracturing stage profile. The controller, in relation to the terminal, also may be configured to receive the first hydraulic fracturing stage profile from the terminal. The controller, in relation to the terminal and in response to a determination that one or more hydraulic fracturing stage profiles are available, also may be configured to provide a prompt to the terminal requesting utilization or amendment of one of the hydraulic fracturing stage profiles for another hydraulic fracturing stage of the plurality of hydraulic fracturing stages. The controller may be configured to receive acceptance of the use of one of the hydraulic fracturing stage profiles for the another hydraulic fracturing stage. Further, the controller may be configured to receive an amended hydraulic fracturing stage profile of the hydraulic fracturing stage profiles for the another hydraulic fracturing stage. The controller may include a server input/output in signal communication with a server such that each hydraulic fracturing stage profile, including indicators of associated hydraulic fracturing stages, are communicated between the controller and the server. The controller may also include a first control output in signal communication with the plurality of hydraulic fracturing pumps such that the controller provides pump control signals based on a stage of the plurality of hydraulic fracturing stages and an associated hydraulic fracturing stage profile. The controller, for example, may be a supervisory controller, and each of the plurality of hydraulic fracturing pumps also may include a controller in signal communication with the supervisory controller as will be understood by those skilled in the art.

Still other aspects and advantages of these embodiments and other embodiments, are discussed in detail herein. Moreover, it is to be understood that both the foregoing information and the following detailed description provide merely illustrative examples of various aspects and embodiments, and are intended to provide an overview or framework for understanding the nature and character of the claimed aspects and embodiments. Accordingly, these and other objects, along with advantages and features of the present disclosure, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain principles of the embodiments discussed herein. No attempt is made to show structural details of this disclosure in more detail than may be necessary for a fundamental understanding of the embodiments discussed herein and the various ways in which they may be practiced. According to common practice, the various features of the drawings discussed below are not necessarily drawn to scale. Dimensions of various features and elements in the drawings may be expanded or reduced to more clearly illustrate embodiments of the disclosure.

DETAILED DESCRIPTION

Figure 1:
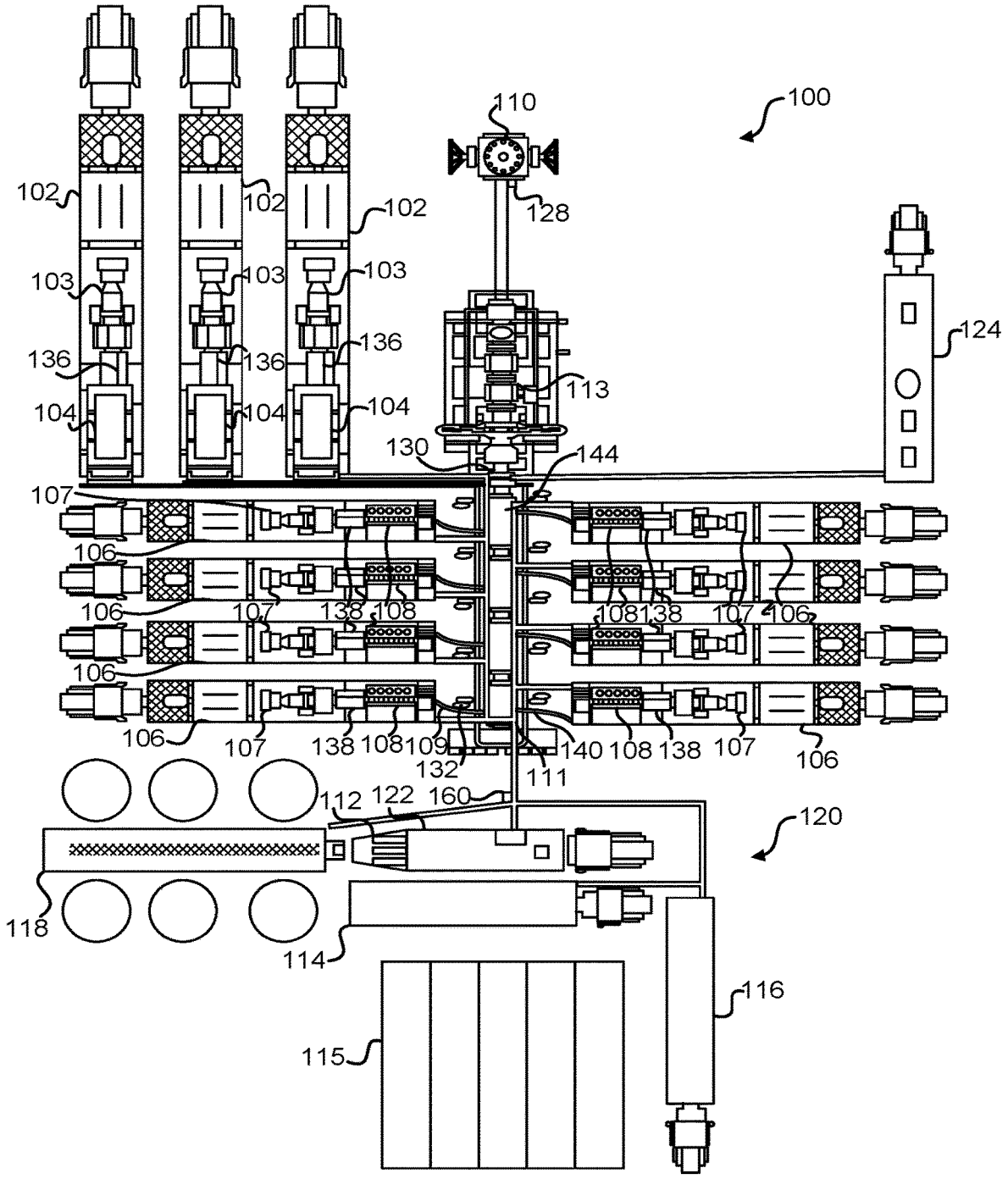
FIG. 1 is a top plan schematic view of a wellsite hydraulic fracturing pumper system, according to an embodiment of the disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect may be combined with features from any other embodiment or aspect in any appropriate combination. For example, any individual or collective features of method aspects or embodiments may be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to," unless otherwise stated. Thus, the use of such terms is meant to encompass the items listed thereafter, and equivalents thereof, as well as additional items. The transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Embodiments of the present disclosure are directed to methods and systems for enhancing operation of hydraulic fracturing equipment at a hydraulic fracturing wellsite. The methods and systems detailed herein may be executed on a controller which controls all equipment at the hydraulic fracturing wellsite and may provide prompts and requests to an operator in relation to utilizing and amending hydraulic fracturing stage profiles for hydraulic fracturing stages.

FIG. 1 is a top-down schematic view of a wellsite hydraulic fracturing system 100, according to an embodiment. The wellsite hydraulic fracturing system 100 may include a plurality of mobile power units 102 to drive electrical generators 104. The electrical generators 104 may provide electrical power to the wellsite hydraulic fracturing system 100 (in other words, to hydraulic fracturing equipment at the wellsite hydraulic fracturing system 100). In such examples, the mobile power units 102 may include an internal combustion engine 103. The internal combustion engine 103 may connect to a source of fuel. The internal combustion engine 103 may be a gas turbine engine (GTE) or a reciprocating-piston engine. In another embodiment, the electrical generators 104 may power the backside equipment 120.

In another embodiment, the GTEs may be dual-fuel or bi-fuel. In other words, the GTE may be operable using two or more different types of fuel, such as natural gas and diesel fuel, or other types of fuel. A dual-fuel or bi-fuel GTE may be operable using a first type of fuel, a second type of fuel, and/or a combination of the first type of fuel and the second type of fuel. For example, the fuel may include gaseous fuels, such as, compressed natural gas (CNG), natural gas, field gas, pipeline gas, methane, propane, butane, and/or liquid fuels, such as, diesel fuel (e.g., #2 diesel), bio-diesel fuel, bio-fuel, alcohol, gasoline, gasohol, aviation fuel, and other fuels. The gaseous fuels may be supplied by CNG bulk vessels, a gas compressor, a liquid natural gas vaporizer, line gas, and/or well-gas produced natural gas. Other types and associated fuel supply sources are contemplated. The one or more internal combustion engines 103 may be operated to provide horsepower to drive the transmission 136 connected to the electrical generators to provide electrical power to the hydraulic fracturing equipment at the wellsite hydraulic fracturing system 100.

The wellsite hydraulic fracturing system 100 may also include a plurality of mobile power units 106 to drive hydraulic fracturing pumps 108. In an embodiment, the mobile power unit 106 may be an internal combustion engine 107 (e.g., a GTE or reciprocating-piston engine). In another embodiment, the hydraulic fracturing pumps 108 may be a directly-driven turbine (DDT) hydraulic fracturing pumps. In such examples, the internal combustion engine 107 may connect to the DDT hydraulic fracturing pump via a transmission 138 connected to a drive shaft, the drive shaft connected to an input flange of the DDT hydraulic fracturing pump. Other engine-to-pump connections may be utilized. In another embodiment, the mobile power units 106 may include auxiliary internal combustion engines, auxiliary electric generators, backup power sources, and/or some combination thereof.

In another embodiment, the hydraulic fracturing pumps 108 may be positioned around a wellhead 110 and may discharge, at a high pressure, slurry to a manifold 144 such that the high pressure slurry may be provided to the wellhead 110 for a hydraulic fracturing stage, as will be understood by those skilled in the art. In such examples, each of the hydraulic fracturing pumps 108 may discharge the slurry through high-pressure discharge lines 109 to flow lines 111 on manifold 144. The flow lines 111 may connect to or combine at the manifold 144. The manifold 144 may provide the slurry or combined slurry to a manifold assembly 113. The manifold assembly 113 may provide the slurry to the wellhead 110 or one or more wellheads. After a hydraulic fracturing stage is complete, some portion of the slurry may return to a flowback manifold (not shown). From the flowback manifold, the slurry may flow to a flowback tank (not shown).

In an embodiment, the slurry may refer to a mixture of fluid (such as water), proppants, and chemical additives. The proppants may be small granules, for example, sand, ceramics, gravel, other particulates, and/or some combination thereof. Further, the granules may be coated in resin. As noted above, once fractures are introduced in reservoir rocks or formations and the slurry is drained or pumped back, the proppants may remain and prop or keep open the newly formed fractures, thus preventing the newly formed fractures from closing or, at least, reducing contracture of the newly formed fractures. Further, chemicals may be added to the slurry. For example, the chemicals may be thickening agents, gels, dilute acids, biocides, breakers, corrosion inhibitors, friction reducers, potassium chloride, oxygen scavengers, pH adjusting agents, scale inhibitors, and/or surfactants. Other chemical additives may be utilized.

The wellsite hydraulic fracturing system 100 may also include a blender unit 112, a hydration unit 114, a chemical additive unit 116, and a conveyor 118 (one or more of which may be referred to as backside equipment 120). In an embodiment, for a hydraulic fracturing stage, the blender unit 112 may provide an amount of slurry at a specified flow rate to the hydraulic fracturing pumps 108, the slurry to be discharged by the hydraulic fracturing pumps 108 to the wellhead 110 (as described above). The flow rate for slurry from the blender unit 112 may be determined by a sensor such as a flow meter (e.g., blender flow rate meter 160). Further, the conveyor 118 may provide proppant to a mixer 122 of the blender unit 112. The conveyor 118 may include a conveyor belt, an auger, a chute (including a mechanism to allow passage of a specified amount of proppant), and/or other equipment to move or transfer proppant to the blender unit 112, as will be understood by those skilled in the art. Further still, the hydration unit 114 may provide a specified amount of fluid, from water tanks 115, and chemicals, from the chemical additive unit 116, to the mixer 122 of the blender unit 112. The chemical additive unit 116 may provide a specified amount and type of chemicals to hydration unit 114. The mixer 122 of the blender unit 112 may mix the fluid, proppant, and chemicals to create the slurry to be utilized by the hydraulic fracturing pumps 108. As noted above, the blender unit 112 may then pressurize and discharge the slurry from hose 142 to flow line 140 to the hydraulic fracturing pumps 108.

In another embodiment, the wellsite hydraulic fracturing system 100, or a portion of the wellsite hydraulic fracturing system 100, may be mobile or portable. Such mobility may allow for the wellsite hydraulic fracturing system 100 to be assembled or disassembled quickly. For example, a majority of the hydraulic fracturing equipment may be included on trailers attached to vehicles or on the vehicles. When a wellsite starts hydraulic fracturing stages, the hydraulic fracturing equipment may be brought to the wellsite, assembled, and utilized and when the hydraulic fracturing stages are completed, the hydraulic fracturing equipment may be disassembled and transported to another wellsite. In such examples, data or hydraulic fracturing stage parameters may be retained by a supervisory controller 124 or another computing device for later use.

The wellsite hydraulic fracturing system 100 may also include a control unit, control center, data van, data center, controller, or supervisory controller 124 to monitor and control operations hydraulic fracturing equipment at the wellsite. In other words, the supervisory controller 124 may be in signal communication with the hydraulic fracturing equipment. The supervisory controller 124 may be in signal communication (to transmit and/or receive signals) with components, other controllers, and/or sensors included on or with the mobile power units 102 driving the electrical generators 104, the internal combustion engines 103, the mobile power units 106 driving the hydraulic fracturing pumps 108, the hydraulic fracturing pumps 108, the internal combustion engines 107, the manifold 144, the wellhead 110, the flow line 111, the hose 142, the backside equipment 120, other equipment at the wellsite, and/or some combination thereof. Further, other equipment may be included in the same location as the supervisory controller 124, such as a display or terminal, an input device, other computing devices, and/or other electronic devices.

As used herein, "signal communication" refers to electric communication such as hard wiring two components together or wireless communication, as will be understood by those skilled in the art. Wireless communication may be Wi-Fi®, Bluetooth®, ZigBee®, or forms of near field communications. In addition, signal communication may include one or more intermediate controllers or relays disposed between elements that are in signal communication with one another.

In another embodiment, the supervisory controller 124 may be in signal communication with a display, a terminal, and/or a computing device, as well as associated input devices. Further, the display may be included with a computing device. The computing device may include a user interface (the user interface to be displayed on the display). The user interface may be a graphical user interface (GUI). In another embodiment, the user interface may be an operating system. In such examples, the operating system may include various firmware, software, and/or drivers that allow a user to communicate or interface with, via input devices, the hardware of the computing device and, thus, with the supervisory controller 124. The computing device may include other peripherals or input devices, e.g., a mouse, a pointer device, a keyboard, and/or a touchscreen. The supervisory controller 124 may communicate, send or transmit prompts, requests, or notifications to the display through the computing device to the display. As used herein, "user" may refer an operator, a single operator, a person, or any personnel at, or remote from, the wellsite hydraulic fracturing system 100. In another embodiment, a user may send data, e.g., through data entry, via an input device, into a computing device associated with the display for a hydraulic fracturing stage profile, from the display to the supervisory controller 124. The user may send responses, e.g., through user selection of a prompt, via the input device, on the display, from the display to the supervisory controller 124.

In an embodiment, the supervisory controller 124 may be in signal communication with the backside equipment 120 to control the hydraulic fracturing stage parameters for a hydraulic fracturing stage. In other words, the supervisory controller 124 may communicate the hydraulic fracturing stage parameters to and control the backside equipment 120 for a current hydraulic fracturing stage. Further, the supervisory controller 124 may communicate with controllers of the backside equipment 120. For example, the supervisory controller 124 may transmit, to controller 150 of the chemical additive unit 116, the amount and type of chemicals to be sent to the hydration unit 114 for the current hydraulic fracturing stage. The supervisory controller 124 may also transmit, through the signal communication, the amount of fluid, to the controller 148 of the hydration unit 114, to provide to the mixer 122 of the blender unit 112 for the current hydraulic fracturing stage. Further, the supervisory controller 124 may also transmit, through the signal communication, the amount and type of proppant, to controller 152 of the conveyor 118, to provide to the mixer 122 of the blender unit 112 for the current hydraulic fracturing stage. Further still, the supervisory controller 124 may transmit, through the signal communication, to a controller 154 of the blender unit 112 the flow rate of the slurry from the blender unit 112 to a set of the hydraulic fracturing pumps 108 for the current hydraulic fracturing stage. The supervisory controller 124 may also be in signal communication with the hydraulic fracturing pumps 108 and/or a controller 146 of the hydraulic fracturing pumps 108 to control or transmit the flow rate (minimum and/or maximum flow rate) of the discharge of the slurry from the set of the hydraulic fracturing pumps 108, the maximum pressure of the slurry, and/or the pressure rating (minimum and/or maximum pressure rate) of the slurry for the current hydraulic fracturing stage.

The supervisory controller 124 may also be in signal communication with various sensors, equipment, controllers and/or other components disposed around and on the hydraulic fracturing equipment at the wellsite hydraulic fracturing system 100. For example, the supervisory controller 124 may receive a measurement of pressure and flow rate of the slurry being delivered to the wellhead 110 from a wellhead pressure transducer 128, the pressure and flow rate of the slurry at a manifold pressure transducer 130, the pressure of the slurry at a hydraulic fracturing pump output pressure transducer 132, and/or data related to each of the hydraulic fracturing pumps 108 from a hydraulic fracturing pump profiler. The wellhead pressure transducer 128 may be disposed at the wellhead 110 to measure a pressure of the fluid at the wellhead 110. While the manifold pressure transducer 130 may be disposed at the end of the manifold 144 (as shown in FIG. 1), it will be understood by those skilled in the art, that the pressure within the manifold 144 may be substantially the same throughout the entire manifold 144 such that the manifold pressure transducer 130 may be disposed anywhere within the manifold 144 to provide a pressure of the fluid being delivered to the wellhead 110. The hydraulic fracturing pump output pressure transducer 132 may be disposed adjacent an output of one of the hydraulic fracturing pumps 108, which may be in fluid communication with the manifold 144 and thus, the fluid at the output of the hydraulic fracturing pumps 108 may be at substantially the same pressure as the fluid in the manifold 144 and the fluid being provided to the wellhead 110. Each of the hydraulic fracturing pumps 108 may include a hydraulic fracturing pump output pressure transducer 132, and the supervisory controller 124 may determine the fluid pressure provided to the wellhead 110 as an average of the fluid pressure measured by each of the hydraulic fracturing pump output pressure transducers 132.

Each of the hydraulic fracturing pumps 108 may include a hydraulic fracturing pump profiler. The hydraulic fracturing pump profiler may be instructions stored in a memory, executable by a processor, of a controller 146. In another embodiment, the hydraulic fracturing pump profiler may be another controller or other computing device. The controller 146 may be disposed on each of the one or more hydraulic fracturing pumps 108. The hydraulic fracturing pump profiler may provide various data points related to each of the one or more hydraulic fracturing pumps 108 to the supervisory controller 124, for example, the hydraulic fracturing pump profiler may provide data including hydraulic fracturing pump characteristics (minimum flow rate, maximum flow rate, harmonization rate, and/or hydraulic fracturing pump condition), maintenance data associated with the one or more hydraulic fracturing pumps 108 and mobile power units 106 (e.g., health, maintenance schedules and/or histories associated with the hydraulic fracturing pumps 108, the internal combustion engine 107, and/or the transmission 138), operation data associated with the one or more hydraulic fracturing pumps 108 and mobile power units 106 (e.g., historical data associated with horsepower, fluid pressures, fluid flow rates, etc., associated with operation of the hydraulic fracturing pumps 108 and mobile power units 106), data related to the transmissions 138 (e.g., hours of operation, health, efficiency, and/or installation age), data related to the internal combustion engines 107 (e.g., hours of operation, health, available power, and/or installation age), information related to the one or more hydraulic fracturing pumps 108 (e.g., hours of operation, plunger and/or stroke size, maximum speed, efficiency, health, and/or installation age), and/or equipment alarm history (e.g., life reduction events, pump cavitation events, pump pulsation events, and/or emergency shutdown events).

Figure 2A:
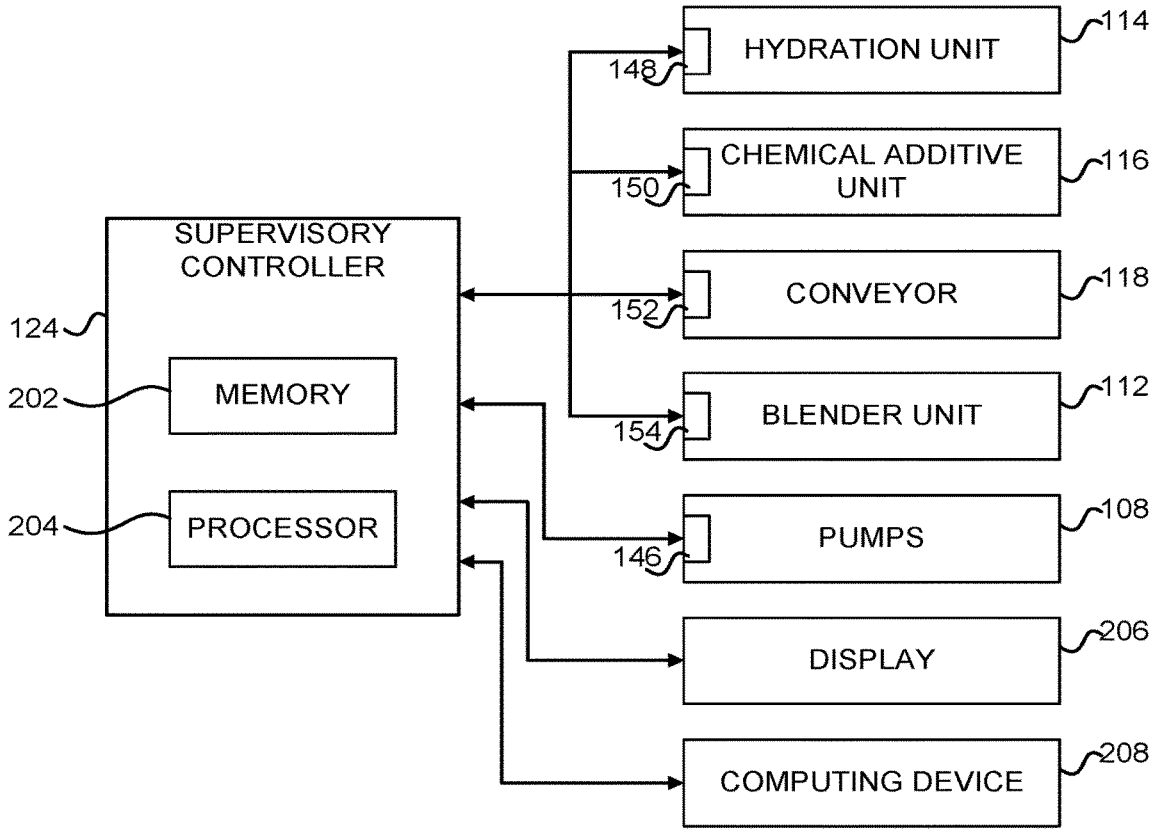
FIGS. 2A and 2B are block diagrams of a controller connected to backside equipment, hydraulic fracturing pumps, a display, and a computing device according to an embodiment of the disclosure.
Figure 2B:
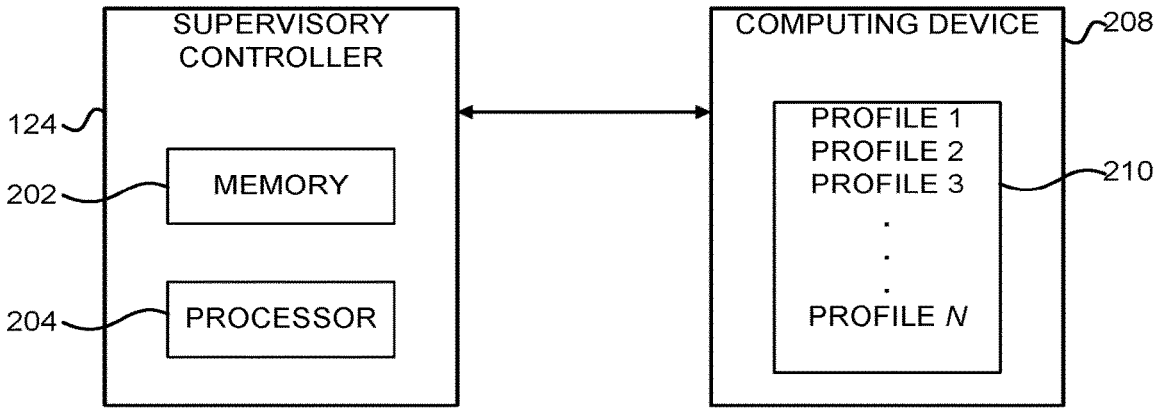

FIGS. 2A and 2B are block diagrams of a supervisory controller 124 in communication with backside equipment 120 (see FIG. 1), hydraulic fracturing pumps 108, a display 206, and a computing device 208, according to an embodiment. The supervisory controller 124 may include a non-transitory machine-readable storage medium (e.g., a memory 202) and processor 204. As used herein, a "machine-readable storage medium" may be any electronic, magnetic, optical, or other physical storage apparatus to contain or store information such as executable instructions, data, and the like. For example, any machine-readable storage medium described herein may be any of random access memory (RAM), volatile memory, non-volatile memory, flash memory, a storage drive (e.g., a hard drive), a solid state drive, any type of storage disc, and the like, or a combination thereof. As noted, the memory 202 may store or include instructions executable by the processor 204. As noted above, the supervisory controller 124 may utilize hydraulic fracturing stage profiles for hydraulic fracturing stages at the hydraulic fracture wellsite. In such embodiments, the hydraulic fracturing stage profile may include hydraulic fracturing stage parameters. For example, a hydraulic fracturing stage profile may include an amount of fluid for the hydration unit 114 to provide to the mixer 122 of the blender unit 112, an amount and type of chemicals for the chemical additive unit 116 to provide to the hydration unit 114, an amount and type of proppant for the conveyor 118 to provide to the mixer 122 of the blender 112, a flow rate of the slurry sent from the blender unit 112 to a set of the one or more hydraulic fracturing pumps 108, a flow rate for the set of the one or more hydraulic fracturing pumps 108 to indicate a flow rate from the hydraulic fracturing pumps 108 to the wellhead 110, a pressure rating for the set of the hydraulic fracturing pumps 108 to follow, and a maximum pressure for the set of the hydraulic fracturing pumps 108 to meet.

The supervisory controller 124 may include instructions stored in the memory 202, when executed by the processor 204, to determine whether previous hydraulic fracturing stage profiles are available for use in a current hydraulic fracturing stage profile. To determine that such previous hydraulic fracturing stage profiles exist, the supervisory controller 124 (in other words, the instructions executed by the processor 204) may check a local memory or other machine-readable storage medium included with or attached to the supervisory controller 124, a computing device 208, or some other specified location. In such examples, the supervisory controller 124 may include previous hydraulic fracturing stage profiles in memory 202 (as in, local memory), another machine-readable storage medium included in the supervisory controller 124, or a machine-readable storage medium connected or added to the supervisory controller 124 (such as, a USB key or an external hard drive). In another embodiment, the supervisory controller 124 may be in signal communication with a computing device 208. The computing device 208 may be a server, edge server, storage device, database, and/or personal computer (such as a desktop, laptop, workstation, tablet, or smart phone). The computing device 208 may store previous hydraulic fracturing stage profiles 210. Further, the computing device 208 may store previous hydraulic fracturing stage profiles 210 from a separate or different hydraulic fracturing wellsite. In other words, a previous wellsite at which at least portions of the wellsite hydraulic fracturing system 100 was used. As noted, the supervisory controller 124 may check the computing device 208 for any previous hydraulic fracturing stage profiles 210. The supervisory controller 124 may determine whether previous hydraulic fracturing stage profiles may be used in a current hydraulic fracturing stage profile based on the equipment available, data from the hydraulic fracturing pump profiler, and/or other data related to the wellsite hydraulic fracturing system 100.

The supervisory controller 124 may include instructions stored in the memory 202, when executed by the processor 204, to build a new hydraulic fracturing stage profile for the current hydraulic fracturing stage and/or further hydraulic fracturing stages. The supervisory controller 124 may build the new hydraulic fracturing stage profile based, at least, in part on one or more previous hydraulic fracturing stage profiles, data from the hydraulic fracturing fleet, data from one or more previous wellsites that the hydraulic fracturing fleet may have been utilized at, the hydraulic fracturing fleets alarm history, data from the hydraulic fracturing pump profiler or profilers, and/or data from the controller 146 of the one or more hydraulic fracturing pumps 108. The supervisory controller 124 may consider, when building the new hydraulic fracturing stage profile, geological data of the current wellsite and, if available, geological data of previous wellsites. For example, based on the geological data of the current wellsite, the supervisory controller 124 may set a specific type and amount of proppant and chemicals to be added to a slurry, an amount of water to be added to the slurry, and a flow rate of the slurry from the blender unit 112. In another embodiment, based on geological data and/or available hydraulic fracturing pumps 108 (availability which may be determined based on maintenance data, prior hydraulic fracturing stage completions, alerts/events, and/or other data described herein), the supervisory controller 124 may select which hydraulic fracturing pumps 108 may be utilized for a specific hydraulic fracturing stage. Other equipment and/or aspects for a hydraulic fracturing stage may be determined by the supervisory controller 124 based on other data described herein. After the new hydraulic fracturing stage profile is built, the supervisory controller 124 may prompt the user to utilize the new hydraulic fracturing stage profile for the current hydraulic fracturing stage. The supervisory controller 124 may build the new hydraulic fracturing stage profile by populating the new hydraulic fracturing stage profile with one or more hydraulic fracturing stage parameters, based on the data described above. Before selecting the new hydraulic fracturing stage profile, the user may amend new hydraulic fracturing stage profile.

The supervisory controller 124 may include instructions stored in the memory 202 which, when executed by the processor 204, may, in response to a determination the previous hydraulic fracturing stage profiles are not available (as described above), send prompts to the display 206 requesting that the user, for a current hydraulic fracturing stage, enter in, via an input device included with display 206

(described above), new hydraulic fracturing stage job parameters for a new or current hydraulic fracturing stage profile and a new or current hydraulic fracturing stage. In such examples, the instructions, when executed by the processor 204, may communicate or send a data packet including text to include on the display 206 and a form or data fields. The form or data fields may accept a user's input and include text indicating the purpose of a specific box in the form or a specific data field. The form or data fields may match or include boxes for each of the hydraulic fracturing stage parameters. In other words, the supervisory controller 124 may send a form, list, or data fields corresponding to the hydraulic fracturing stage parameters, thus, allowing a user to enter or alter or amend the hydraulic fracturing stage parameters for the new or current hydraulic fracturing stage. The instructions, when executed by the processor 204, may include an interactive save field or button. The interactive save field or button may allow the user to save entered hydraulic fracturing stage parameters as a new or current hydraulic fracturing stage profile.

The supervisory controller 124 may include instructions stored in the memory 202 which, when executed by the processor 204, may, in response to a determination the previous hydraulic fracturing stage profiles are available (as described above), communicate or send prompts to the display 206 requesting that the user, for a current hydraulic fracturing stage, accept or amend, at an input device included with display 206 (described above), one of the previous hydraulic fracturing stage profiles for the current hydraulic fracturing stage profile. In such examples, the instructions, when executed by the processor 204, may communicate or send a list of the previous hydraulic fracturing stage profiles. Each of the previous hydraulic fracturing stage profiles may be selectable by the user. In another embodiment, each of the previous hydraulic fracturing stage profiles may include two options, accept or amend.

The supervisory controller 124 may include instructions stored in the memory 202 which, when executed by the processor 204, may, in response to a selection to amend a previous hydraulic fracturing stage profile, communicate or send a request that the user amend the selected hydraulic fracturing stage profile. In such examples, the instructions, when executed by the processor 204, may communicate or send a data packet including text to include on the display 206 and a form or data fields filled in with the data from the selected hydraulic fracturing stage parameters. In other words, the form or data fields may appear the same as described above, but may be pre-filled with the data from the selected hydraulic fracturing stage profile. Any form or data field may be updated or remain as is. As described above, a save button may be included.

The supervisory controller 124 may include instructions stored in the memory 202 which, when executed by the processor 204, may prompt the user to accept the selected, new, or amended hydraulic fracturing stage profile as the current hydraulic stage profile for the current hydraulic stage profile. In such examples, the instructions, when executed by the processor 204) may communicate or send the prompt in response to an entry or amendment and save of a new hydraulic fracturing stage profile or amended selected hydraulic fracturing stage profile, respectively. In a further example, the instructions may communicate or send the prompt in response to a selection of a previous hydraulic fracturing stage profile.

The supervisory controller 124 may include instructions stored in the memory 202 which, when executed by the processor 204, may, in response to a reception of an acceptance of the selected, new, or amended hydraulic fracturing stage profile, communicate or send the current hydraulic fracturing stage profile (in other words, the current hydraulic fracturing stage parameters) to the backside equipment 120 for the current hydraulic fracturing stage. As noted above, the supervisory controller 124 may be in signal communication with the backside equipment 120. The connection between the supervisory controller 124 and backside equipment 120 may be a representational state transfer (REST or RESTful) interface, a WebSocket® interface, or some other transmission control protocol (TCP) or QUIC based interface. In such examples, the current hydraulic fracturing stage parameters may be sent from the supervisory controller 124 to the backside equipment 120 over hypertext transfer protocol (HTTP), hypertext transfer protocol secure (HTTPS), or other protocol.

After the supervisory controller 124 communicates or sends the current hydraulic fracturing stage parameters to the backside equipment 120 (blender unit 112, hydration unit 114, chemical additive unit 116, and conveyor 118) the supervisory controller 124 may wait for a confirmation of reception of the current hydraulic fracturing stage parameters. In response to a reception of the confirmation of reception of the current hydraulic fracturing stage parameters, the supervisory controller 124 may include instructions which, when executed by the processor 204, may determine a set of the hydraulic fracturing pumps 108 to be utilized based on the flow rate, pressure rate, maximum pressure, and hydraulic fracturing pumps 108 available for use.

In another embodiment, after the set of hydraulic fracturing pumps 108 are selected for the current hydraulic fracturing stage, the processor 204 of the supervisory controller 124 may execute instructions included in the memory 202 to determine whether the set of the hydraulic fracturing pumps 108 meet the pressure rate and/or maximum pressure of the current hydraulic fracturing stage profile. In another embodiment, the supervisory controller 124 may include instructions stored in the memory 202 which, when executed by the processor 204, may, in response to a determination that not all of the sets of the hydraulic fracturing pumps 108 meet the pressure rate and/or maximum pressure of the current hydraulic fracturing stage profile, notify the user which of the set of the hydraulic fracturing pumps 108 may not meet the criteria of the current hydraulic fracturing stage profile and determine if any of the set of the hydraulic fracturing pumps 108 meet a pressure rate utilization of between 50% to 98% (e.g., between 75% to 90%) of the current hydraulic fracturing stage profile. If one of the hydraulic fracturing pumps 108 do not meet a pressure rate utilization of between 50% to 98% (e.g., between 75% to 90%) of the current hydraulic fracturing stage profile, the processor 204 of the supervisory controller 124 may execute instructions to discount or remove the hydraulic fracturing pump from use in the current hydraulic fracturing stage. If one of the hydraulic fracturing pumps 108 do meet a pressure rate utilization of between 50% to 98% (e.g., between 75% to 90%) of the current hydraulic fracturing stage profile, the processor 204 of the supervisory controller 124 may execute instructions to send a prompt to the display 206 notifying a user that the user may accept use of the hydraulic fracturing pump. If a user chooses to utilize the hydraulic fracturing pump, the processor 204 of the supervisory controller 124 may execute instructions to prompt the user to enter an identification number to confirm an acceptance of the hydraulic fracturing pump.

In another embodiment, after the determination of whether to discount or remove any of the hydraulic fracturing pumps 108 due to pressure rate utilization, the processor 204 of the supervisory controller 124 may execute instructions included in the memory 202 to determine whether the set of the hydraulic fracturing pumps 108 meet the flow rate of the current hydraulic fracturing stage profile. In another embodiment, the supervisory controller 124 may include instructions stored in the memory 202 which, when executed by the processor 204, may, in response to a determination that not all of the sets of the hydraulic fracturing pumps 108 meet the flow rate of the current hydraulic fracturing stage profile, notify the user which of the set of the hydraulic fracturing pumps 108 may not meet the criteria of the current hydraulic fracturing stage profile and determine if any of the set of the hydraulic fracturing pumps 108 meet a flow rate at between 50% to 98% (e.g., between 75% to 90%) of crank RPM rating of the current hydraulic fracturing stage profile. If one of the hydraulic fracturing pumps 108 do not meet a flow rate at between 50% to 98% (e.g., between 75% to 90%) of crank RPM rating of the current hydraulic fracturing stage profile, the processor 204 of the supervisory controller 124 may execute instructions to discount or remove the hydraulic fracturing pump from use in the current hydraulic fracturing stage. If one of the hydraulic fracturing pumps 108 do meet a flow rate at between 50% to 98% (e.g., between 75% to 90%) of crank RPM rating of the current hydraulic fracturing stage profile, the processor 204 of the supervisory controller 124 may execute instructions to communicate or send a prompt to the display 206 notifying a user that the user may accept use of the hydraulic fracturing pump. If a user chooses to utilize the hydraulic fracturing pump, the processor 204 of the supervisory controller 124 may execute instructions to prompt the user to enter an identification number to confirm an acceptance of the hydraulic fracturing pump.

In another embodiment, after the determination of whether to discount or remove any of the hydraulic fracturing pumps 108 due to flow rate utilization, the processor 204 of the supervisory controller 124 may execute instructions included in the memory 202 to determine whether the set of the hydraulic fracturing pumps 108 meet a power utilization between 50% to 98% (e.g., between 75% to 80%) of maximum pressure for the current hydraulic fracturing stage profile. In another embodiment, the supervisory controller 124 may include instructions stored in the memory 202 which, when executed by the processor 204, may, in response to a determination that not all of the sets of the hydraulic fracturing pumps 108 meet the power utilization between 50% to 98% (e.g., between 75% to 80%) of maximum pressure for the current hydraulic fracturing stage profile, notify the user of the poor power utilization and prompt the operator to accept an increase in power utilization of the set of the hydraulic fracturing pumps 108. In response to an acceptance of the prompt to increase power utilization, the processor 204 may execute instructions to move one of the poor power utilization hydraulic fracturing pumps offline (in other words, remove a hydraulic fracturing pump from the set of the hydraulic fracturing pumps 108) at a time, until a desired power utilization is met. In another embodiment, the processor 204 may execute instructions to remove all of the poor power utilization hydraulic fracturing pumps offline or prompt the user to select which poor power utilization hydraulic fracturing pumps to move offline.

Figure 3:
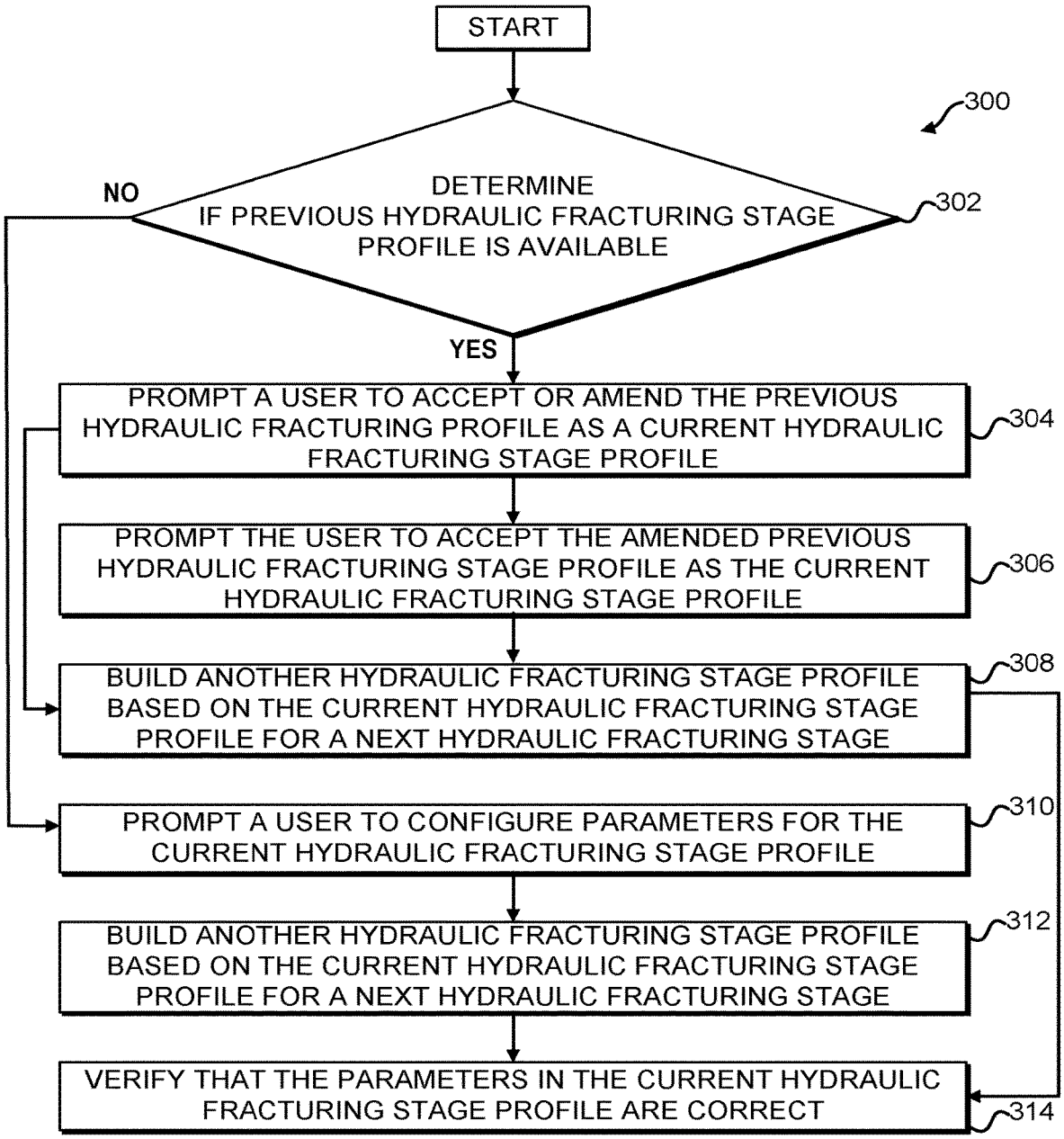
FIG. 3 is a flowchart of a method of enhanced operation of hydraulic fracturing equipment by use of hydraulic fracturing stage profiles, according to an embodiment of the disclosure.

FIG. 3 is a flowchart of example method 300 of utilizing and amending hydraulic fracturing stage profiles, according to an embodiment. The method is detailed with reference to the wellsite hydraulic fracturing system 100 and supervisory controller 124. Unless otherwise specified, the actions of method 300 may be completed within the supervisory controller 124. Specifically, method 300 may be included in one or more programs, protocols, or instructions loaded into the memory 202 of the supervisory controller 124 and executed on the processor 204. The order in which the operations are described is not intended to be construed as a limitation, and any number of the described blocks may be combined in any order and/or in parallel to implement the methods.

At block 302, the supervisory controller 124 may determine whether one or more previous hydraulic fracturing stage profiles 210 are available for use with the hydraulic fracturing equipment at the hydraulic fracturing wellsite. In an example, the supervisory controller 124 may search all storage attached or connected to the supervisory controller 124 to determine whether a previous hydraulic fracturing stage profile is available. In another embodiment, the supervisory controller 124 may determine whether a previous hydraulic fracturing stage is available for use after receiving a prompt from a user (e.g., when a user starts a process at a terminal or display 206 with an input device). In another embodiment, the supervisory controller 124 may perform the determination upon or without user intervention. For example, in response to a user opening or initiating an application, the supervisory controller 124 may initiate the determination. The supervisory controller 124, without intervention may initiate the determination after an event, e.g., the event being a completion of a previous hydraulic fracturing stage).

At block 304, supervisory controller 124 may prompt a user to accept or amend the previous hydraulic fracturing stage profile as a current hydraulic fracturing stage profile for a current hydraulic fracturing pumping stage, in response to the determination that previous hydraulic fracturing stage profiles are available for use. Stated another way, if hydraulic fracturing stage profiles are available, the supervisory controller 124 may prompt the user to accept or amend one of the available hydraulic fracturing stage profiles. In such examples, the supervisory controller 124 may list the available hydraulic fracturing stage profiles available for use. In such examples, a user may select one of the available hydraulic fracturing stage profiles for use in the next hydraulic fracturing stage. In another embodiment, supervisory controller 124 may prompt the user to select an available hydraulic fracturing stage profile while a hydraulic fracturing stage is occurring. In another embodiment, when a user selects a previous hydraulic fracturing stage to amend, the supervisory controller 124 may populate the display 206 or terminal with the hydraulic fracturing stage parameters of the selected hydraulic fracturing stage profile. The user may update or change any of the values populated on the display 206. In another embodiment, an interactive save field or button may populate the display 206 or terminal along with the hydraulic fracturing stage parameters of the selected hydraulic fracturing stage profile. After the user updates or changes the parameters, the user may save the changes or updates.

At block 306, in response to a reception of an amendment of a previous or available hydraulic fracturing stage, the supervisory controller 124 may prompt, at a display 206 or terminal, a user to accept the amended previous hydraulic fracturing stage profile as the current hydraulic fracturing stage profile. In other words, the amended previous hydraulic fracturing stage profile may be utilized, by the supervisory controller 124, as the current hydraulic fracturing stage profile for a current hydraulic fracturing stage.

At block 308, in response to either a selection or amendment of a previous hydraulic fracturing storage profile, the supervisory controller 124 may build another hydraulic fracturing stage profile based at least in part on the current hydraulic fracturing stage profile for a next hydraulic fracturing stage. The supervisory controller 124 may also base the new hydraulic fracturing stage profile on one or more previous hydraulic fracturing stage profiles, data from the hydraulic fracturing fleet, data from previous wellsites that the hydraulic fracturing fleet may have been utilized at, the hydraulic fracturing fleets alarm history, data from the hydraulic fracturing pump profiler, data from the controller 146 of the one or more hydraulic fracturing pumps 108, and/or other data relevant to a hydraulic fracturing stage, as will be understood by those skilled in the art. In other words, the supervisory controller 124 may populate the hydraulic fracturing stage parameters for the next hydraulic fracturing stage based on the data noted above. At a later time, the supervisory controller 124 may prompt a user to accept or amend the new hydraulic fracturing stage profile for the next hydraulic fracturing stage.

The supervisory controller 124 may also store the current hydraulic fracturing stage profile in memory 202 as another previous hydraulic fracturing stage profile or the new hydraulic fracturing stage profile (noted above) for the next hydraulic fracturing stage for use in association with the supervisory controller 124. In other words, the current hydraulic fracturing stage profile or the new hydraulic fracturing stage may be stored along with an indicator. In an example, the indicator may indicate which hydraulic fracturing stage the current hydraulic fracturing stage profile is to be used or utilized with. For example, a user may create, select, or amend n hydraulic fracturing stage profiles. Each of the n hydraulic fracturing stage profiles may be associated with a like numbered hydraulic fracturing stage (e.g., a n hydraulic fracturing stage profile may be associated with a n hydraulic fracturing stage, a n−1 hydraulic fracturing stage profile may be associated with a n−1 hydraulic fracturing stage, a n−2 hydraulic fracturing stage profile may be associated with a n−2 hydraulic fracturing stage, etc.). In an example, the indicator may be represented by an ID, number, letter, name, or some combination thereof. In another embodiment, a hydraulic fracturing stage may be saved as a JSON, BSON, XML, XLS, DB, or some other appropriate file type. In such examples, the name of the saved hydraulic fracturing stage profile may indicate the associated hydraulic fracturing stage.

At block 310, the supervisory controller 124 may prompt a user to configure hydraulic fracturing pumping stage parameters for the current hydraulic fracturing stage profile, in response to the determination that previous hydraulic fracturing stage profiles are not available for use. In such examples, the supervisory controller 124 may populate the display 206 or terminal with blank fields, including labels or texts to indicate the hydraulic fracturing stage parameters.

The supervisory controller 124 may store (as describe above) the current hydraulic fracturing stage profile in memory 202 as the previous hydraulic fracturing stage profile for use in association with the supervisory controller 124. In such examples, a previous hydraulic fracturing stage profile may not be available for use in either the supervisory controller's 124 memory 202 or at the computing device 208. In such examples, the supervisory controller 124 may store the current hydraulic fracturing stage profile as a previous hydraulic fracturing stage profile for potential use in a next or future hydraulic fracturing stage. As described above, the supervisory controller 124 may also build 312 a new hydraulic fracturing stage profile for the next hydraulic fracturing stage based on the current hydraulic fracturing stage profile, as well as other data, as will be understood by those in the art.

At block 314, the supervisory controller 124 may prompt the user at the terminal to verify that the hydraulic fracturing stage parameters in the current hydraulic fracturing stage profile are correct. In other words, in response to a selection, amendment, or entry of a new hydraulic fracturing stage profile, the supervisory controller 124 may send a prompt to the terminal requesting verification that the new hydraulic fracturing stage contains the correct hydraulic fracturing stage parameters for the current hydraulic fracturing stage. In such examples, the supervisory controller 124 may include the hydraulic fracturing stage parameters in the prompt for verification, thus allowing for the user to visually confirm that the hydraulic fracturing stage parameters are correct of the current hydraulic fracturing stage.

Figure 4A:
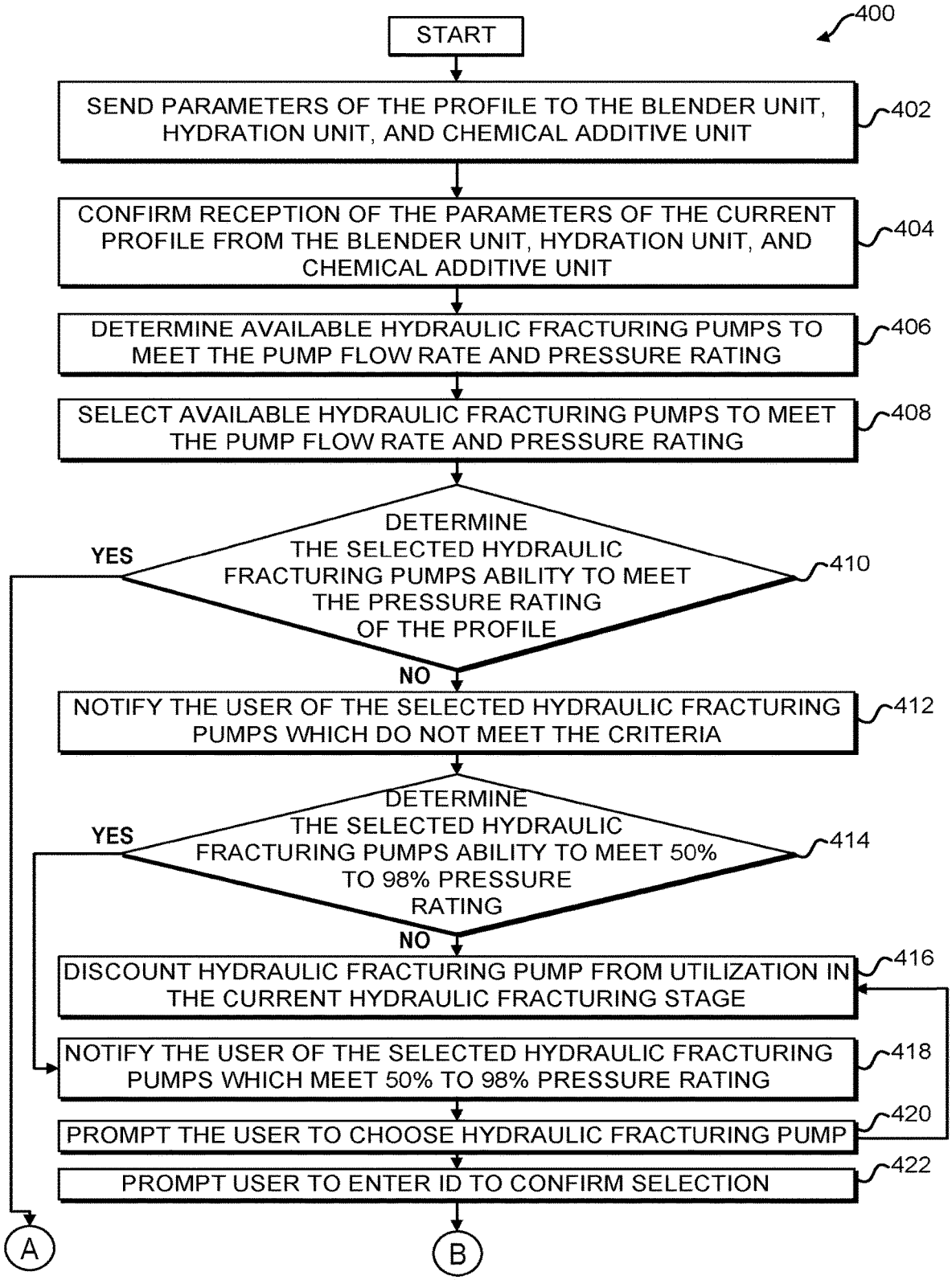
FIGS. 4A, 4B, and 4C are flowcharts of a method of enhanced operation of hydraulic fracturing equipment by use of hydraulic fracturing stage profiles, according to an embodiment of the disclosure.
Figure 4B:
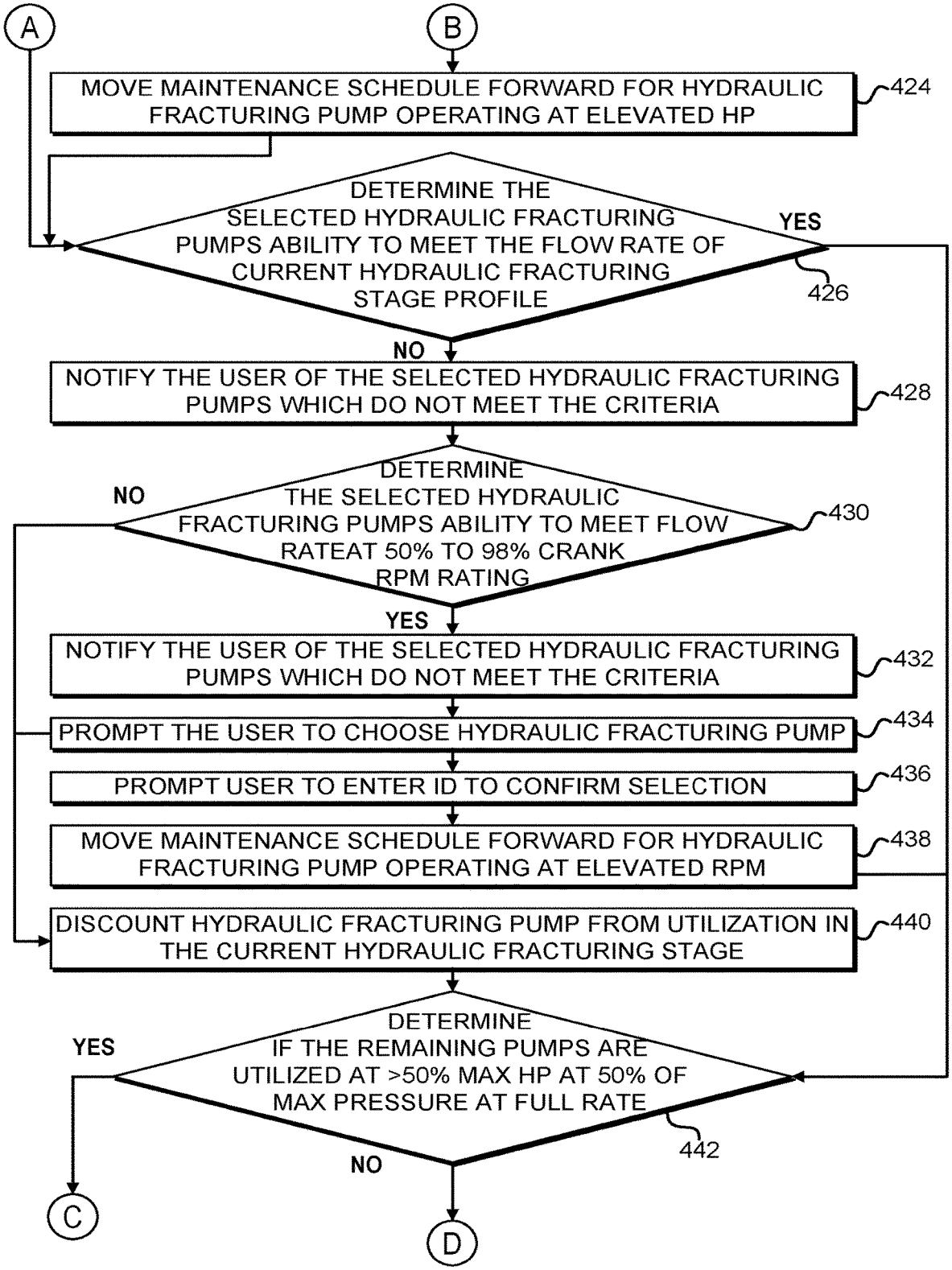
Figure 4C:
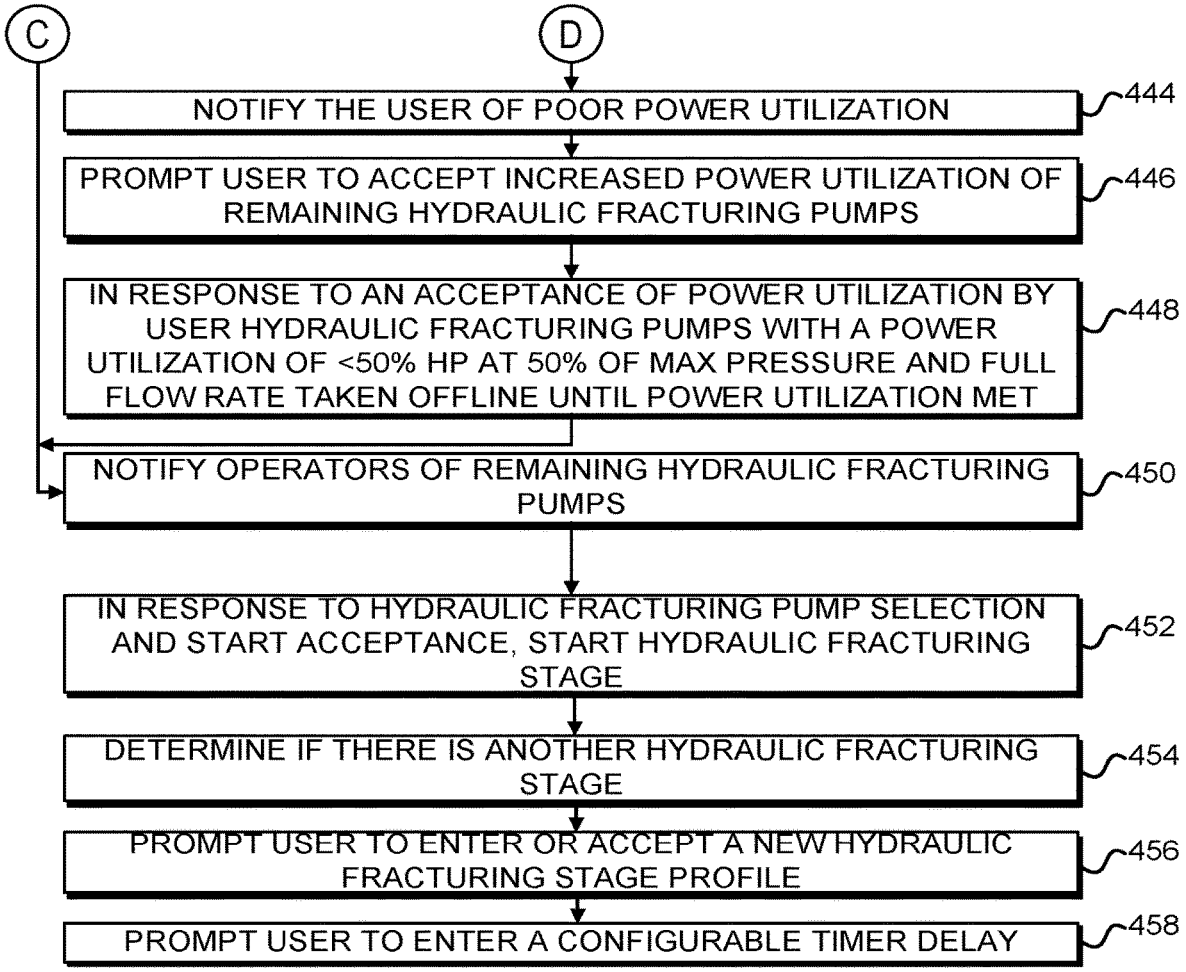

FIGS. 4A, 4B, and 4C are flowcharts of an example method 400 of utilizing and amending hydraulic fracturing stage profiles, according to an embodiment. The method is detailed with reference to the wellsite hydraulic fracturing system 100 and supervisory controller 124. Unless otherwise specified, the actions of method 400 may be completed within the supervisory controller 124. Specifically, method 400 may be included in one or more programs, protocols, or instructions loaded into the memory 202 of the supervisory controller 124 and executed on the processor 204. The order in which the operations are described is not intended to be construed as a limitation, and any number of the described blocks may be combined in any order and/or in parallel to implement the methods.

At block 402, in response to reception of a confirmation or verification that the current hydraulic fracturing stage parameters of the current hydraulic fracturing stage profile are correct, the supervisory controller 124 may communicate or send the hydraulic fracturing stage parameters of the current hydraulic fracturing stage profile to the blender unit 112, hydration unit 114, and chemical additive unit 116. At block 404, the supervisory controller 124 may confirm reception of the hydraulic fracturing pumping stage parameters of the current hydraulic fracturing stage profile from the blender unit 112, hydration unit 114, and chemical additive unit 116. In other words, before the hydraulic fracturing stage may continue, the supervisory controller 124 may wait for confirmation of reception of the parameters by the backside equipment 120. In another embodiment, the supervisory controller 124 may also communicate or send the parameters to the conveyor 118. In another embodiment, the supervisory controller 124 may communicate or send the parameters to the backside equipment 120 in a specific order. For example, the supervisory controller 124 may send the parameters to the blender unit 112 first. After confirmation of data reception by the blender unit 112 to the supervisory controller 124, the supervisory controller 124 may communicate or send the parameters to the hydration unit 114. After confirmation of data reception by the supervisory controller 124 from the hydration unit 114, the supervisory controller 124 may communicate or send data to the chemical additive unit 116. In another embodiment, the supervisory controller 124 may send the parameters to all the backside equipment 120 at once and wait for confirmation from all of the backside equipment 120 before moving on. In another embodiment, the confirmation may be sent automatically by each of the backside equipment 120. In another embodiment, a user or operator at each piece of the backside equipment 120 may verify that the parameters have been sent and are correct for the current hydraulic fracturing stage.

At block 406, the supervisory controller 124 may determine the available hydraulic fracturing pumps which meet the current hydraulic fracturing stage profiles pressure rate, maximum pressure, and flow rate. In another embodiment, the supervisory controller 124 may consider other factors in hydraulic fracturing pump availability. For example, the supervisory controller 124 may consider the hydraulic fracturing pumps' 108 maintenance schedules, current fuel levels for the internal combustion engines 107 powering the hydraulic fracturing pumps 108, which of the hydraulic fracturing pumps 108 are currently in use, and/or proximity of hydraulic fracturing pumps 108 to the wellhead 110. At block 408, based on the available hydraulic fracturing pumps, the supervisory controller 124 may select, from the available hydraulic fracturing pumps, the hydraulic fracturing pumps to meet the flow rate, pressure rate, and/or maximum pressure.

At block 410, the supervisory controller 124 may determine whether the selected hydraulic fracture pumps meet the profiles pressure rating. At block 412, if the selected hydraulic fracturing pumps do not meet the pressure rating, the supervisory controller 124 may notify a user, at the display 206, that a set of the selected hydraulic fracturing pumps do not meet the pressure rating. At block 414, after notifying the user, the supervisory controller 124 may determine whether the discounted hydraulic fracturing pumps may meet pressure utilizing 50% to 98% (e.g., 75% to 90%) of the profile pressure rating. At block 418, if the hydraulic fracturing pumps may meet 50% to 98% (e.g., 75% to 80%), then the supervisory controller 124 may notify the user. At block 420, after notifying the user, the supervisory controller 124 may send the user a confirmation on whether to use the discounted hydraulic fracturing pumps. In another embodiment, the supervisory controller 124 may send the notification and request to select the hydraulic fracturing pumps together (in other words, blocks 418 and 420 may performed simultaneously). At block 416, if the user decides to not use the hydraulic fracturing pumps or if the hydraulic fracturing pumps do not utilize at least 50% (e.g., at least 75%) of the profile pressure rating, the supervisory controller 124 may discount the hydraulic fracturing pumps. In other words, the supervisory controller 124 may remove the hydraulic fracturing pumps from the set of selected hydraulic fracturing pumps for the current hydraulic fracturing stage. At block 422, if the user decides to use the hydraulic fracturing pumps utilizing 50% to 98% (e.g., 75% to 90%) of the hydraulic fracturing stage profile pressure rating, the supervisory controller 124 may send a prompt requesting the user to enter in identification to confirm the selection. In an embodiment, the supervisory controller 124 may store the identification, a timestamp, the pumps selected, and/or some combination thereof at a local memory of the supervisory controller 124 or at a separate computing device 208. At block 424, the supervisory controller 124 may move the scheduled maintenance of the selected hydraulic fracturing pumps forward or to a sooner date and time.

At block 426, the supervisory controller 124 may determine whether the selected hydraulic fracture pumps meet the profiles flow rate. At block 428, if the selected hydraulic fracturing pumps do not meet the flow rate, the supervisory controller 124 may notify a user, at the display 206, that a set of the selected hydraulic fracturing pumps do not meet the flow rate. At block 430, after notifying the user, the supervisory controller 124 may calculate whether the discounted hydraulic fracturing pumps may meet flow rate utilizing 50% to 98% (e.g., 75% to 90%) of the crank RPM rating. At block 432, if the hydraulic fracturing pumps may meet 50% to 98% (e.g., 75% to 80%), then the supervisory controller 124 may notify the user. At block 434, after notifying the user, the supervisory controller 124 may send the user a confirmation on whether to use the discounted hydraulic fracturing pumps. In another embodiment, the supervisory controller 124 may send the notification and request to select the hydraulic fracturing pumps together or simultaneously. At block 440, if the user decides to not use the hydraulic fracturing pumps or if the hydraulic fracturing pumps do not meet flow rate utilizing at least 50% (e.g., at least 75%) of the crank RPM rating, the supervisory controller 124 may discount the hydraulic fracturing pumps. In other words, the supervisory controller 124 may remove the hydraulic fracturing pumps from the set of selected hydraulic fracturing pumps for the current hydraulic fracturing stage. At block 436, if the user decides to use the hydraulic fracturing pumps that meet flow rate utilizing 50% to 98% (e.g., 75% to 90%) of the crank RPM rating, the supervisory controller 124 may send a prompt requesting the user to enter in identification to confirm the selection. In an embodiment, the supervisory controller 124 may store the identification, a timestamp, the hydraulic fracturing pumps selected, and/or some combination thereof at a local memory of the supervisory controller 124 or at the separate computing device 208. At block 438, the supervisory controller 124 may move the scheduled maintenance of the selected hydraulic fracturing pumps forward or to a sooner date and time.

At block 442, the supervisory controller 124 may determine the hydraulic fracturing pumps power utilization. In other words, the supervisory controller 124 may determine whether all remaining hydraulic fracturing pumps being utilized for the current hydraulic fracturing stage operate at 50% to 90% maximum horsepower at 50% to 90% of maximum stage pressure at a full flow rate. At block 444, if the hydraulic fracturing pumps do not meet power utilization, the supervisory controller 124 may notify the user. At block 446, the supervisory controller 124 may prompt the user to accept an increase in power utilization. At block 448, if the user accepts the power optimization, each hydraulic fracturing pump with a poor power utilization may be taken offline serially or, in other words, one at a time until the desired power utilization it met. In another embodiment, the supervisory controller 124 may remove all hydraulic fracturing pumps not meeting power utilization.

At block 450, the supervisory controller 124 may notify the user which hydraulic fracturing pumps are to be utilized or are left for the current hydraulic fracturing stage. At block 452, after notifying the user, the supervisory controller 124 may prompt the user to confirm the hydraulic fracturing pump selection. In another embodiment, the supervisory controller 124 may communicate or send a list of the hydraulic fracturing pumps for the stage, as well as a prompt to confirm the selection. In response to a confirmation, the supervisory controller 124 may start the hydraulic fracturing stage. In another embodiment, a previous hydraulic fracturing stage may be occurring and in response to the confirmation, the supervisory controller 124 may prompt the user to enter, select, or amend another hydraulic fracturing stage profile for another hydraulic fracturing stage. At block 454, the supervisory controller 124 may determine whether there are other hydraulic fracturing stages. At block 456, the supervisory controller 124 may prompt the user to enter, select, or amend another hydraulic fracturing stage profile for further or other hydraulic fracturing stages, until all planned hydraulic fracturing stages include hydraulic fracturing stage parameters. At block 458, for further hydraulic fracturing stage profiles, the supervisory controller 124 may prompt the user to enter in a time delay. For example, when the current stage finishes, the next stage, while ready to start, may not start until after the specified time delay. The time delay may allow for a user or other personnel/operators to inspect the hydraulic fracturing equipment at the wellsite before the next stage begins. In another embodiment, rather than a time delay, the supervisory controller 124 may prompt the user to confirm the next stage before initiation.

Figure 5:
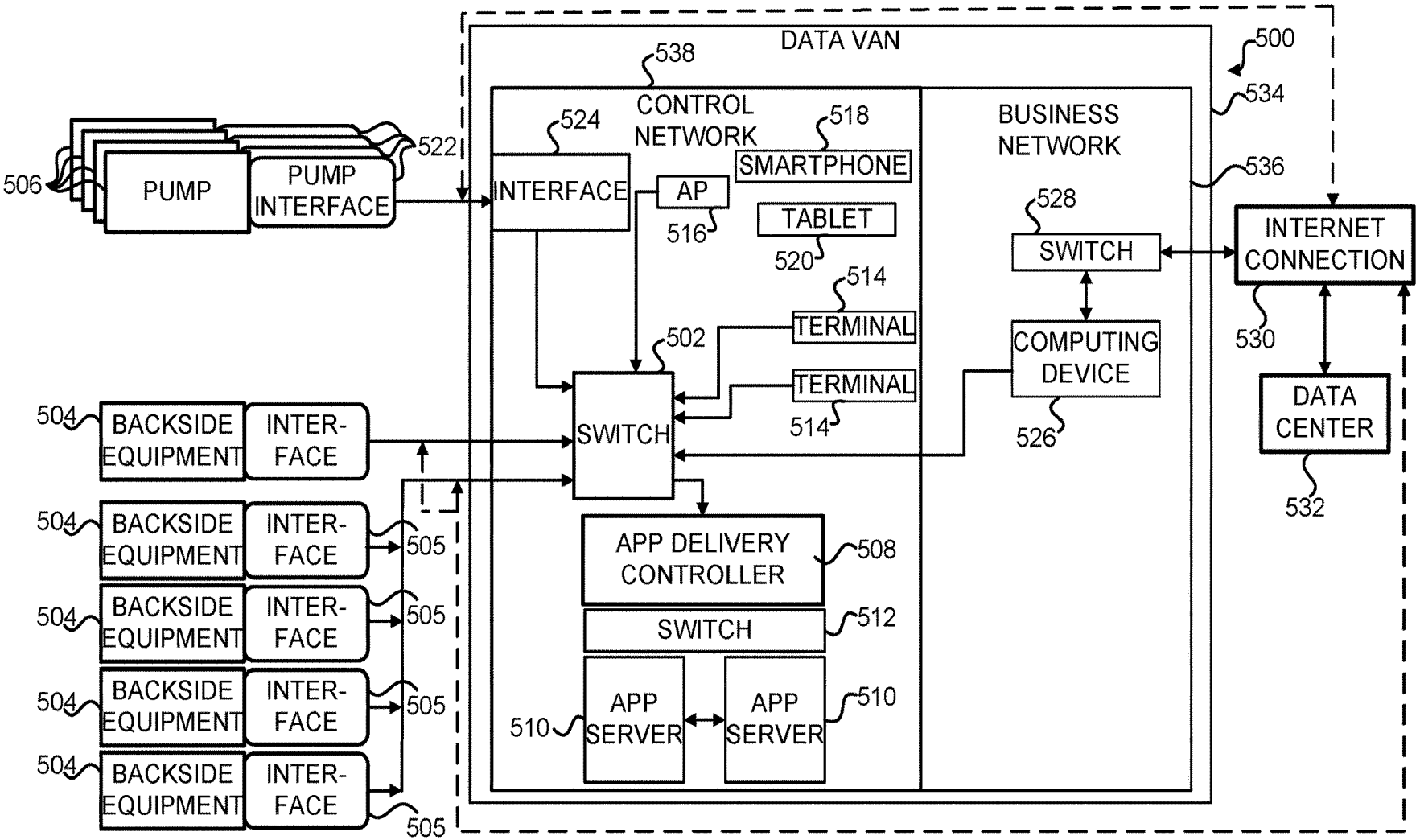
FIG. 5 is a block diagram of a wellsite hydraulic fracturing pumper system, according to an embodiment of the disclosure.

FIG. 5 is a block diagram of a wellsite hydraulic fracturing pumper system 500, according to an example. In an embodiment, the controller or supervisor may be included in a data van 534. In such an embodiment, the data van 534 may be separated into a control network 538 and business network 536. In another embodiment, the control network 538 may include the controller, as well as user displays (e.g., a user or operator terminal 514). The controller may include various electronic components. For example, the controller may include a switch (e.g., an Ethernet switch 502) to connect to the backside equipment 504 or backside equipment 504 controllers (e.g., via an interface 505 such as a REST, RESTful, or WebSocket® interface) and one or more hydraulic fracturing pumps 506 or the one or more hydraulic fracturing pumps 506 controllers to an application delivery controller 508. The application delivery controller 508 may connect to a server and backup or mirrored server (e.g., two connected and/or mirrored application servers 510) via another switch 512. In such examples, the controller may be considered the Ethernet switch 502, the application delivery controller 508, the switch 512, and the two connected and/or mirrored application servers 510. In another embodiment, the controller may be in signal communication with user or operator terminals 514. In another embodiment, the controller may connect to a wireless access point (AP) 516 or wireless router. In such examples, a user may connect to the controller via wireless signals. Further the user may connect to the controller via a smartphone 518 or tablet 520. In another embodiment, a hydraulic fracturing pump interface 522, disposed on a controller or component of each of the hydraulic fracturing pumps 506, may be in direct electrical communication with an intermediate interface 524. The hydraulic fracturing pump interface 522 may be a serial interface (e.g., a RS422 interface). In another embodiment, the hydraulic fracturing pump interface 522 may be a wireless interface. In other words, the hydraulic fracturing pump interface 522 may send data, via a wireless network, to the intermediate interface 524. The intermediate interface 524 may be in direct electrical communication or wireless communication with the controller (through the Ethernet switch 502).

As noted, the data van 534 may include a business network 536 or business unit. The business network 536 may include a computing device 526 to store the hydraulic fracturing stage profiles, as well as other wellsite data and analytics. The computing device 526 may be in signal communication with the controller. The computing device 526 may be a server. In another embodiment, the computing device 526 may be an edge server. In a further example, the computing device 526 may connect to a switch 528 to send, through an internet connection 530, data and/or analytics of the wellsite to a data center 532 for further analysis. Further, the hydraulic fracturing pumps 506 and backside equipment 504 may connect, through the internet connection 530, to the data center 532, thus providing real time data to the data center 532.

Figure 6:
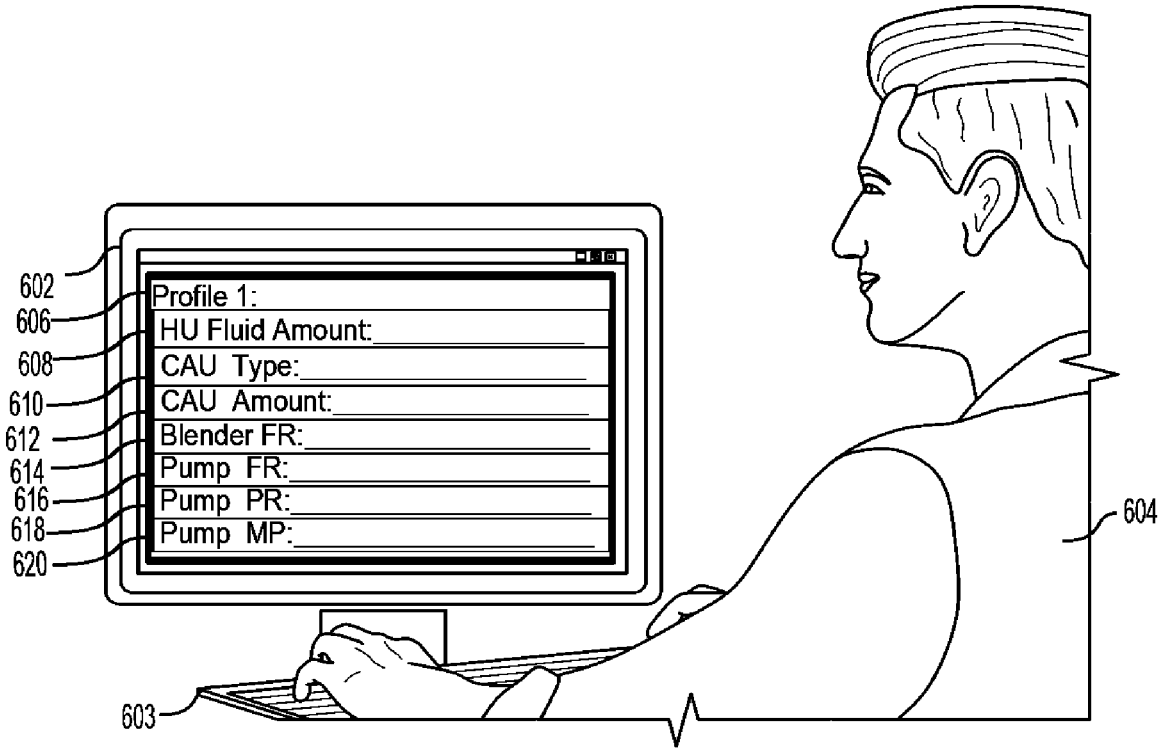
FIG. 6 is a schematic view of a display of a wellsite hydraulic fracturing system, according to an embodiment of the disclosure.
Figure 7:
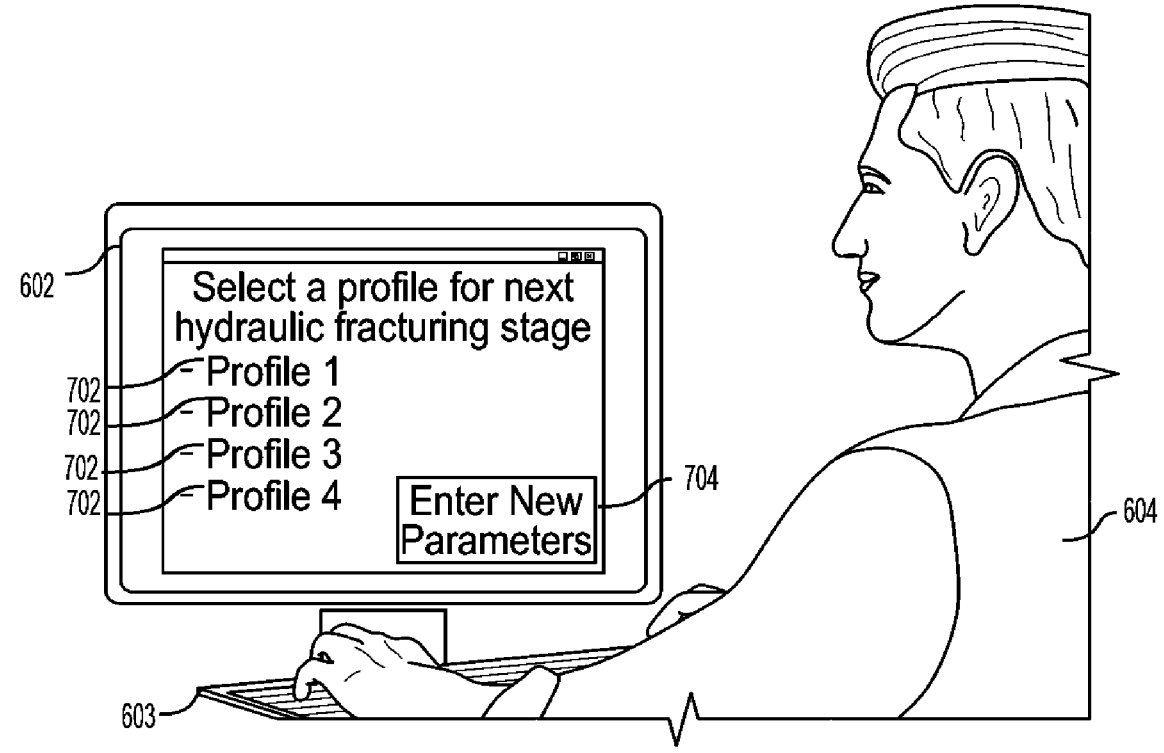
FIG. 7 is another schematic view of a display of a wellsite hydraulic fracturing system, according to an embodiment of the disclosure.
Figure 8:
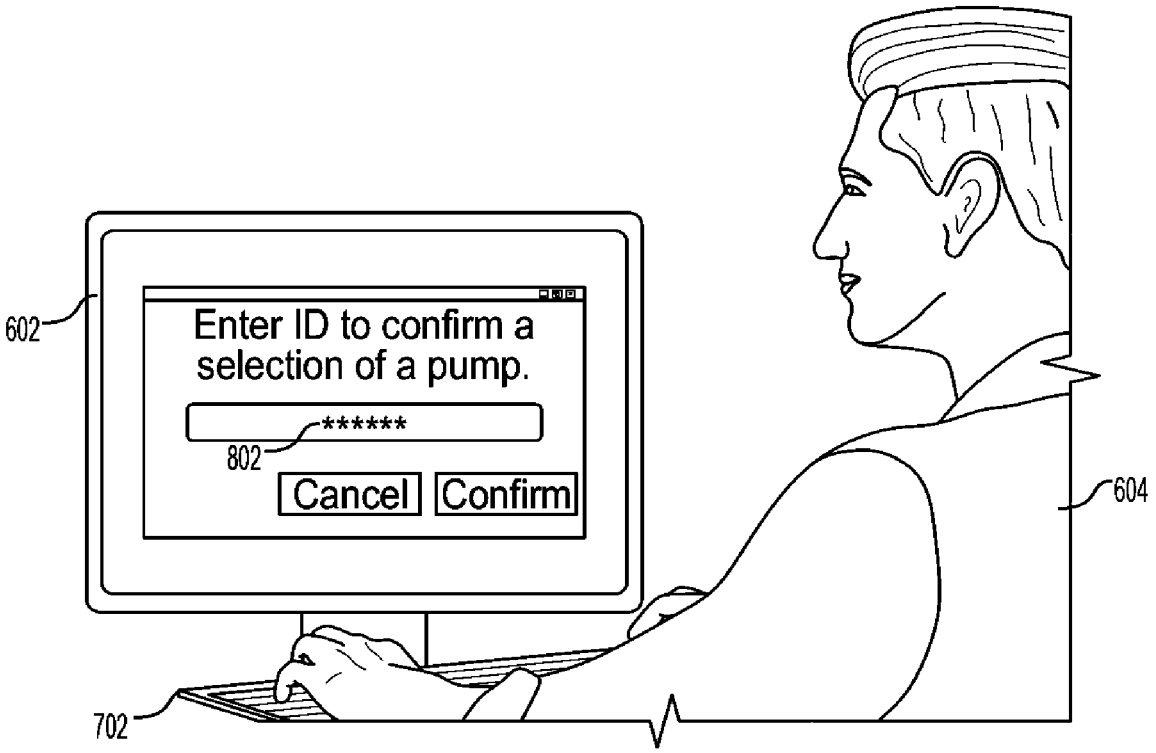
FIG. 8 is another schematic view of a display of a wellsite hydraulic fracturing system, according to an embodiment of the disclosure.

FIGS. 6, 7, and 8 are schematic views of a terminal 602, according to an embodiment. As noted, the terminal 602 or display may be in signal communication with a controller. Further, an input device 603 (e.g., a keyboard or touch-sensitive display) may be in signal communication with the controller as well, to allow a user 604 to enter data into the terminal 602. As such, the controller may send prompts or requests to the terminal 602. As shown, the controller may send a prompt for the user 604 to fill in or enter in data for a current hydraulic fracturing stage profile 606. In such examples, the current hydraulic fracturing stage profile 606 may include fields for the amount of liquid from the hydration unit 608, the amount of chemicals from the chemical additive unit 612, the type of chemicals from the chemical additive unit 610, the amount of proppant from the conveyor (not shown), the flow rate for the blender unit 614, the flow rate for the hydraulic fracturing pumps to be selected 616, the pressure rate for the hydraulic fracturing pumps to be selected 618, the maximum pressure of the hydraulic fracturing pumps to be selected 620, and/or other hydraulic fracturing stage parameters. In such examples, the user 604 may enter data into each field via the input device 603. In another embodiment, the controller may send a prompt for a user 604 to accept a hydraulic fracturing stage profile 702 for a next hydraulic fracturing stage 704. In such examples, the user 604 may select one of the hydraulic fracturing stage profiles 702, choose to amend one of the hydraulic fracturing stage profiles 702 after selecting one of the hydraulic fracturing stage profiles 702, or choose to enter in new hydraulic fracturing stage parameters 704. In response to a selection, a notification may be sent to the controller, including the option selected. In another embodiment, if a user 604 selects one of the hydraulic fracturing stage profiles 702, the controller may display a prompt to select the profile or amend the profile. In another embodiment, the controller may request that the user 604 enter in the users 604 employee identification (ID) 802 to select hydraulic fracturing pumps that do not meet the hydraulic fracturing stage profile criteria (e.g., the pressure rate, the maximum pressure, or the flow rate). In such an example, the controller may store, in response to entry of the user's employee ID 802, locally or to a computing device, the user's employee ID 802, a time stamp (in other words, when the hydraulic fracturing stage pump was selected), and/or the hydraulic fracturing pumps selected.

Figure 9:
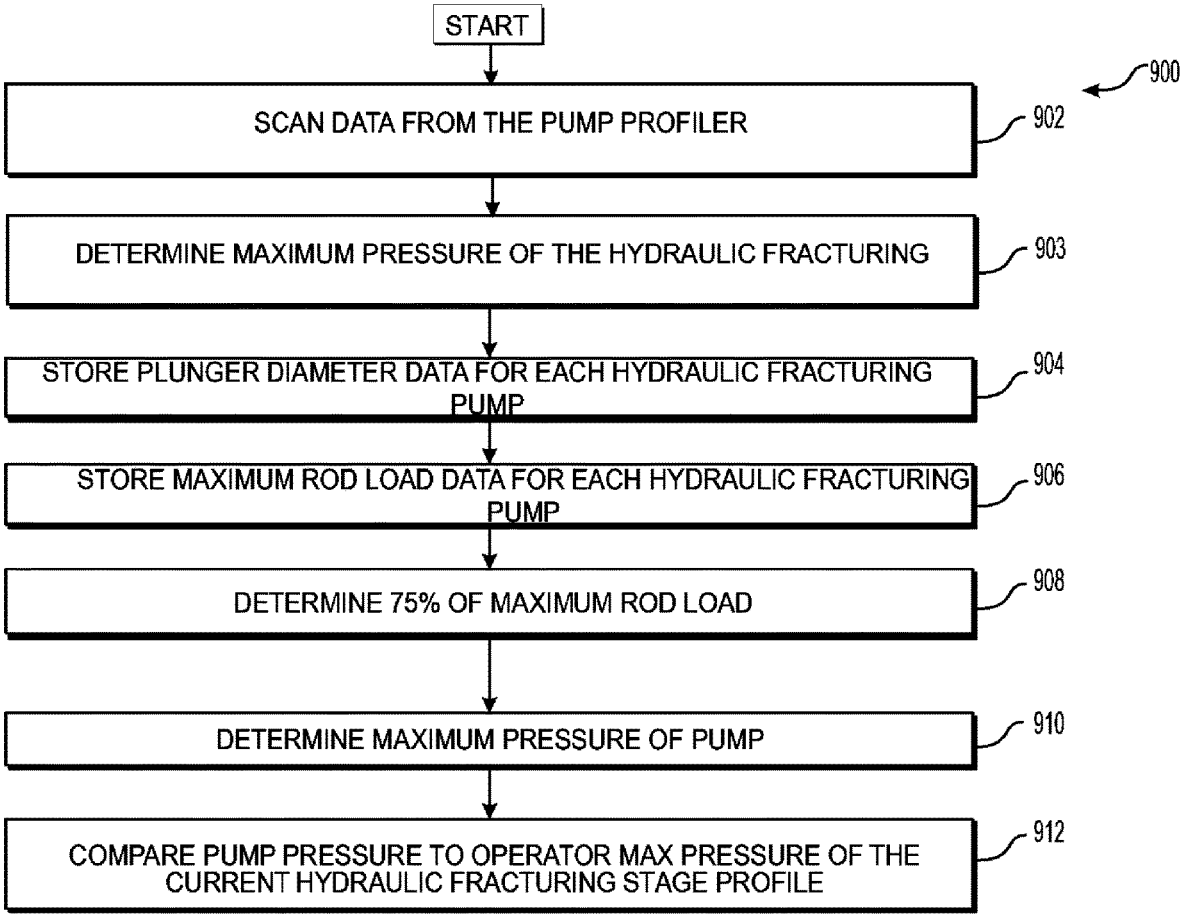
FIG. 9 is a flowchart of a method for determining hydraulic fracturing pump pressure in relation to a value in the hydraulic fracturing stage profile, according to an embodiment of the disclosure.
Figure 10:
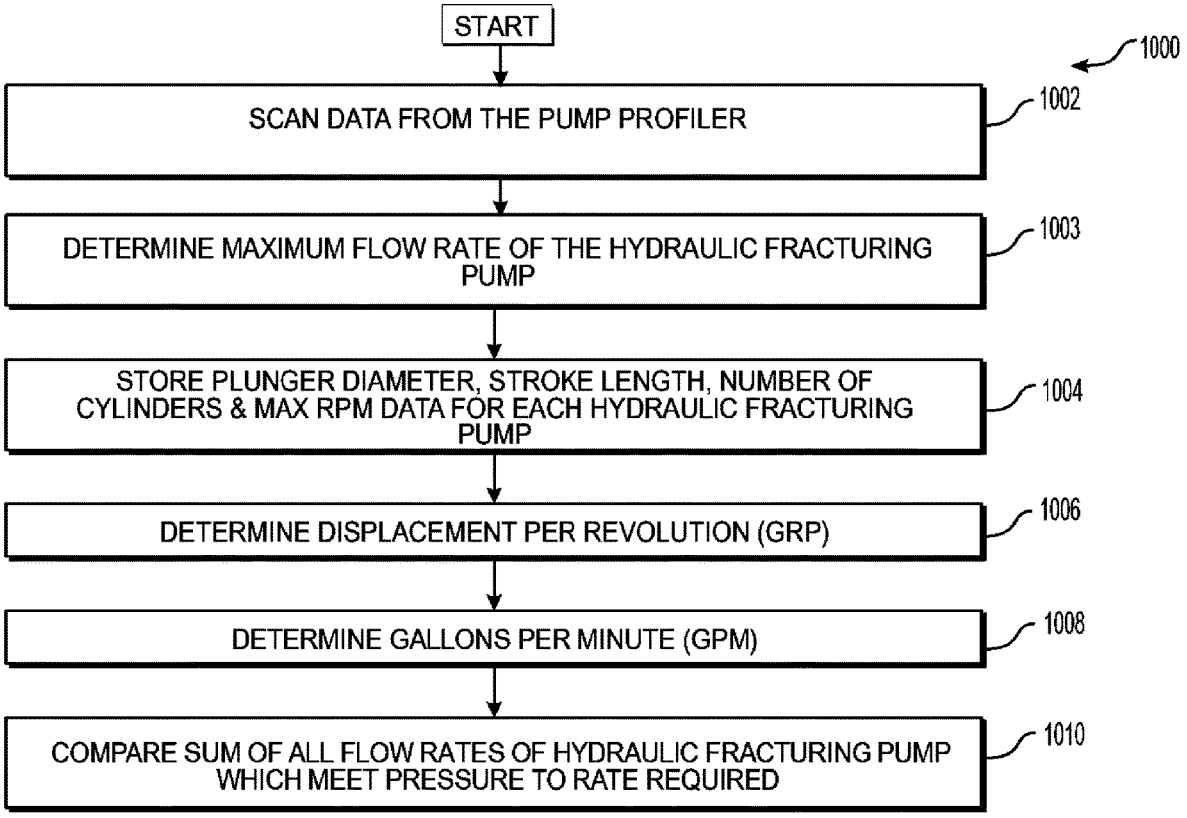
FIG. 10 is flowchart of a method for determining hydraulic fracturing pump flow rate in relation to a value in the hydraulic fracturing stage profile, according to an embodiment of the disclosure.

FIG. 9 is a flowchart of a method 900 for determining hydraulic fracturing pump pressure in relation to a value in the hydraulic fracturing stage profile, according to an embodiment. FIG. 10 is a flowchart of a method 1000 for determining hydraulic fracturing pump flow rate in relation to a value in the hydraulic fracturing stage profile, according to an embodiment. These methods are detailed with reference to the wellsite hydraulic fracturing system 100 and supervisory controller 124. Unless otherwise specified, the actions of method 900 and 1000 may be completed within the supervisory controller 124. Specifically, method 900 and 1000 may be included in one or more programs, protocols, or instructions loaded into the memory 202 of the supervisory controller 124 and executed on the processor 204. The order in which the operations are described is not intended to be construed as a limitation, and any number of the described blocks may be combined in any order and/or in parallel to implement the methods.

As noted above, the supervisory controller 124 may determine whether a hydraulic fracturing pumps pressure meets the pressure rate specified in the current hydraulic fracturing stage profile. At block 902, the supervisory controller 124 may scan a hydraulic fracturing pump's pump profiler, controller, or sensor to obtain or determine 903 the maximum pressure that the hydraulic fracturing pumps may meet. At block 904, the supervisory controller 124 may store the plunger diameter (PD) from the pump profiler. At block 906, the supervisory controller 124 may store the maximum rod load (RL) for each of the hydraulic fracturing pumps. At block 908, the controller may determine 75% of the maximum RL. At block 910, the supervisory controller 124, utilizing maximum RL, may determine the maximum pressure (PSI) of the hydraulic fracturing pump with the following equation:

$$\frac{RL}{PD^2 * .7854} = PSI$$

At block 912, the supervisory controller 124 may compare the determined pressure to the maximum pressure of the hydraulic fracturing stage profile. As noted above and in relation to method 400, the supervisory controller 124 may discount or remove the hydraulic fracturing pumps, which do not meet 50% to 90% of the pressure rating of the current hydraulic fracturing profile.

As noted above, the supervisory controller 124 may determine whether a hydraulic fracturing pumps flow rate meets the flow rate specified in the hydraulic fracturing stage profile. At block 1002, the supervisory controller 124 may scan a hydraulic fracturing pump's pump profiler, controller, or sensor to obtain or determine, at block 1003, the maximum flow rate that the hydraulic fracturing pump may pump. At block 1004, the controller may store the plunger diameter (PD), stroke length (SL), number of cylinders (NC), and/or maximum RPM for each hydraulic fracturing pump. At block 1006, the supervisory controller 124 may determine the displacement per revolution (GPR):

$$\frac{PD^2 * .7854 * SL * NC}{231} = GPR$$

At block 1008, utilizing 75% of the maximum pump RPM rating, the supervisory controller 124 may determine gallons per minute (GPM) with the following equation:

$$GPR * RPM = GPM$$

In another embodiment, the supervisory controller 124 may convert the GPM to barrels per minute (BPM). At block 1010, the supervisory controller 124 may sum all flow rates of the hydraulic fracturing pumps that meet the maximum pressure and may compare the summed flow rate to the flow rate of the hydraulic fracturing stage profile. As noted above and in relation to method 400, the supervisory controller 124 may discount or remove the hydraulic fracturing pumps which do not meet the flow rate at 50% to 90% maximum HP at 50% to 90% maximum pressure at full flow rate of the current hydraulic fracturing profile.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory machine-readable memory that may direct a computer or other programmable data processing apparatus to function in a particular manner, such that the instructions stored in the machine-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They may also be practiced with other computer system configurations, including handheld devices, multiprocessor systems, microprocessor-based or programmable consumer electronics, mini-computers, mainframe computers, and the like.

Application programs that are components of the systems and methods described herein may include routines, programs, components, data structures, etc. that may implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks may be performed by remote processing devices linked through a communications network.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

This is a continuation of U.S. Non-Provisional application Ser. No. 17/555,919, filed Dec. 20, 2021, titled "STAGE PROFILES FOR OPERATIONS OF HYDRAULIC SYSTEMS AND ASSOCIATED METHODS," which is a continuation of U.S. Non-Provisional application Ser. No. 17/500,217, filed Oct. 13, 2021, titled "STAGE PROFILES FOR OPERATIONS OF HYDRAULIC SYSTEMS AND ASSOCIATED METHODS," now U.S. Pat. No. 11,236,598, issued Feb. 1, 2022, which is continuation of U.S. Non-Provisional application Ser. No. 17/308,330, filed May 5, 2021, titled "STAGE PROFILES FOR OPERATIONS OF HYDRAULIC SYSTEMS AND ASSOCIATED METH- ODS," now U.S. Pat. No. 11,208,879, issued Dec. 28, 2021, which is continuation of U.S. Non-Provisional application Ser. No. 17/182,489, filed Feb. 23, 2021, titled "STAGE PROFILES FOR OPERATIONS OF HYDRAULIC SYSTEMS AND ASSOCIATED METHODS," now U.S. Pat. No. 11,028,677, issued Jun. 8, 2021, which claims priority to and the benefit of U.S. Provisional Application No. 62/705,332, filed Jun. 22, 2020, titled "METHODS AND SYSTEMS TO ENHANCE OPERATION OF HYDRAULIC FRACTURING EQUIPMENT AT A HYDRAULIC FRACTURING WELLSITE BY HYDRAULIC FRACTURING STAGE PROFILES," and U.S. Provisional Application No. 62/705,356, filed Jun. 23, 2020, titled "STAGE PROFILES FOR OPERATIONS OF HYDRAULIC SYSTEMS AND ASSOCIATED METHODS," the disclosures of all of which are incorporated herein by reference in their entirety.

In the drawings and specification, several embodiments of systems and methods of enhancing operation of hydraulic fracturing equipment at a hydraulic fracturing wellsite have been disclosed, and although specific terms are employed, the terms are used in a descriptive sense only and not for purposes of limitation. Embodiments of systems and methods have been described in considerable detail with specific reference to the illustrated embodiments. However, it will be apparent that various modifications and changes may be made within the spirit and scope of the embodiments of systems and methods as described in the foregoing specification, and such modifications and changes are to be considered equivalents and part of this disclosure.

What is claimed:

1. A wellsite hydraulic fracturing pumper system, the system comprising:

one or more hydraulic fracturing pumps configured to provide a slurry to a wellhead in hydraulic fracturing pumping stages and when positioned at a hydrocarbon well site, each of the hydraulic fracturing pumps comprising a gas turbine engine mechanically linked to a hydraulic fracturing pump via a drive shaft; and a controller to control the hydraulic fracturing pumps, the controller positioned in signal communication with a terminal, a computing device, and sensors included on the hydraulic fracturing pumps, the controller including a processor and a memory storing instructions, the instructions, when executed by the processor, to:

determine if the one or more hydraulic fracturing pumps are operable between 75 percent to 90 percent of a pressure rating;

in response to a determination that the one or more hydraulic fracturing pumps are operable between 75 percent and 90 percent of the pressure rating, communicate a prompt to the terminal to accept the one or more hydraulic fracturing pumps for use in a hydraulic fracturing pump stage; and in response to an acceptance of use of the one or more hydraulic fracturing pumps operable between 75 percent and 90 percent of the pressure rating, communicate a prompt requesting a user to enter identification to confirm selection of the one or more hydraulic fracturing pumps.

2. The wellsite hydraulic fracturing pumper system of claim 1, wherein the controller further includes instructions stored on the memory, when executed by the processor, to:

in response to a denial of use of the one or more hydraulic fracturing pumps operable between 75 percent and 90 percent of the pressure rating, discount the one or more hydraulic fracturing pumps; and in response to a determination that the one or more hydraulic fracturing pumps are not operable between 75 percent and 90 percent of the pressure rating, discount the one or more hydraulic fracturing pumps.

3. The wellsite hydraulic fracturing pumper system of claim 1, wherein the controller further includes instructions stored on the memory, when executed by the processor, to:

determine if hydraulic fracturing stage profiles are available for use in the hydraulic fracturing pumping stages;

in response to determination that the hydraulic fracturing stage profiles are not available for use, communicate a prompt at the terminal to enter hydraulic fracturing stage parameters for a current hydraulic fracturing stage profile and for a current hydraulic fracturing stage; and in response to a determination that the hydraulic fracturing stage profiles are available for use, communicate a prompt at the terminal to utilize one of the hydraulic fracturing stage profiles or to amend one of the hydraulic fracturing stage profiles for the current hydraulic fracturing stage profile.

4. The wellsite hydraulic fracturing pumper system of claim 3, wherein the controller further includes instructions stored on the memory, when executed by the processor, to:

in response to an entry or amendment of the hydraulic fracturing stage parameters for the current hydraulic fracturing stage profile at the terminal, store the current hydraulic fracturing stage profile to the computing device with an indicator to indicate that the current hydraulic fracturing stage profile is associated with the current hydraulic fracturing pumping stage, and communicate a prompt to the terminal requesting acceptance of the use of the current hydraulic fracturing stage profile for the current hydraulic fracturing stage.

5. The wellsite hydraulic fracturing pumper system of claim 4, further comprising:

a blender configured to provide the slurry, the slurry including fluid, chemicals, and proppant, to the hydraulic fracturing pumps;

a hydration unit to provide fluid to the blender;

a chemical additive unit to provide chemicals to the blender; and a conveyor to provide proppant to the blender;

wherein the controller is configured to control one or more of the blender, the hydration unit, the chemical additive unit, and the conveyor.

6. The wellsite hydraulic fracturing pumper system of claim 5, wherein the hydraulic fracturing stage parameters include:

an amount of fluid for the hydration unit to provide to the blender;

an amount and type of chemicals for the chemical additive unit to provide to the blender;

an amount and type of proppant for the conveyor to provide to the blender;

a flow rate of the slurry for the blender to indicate a rate of flow of the slurry to a set of hydraulic fracturing pumps;

a flow rate for the set of hydraulic fracturing pumps to indicate a rate of flow to the wellhead; and the pressure rating and maximum pressure for the set of hydraulic fracturing pumps; and wherein the controller further includes instructions stored on the memory, when executed by the processor, to:

in response to a reception of the acceptance of the use of the current hydraulic fracturing stage profile for the current hydraulic fracturing stage:

communicate the amount of fluid to be provided to the blender to a controller of the hydration unit;

communicate the amount and type of chemicals to the chemical additive unit;

communicate the amount and type of proppant to a controller of the conveyor; and communicate the flow rate of the slurry to a blender flow meter of the blender.

7. The wellsite hydraulic fracturing pumper system of claim 6, wherein the controller further includes instructions stored on the memory, when executed by the processor, to:

in response to a confirmation from the controller of the hydration unit, the controller of the chemical additive unit, the controller of the conveyor, and the blender flow meter that the hydraulic fracturing pumping stage parameters are received by the blender, hydration unit, chemical additive unit, and conveyor:

determine the set of hydraulic fracturing pumps to be utilized based on the flow rate, pressure rate, and maximum pressure in the current hydraulic fracturing stage profile and on available hydraulic fracturing pumps in the wellsite hydraulic fracturing pumper system; and determine whether the set of hydraulic fracturing pumps meet the pressure rating and flow rate for the set of hydraulic fracturing pumps of the current hydraulic fracturing stage profile.

8. The wellsite hydraulic fracturing pumper system of claim 6, wherein the controller further includes instructions stored on the memory, when executed by the processor, to:

in response to a determination that the set of hydraulic fracturing pumps meet the pressure rating and flow rate of the current hydraulic fracturing stage profile:

determine a power utilization of the set of hydraulic fracturing pumps;

in response to a determination that one or more hydraulic fracturing pumps are utilized at 75 percent maximum HP at 80 percent of maximum stage pressure and at full flow rate, communicate a notification to the terminal of poor power utilization and a prompt to accept increased power utilization of the set of hydraulic fracturing pumps; and in response to an acceptance of the increased power utilization, move one of the one or more hydraulic fracturing pumps with poor power utilization offline at a time until the set of hydraulic fracturing pumps is not a poor power utilization state.

9. The wellsite hydraulic fracturing pumper system of claim 6, wherein the controller further includes instructions stored on the memory, when executed by the processor, to:

in response to a determination that the set of hydraulic fracturing pumps are not exhibiting poor power utilization:

communicate a notification and request for confirmation of the set of hydraulic fracturing pumps to be utilized; and in response to a reception of the confirmation of the set of hydraulic fracturing pumps to be utilized, start the current hydraulic fracturing stage.

10. The wellsite hydraulic fracturing pumper system of claim 6, wherein the controller further includes instructions stored on the memory, when executed by the processor, to:

in response to a start of the current hydraulic fracturing stage, determine if further hydraulic fracturing stages are to occur; and in response to a determination that further hydraulic fracturing stages are to occur, communicate a prompt to the terminal to utilize or amend one of the hydraulic fracturing stage profiles or the current hydraulic fracturing stage profile for a next hydraulic fracturing stage, wherein the prompt is communicated during execution of the current hydraulic fracturing stage.

11. The wellsite hydraulic fracturing pumper system of claim 6, wherein the amended current hydraulic fracturing profile includes a time delay, the time delay to indicate when the current hydraulic fracturing stage begins.

12. The wellsite hydraulic fracturing pumper system of claim 6, wherein availability for use of the hydraulic fracturing stage profiles is based on maintenance data associated with the hydraulic fracturing pumps.

13. The wellsite hydraulic fracturing pumper system of claim 6, wherein availability for use of the hydraulic fracturing stage profiles is based on events associated with the hydraulic fracturing pumps.

14. The wellsite hydraulic fracturing pumper system of claim 5, wherein one or more of a maximum rod load, a plunger diameter, a stroke length, a number of cylinders, and a maximum rpm for each hydraulic fracturing pump is stored on the memory of the controller.

15. The wellsite hydraulic fracturing pumper system of claim 5, wherein the blender, the hydration unit, the chemical additive unit, and the conveyor are powered by one or more electrical generators located at the hydrocarbon well site, wherein each of the one or more electrical generators are driven by an internal combustion engine.

16. The wellsite hydraulic fracturing pumper system of claim 15, wherein the internal combustion engine and the gas turbine engine mechanically linked to a hydraulic fracturing pump are connected to a source of fuel, wherein the source of fuel comprises one or more of CNG, line gas, or well-gas produced natural gas.

17. A hydraulic fracturing pumper system, the system comprising:

a plurality of hydraulic fracturing pumps configured to provide a slurry to a wellhead in hydraulic fracturing pumping stages and when positioned at a hydrocarbon well site, each of the plurality of hydraulic fracturing pumps comprising a gas turbine engine mechanically linked to a hydraulic fracturing pump via a drive shaft;

a controller for the hydraulic fracturing pumper system, the controller comprising:

a terminal input/output in signal communication with a terminal such that the controller is configured to:

provide a prompt to the terminal to enter data for a hydraulic fracturing stage of a plurality of hydraulic fracturing stages into a first hydraulic fracturing stage profile;

receive the first hydraulic fracturing stage profile from the terminal input/output;

in response to a determination that hydraulic fracturing stage profiles are available for use, provide a prompt to the terminal requesting utilization or amendment of one of the hydraulic fracturing stage profiles for another hydraulic fracturing stage of the plurality of hydraulic fracturing stages;

receive acceptance of the use of one of the hydraulic fracturing stage profiles for the another hydraulic fracturing stage;

receive an amended hydraulic fracturing stage profile of the hydraulic fracturing stage profiles for the another hydraulic fracturing stage;

a server input/output in signal communication with a server such that each hydraulic fracturing stage profile, including indicators of associated hydraulic fracturing stages, are communicated between the controller and the server; and a first control output in signal communication with hydraulic fracturing pumps such that the controller provides pump control signals based on a stage of the plurality of hydraulic fracturing stages and an associated hydraulic fracturing stage profile.

18. The hydraulic fracturing pumper system of claim 17, further comprising:

a second output in signal communication with a blender to provide blender control signals based on the stage of the plurality of hydraulic fracturing stages and the associated hydraulic fracturing stage profile;

a third output in signal communication with a chemical additive unit to provide chemical additive unit control signals based on the stage of the plurality of hydraulic fracturing stages and the associated hydraulic fracturing stage profile; and a fourth output in signal communication with a hydration unit to provide hydration unit control signals based on the stage of the plurality of hydraulic fracturing stages and the associated hydraulic fracturing stage profile.

19. A hydraulic fracturing pumper system, the system comprising:

a plurality of hydraulic fracturing pumps configured to provide a slurry to a wellhead in hydraulic fracturing pumping stages and when positioned at a hydrocarbon well site, each of the plurality of hydraulic fracturing pumps comprising a gas turbine engine mechanically linked to a hydraulic fracturing pump via a drive shaft;

wherein each of the plurality of hydraulic fracturing pumps configured to be in signal communication with a controller for the hydraulic fracturing pumper system, the controller comprising:

a terminal input/output in signal communication with a terminal such that the controller is configured to:

provide a prompt to the terminal to enter data for a hydraulic fracturing stage of a plurality of hydraulic fracturing stages into a first hydraulic fracturing stage profile;

receive the first hydraulic fracturing stage profile from the terminal input/output;

in response to a determination that hydraulic fracturing stage profiles are available for use, provide a prompt to the terminal requesting utilization or amendment of one of the hydraulic fracturing stage profiles for another hydraulic fracturing stage of the plurality of hydraulic fracturing stages;

receive acceptance of the use of one of the hydraulic fracturing stage profiles for the another hydraulic fracturing stage;

receive an amended hydraulic fracturing stage profile of the hydraulic fracturing stage profiles for the another hydraulic fracturing stage;

a server input/output in signal communication with a server such that each hydraulic fracturing stage profile, including indicators of associated hydraulic fracturing stages, are communicated between the controller and the server; and a first control output in signal communication with hydraulic fracturing pumps such that the controller provides pump control signals based on a stage of the plurality of hydraulic fracturing stages and an associated hydraulic fracturing stage profile.

20. The hydraulic fracturing pumper system of claim 19, further comprising:

a blender, a hydration unit, a chemical additive unit, and a conveyor, each powered by one or more electrical generators located at the hydrocarbon well site, wherein each of the one or more electrical generators are driven by an internal combustion engine, wherein the internal combustion engine and the gas turbine engine mechanically linked to a hydraulic fracturing pump are connected to a source of fuel, wherein the source of fuel comprises one or more of CNG, line gas, or well-gas produced natural gas.

* * * * *